US006846270B1

(12) United States Patent
Etnyre

(10) Patent No.: US 6,846,270 B1
(45) Date of Patent: Jan. 25, 2005

(54) METHOD AND APPARATUS FOR ASSISTING OR RESISTING POSTURES OR MOVEMENTS RELATED TO THE JOINTS OF HUMANS OR DEVICES

(76) Inventor: Grant Etnyre, 21500 Califa St., #92, Woodland Hills, CA (US) 91367

( * ) Notice: Subject to any disclaimer, the term of this patent is extended or adjusted under 35 U.S.C. 154(b) by 0 days.

(21) Appl. No.: 09/513,995

(22) Filed: Feb. 26, 2000

Related U.S. Application Data

(60) Provisional application No. 60/121,689, filed on Feb. 25, 1999.

(51) Int. Cl.[7] ..... A63B 21/005

(52) U.S. Cl. ..... 482/6; 428/8; 601/23

(58) Field of Search ..... 482/1–9, 51, 900–902, 482/10; 601/23, 33

(56) References Cited

U.S. PATENT DOCUMENTS

| | | | | |
|---|---|---|---|---|
| 4,828,257 A | | 5/1989 | Dyer et al. | |
| 4,912,638 A | | 3/1990 | Pratt, Jr. | |
| 4,927,136 A | | 5/1990 | Leask | |
| 5,186,695 A | | 2/1993 | Mangseth et al. | |
| 5,201,772 A | | 4/1993 | Maxwell | |
| 5,360,383 A | * | 11/1994 | Boren | 482/10 |
| 5,512,025 A | | 4/1996 | Dalebout et al. | |
| 5,720,711 A | * | 2/1998 | Bond et al. | 601/23 |
| 6,027,429 A | * | 2/2000 | Daniels | 482/5 |

* cited by examiner

*Primary Examiner*—Glenn E. Richman
(74) *Attorney, Agent, or Firm*—Kelly, Bauersfeld,. Lowry & Kelley, LLP

(57) ABSTRACT

A process for accommodating, improving or transmuting random static and dynamic human functions to an object is provided. A device is selected which includes a proximal member and a distal member which articulate relative to one another at an interface. Energy is transmitted through the interface with a predetermined and variable efficacy. The interface is configured to permit static force to have perpendicular and parallel components relative to a primary plane of the interface and to permit a dynamic force to have a parallel component relative to the primary plane. An inertia at the interface is affected in terms of positive or negative affinity between the members and a proximity of the members to one another at the interface such that either the static or dynamic forces attract the members to one another at the interface, such that either the static or dynamic forces attract the members toward one another at the interface urging a contact whereby a tendency for a motion of one member relative to another at the interface is resisted and a tendency for the interface between the members to remain in a statically opposed position is assisted. Alternatively, the static and dynamic forces repel the members from one another at the interface urging a separation whereby a tendency for a motion of one relative to another at the interface is assisted and a tendency for the interface between the members to remain in a statically opposed position is resisted.

158 Claims, 37 Drawing Sheets

1.
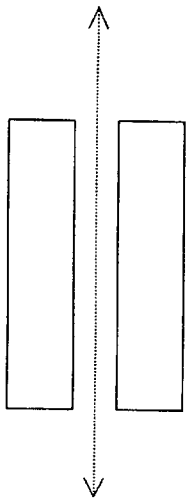
2.
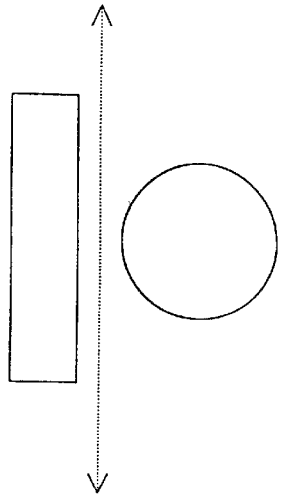
3.
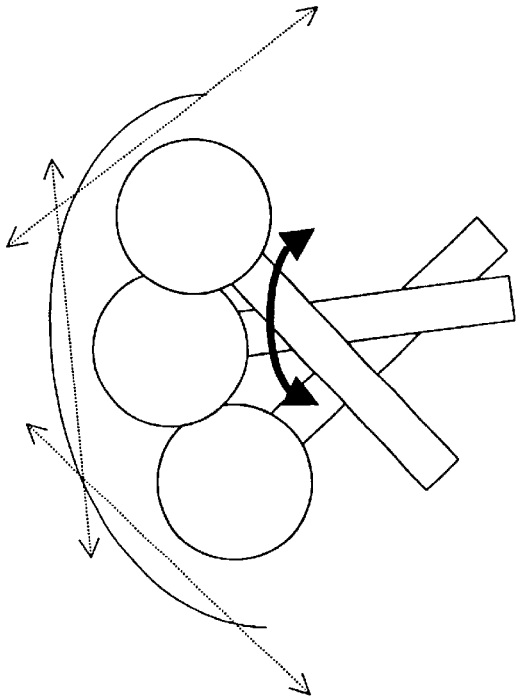
FIG 27

1.
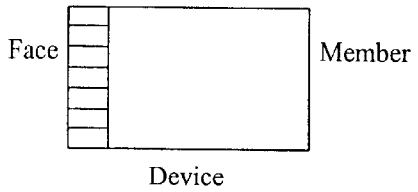
A plurality of Members, each with a plurality of Faces, articulating at Interfaces, demonstrating two Primary Planes via dashed lines, one relative to two flat surfaces, and another relative to a flat and a contoured surface. Additional faces denote Sensors, Effectors, or Portions Associable with an Object.
2.
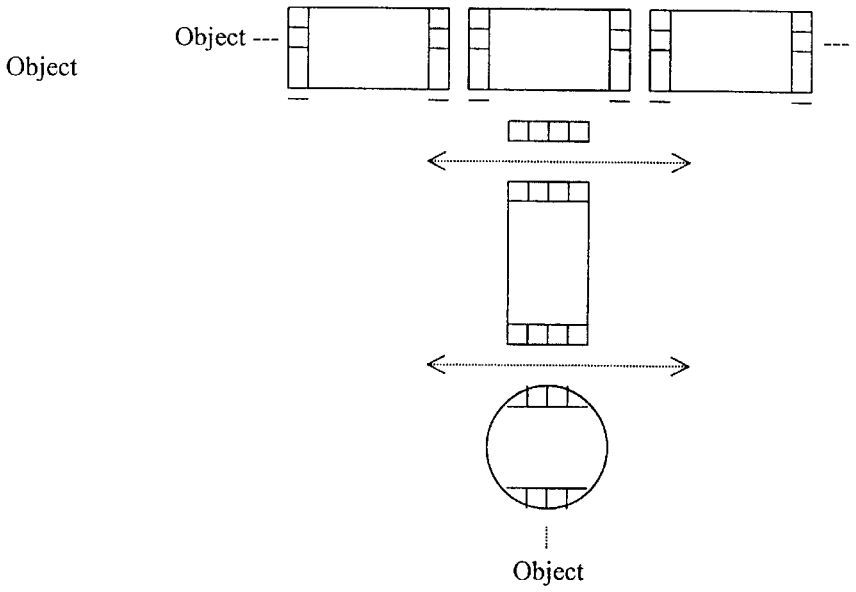
FIG 32

QUADRANT I
(SOUTH)

METHOD AND APPARATUS FOR ASSISTING OR RESISTING POSTURES OR MOVEMENTS RELATED TO THE JOINTS OF HUMANS OR DEVICES

RELATED APPLICATION

This application claims priority from provisional application Serial No. 60/121,689 filed Feb. 25, 1999.

BACKGROUND OF THE INVENTION

The present invention relates generally to positions, or postures, and motions of human body parts and other devices. More particularly, the present invention relates to a process for accommodating, improving, imitating or transmuting random static and dynamic human functions relative to an object, such as a human body-part or mechanical part.

No human is completely independent in all activities. People may or may not require assistance to execute a task. As such, a person s functional status is said to be independent if no assistance is required, assisted if partial assistance is required, and dependent if complete assistance is required to execute a given task. Therefore, a person may require no assistance or full and complete assistance, depending on the person and the specific task under consideration.

Assistance, as applied here, relates to any form of support which permits task execution. Physical assistance, in the form of extrinsic force, is the most common form of assistance required to execute a task. Extrinsic force is typically provided by another person or a device. As such, assisted or dependent individuals utilize assistance devices or the physical efforts of an assistant to execute certain tasks.

The functional status of and individual changes from the beginning to the end of life. In general, independence is gained as life waxes and is lost as life wanes. Largely dependent at birth, assistances are weaned from individuals as intrinsic efforts and abilities emerge. Accordingly, fortunes vary in terms of a person s ability to attain, maintain, and sustain independence in sorted life skills.

In our society, medicine and specifically the field of physical medicine and rehabilitation, is the profession charged with the purpose of assisting individuals to attain and regain functional independence in life skills. Many medical specialties are biased. toward providing chemicals only in attempts to optimize function, whereas physical medicine and rehabilitation more holistically stresses chemical, cognitive, spiritual, and especially physical approaches to augment function.

Physical approaches seek to affect the body mechanically. Biomechanics as a discipline seeks to describe the body in physical terms. Taken together, biomechanics and physical approaches represent the theory and application of physical forces relating to body positioning and change in positioning, or motions.

The individual s functional status determines the physical approaches offered. Dependent and assisted individuals require physical assistance in the form of passive and assistive manual approaches, whereas independent individuals execute activities, or exercises, without assistance and may resist extrinsic forces, or loads, to varying degrees.

Passive, assistive, active and resistive are terms used to describe the degree an individual participates in the effort of an activity. Resisted motions require significant intrinsic forces which surpass progressive load demands of a task. Active motions are completed independently by intrinsic forces alone, without additional resistance. Assisted motions cannot occur unless some percentage of extrinsic force is provided in addition to intrinsic force. Passive motions require extrinsic force alone, without intrinsic force. In this way, there exists a continuum of physical activity from passive to resistive, and a similar continuum of functioning from, say, the disabled individual to an elite athlete. Normal functioning lies somewhere in-between.

Therapeutic approaches aim to normalize the disabled whereas performance approaches aim to athleticize the normal. All physical approaches aim to optimize physical and functional capabilities. Physical approaches consist of exercises and manual approaches, the former prescribed as active and resistive approaches, and the latter prescribed as passive and assistive approaches, typically provided by an assistant. The existence of the assistant during manual approaches complicates the measurement of the physical forces involved, as well as efforts to standardize the application of those forces.

Accordingly, establishing validity and reliability for manual approaches has suffered in comparison to exercises, which accounts for the stigma attached to manual approaches in the Western Medical Model. A means to objectify the processes involved in manual approaches is currently lacking. Such a means would not only serve as a model for the application of manual approaches, it may also allow individuals to achieve independence sooner in the process of their rehabilitation.

In certain circumstances where an individual requires assistance, an assistive device may substitute for the assistant in order to allow independence. Using an assistive device to accomplish a goal instead of a person allows greater control of the physical forces involved, both for individuals and for researchers. The benefit of manual approaches largely rests in the extrinsic physical forces which unweigh the limb, and the benefit of exercises largely rests in the intrinsic physical forces which add resistance or rate to the limb. Each provide stabilization or motion, as desired.

Accordingly, there is a need for an assistive device capable of allowing assisted or resisted postures or motions, while either increasing or decreasing the effort required to achieve the activity. A device capable of interfacing with humans in this way may ultimately be programmed to move independently in relation to human motions, or alternatively, apart from human motion altogether, as with robotics for instance. The present invention fulfills these needs and provides other related advantages.

SUMMARY OF THE INVENTION

The present invention resides in a process for accommodating, improving, imitating, or transmuting random static and dynamic human functions, relative to an object. A device is selected which comprises a proximal member and a distal member which articulate relative to one another at an interface. Energy is transmitted through the interface with a predetermined and variable efficacy. The interface is configured to permit static force to have perpendicular and parallel components relative to a primary plane of the interface and to permit a dynamic force to have a parallel component relative to the primary plane. An inertia at the interface is affected in terms of positive or negative affinity between the members and a proximity of the members to one another at the interface such that either the static or dynamic forces attract the members to one another at the interface, such that either the static or dynamic forces attract the members toward one another at the interface urging a contact whereby a tendency for a motion of one member relative to another at the interface is resisted and a tendency for the interface between the members to remain in a statically opposed position is assisted. Alternatively, the static and dynamic forces repel the members from one another at the interface urging a separation whereby a tendency for a motion of one relative to another at the interface is assisted and a tendency for the interface between the members to remain in a statically opposed position is resisted.

A portion of the device, typically a portion of the proximal member, is associable with the object. The object is associated with the device and an activity is selected which will accomplish the purpose of accommodating, improving, imitating or transmuting random static and dynamic human functions relative to the object. A system of forces is provided to the device which interact to bring about the selected activity. The device utilizes the system of forces to create a governable degree of inertia along the interface so arranged in predetermined degrees of freedom to accommodate, improve, imitate or transmute a myriad of random human functions, including a static posture and a dynamic movement resulting from a position, a translation, a rotation, or a revolution singularly at the interface or via a combination thereof. It must be determined whether the object is associated continuously or intermittently with the device. The object can either comprise a human body-part or a mechanical part. The human body-part is typically associated with the proximal member and the mechanical part with the distal member. The associable portion of the device effectively unweights the human body-part so as to counter the affect of gravity on the human body-part.

Intrinsic forces from the human body-part and extrinsic forces from the device provide the system of forces to bring about the selected activity. The associable portion of the device is capable of providing a net extrinsic force from the proximal member to the human body-part and a net intrinsic force from the human body-part to the proximal member. A net resultant force from the system of forces creates motion of one member relative to another member. The system of forces applied at the interface act to either resist or assist movement of the proximal member relative to the distal member. Dynamic force can be created perpendicular to the primary plane of the interface. The system of forces can be created such that the motion of the object is initially assisted by the device and over time the system of forces reduces the degree of extrinsic force contribution as intrinsic force is offered and increased until the activity is performable without the assistance of extrinsic forces which then may be weaned completely providing the opportunity to subsequently enlist resistive extrinsic forces to increasingly antagonize the activity despite continued achievement of the activity in efforts to improve the function of the object.

The proximal and distal members are connected by an attachment member which limits separation and allows for displacement at the interface. Preferably, the device is articulated so as to allow smooth and free motions with variable degrees of freedom including redundant motions. The device may also include a detachable component having a detachable member.

The associable portion of the device preferably conforms to either the human body-part or mechanical part. The associable portion comprises a manipulable surface or a conformable clothing capable of transmitting forces such as a handle, glove, shoe, sock, helmet, strap, or orthotic.

The proximal and distal members each have a face adjoining the interface. The face of either the proximal or distal member may form a track which includes gates for directing the motion of the face of the other member. The gates are subject to governance. Either the proximal or distal member may form a cam surface. The interface may comprise a plurality of interfaces arranged in either parallel, series, or a combination thereof within the device. The device may comprise a plurality of devices which are associable with a plurality of objects.

Energy is transmitted across the interface of the device, typically in the form of energetic radiation, conduction, convection, or vibration to affect a facilitation of the activity. The energy transmission can be transmitted either to or from the object. Static magnetic flux density can be introduced at the interface to affect the inertia at the interface. Preferably, the magnetic flux is introduced by electromagnets. A plurality of magnetic flux density sources can be provided to create a holding or motive force at the interface.

The energy transmitted at the interface can be variably adjusted using a barrier. The barrier may include the use of a bladder having fluid characteristics which affect the system of forces. The barrier may also include a rolling member which allows linear displacement as well as angular displacement of one member relative to another member. The rolling member is engageable by a force providing source. A plurality of motor, hydraulic or electromechanical fiber sources can be provided to contribute to a net force at the interface.

The transmitted energy is subjectable to an operable governing process. The governing process is created either manually or electrically using a remote control and determined by a computer. The governance process involves the steps of creating, modifying, and eliminating data. The modifying step includes the steps of directing, magnifying, and distributing data. The governance process may also involve the steps of discerning, comparing, deciding, executing and repeating. The governance process affects the configuration and design of the interface and the forces applied thereto. The governance process can also affect a change in the direction or magnitude of the applied force. Typically, the governance process affects a change in the distribution of the applied forces both temporally and spatially.

A goal is relating to the activity is selected and during operation of the device, physical data relating to the device and the object are sensed. The physical data may be sensed using an accelerometer or a gyroscope. A governing force is created which comprises either an equilibrant or resultant force which affects a shift in the balance of the intrinsic and extrinsic system of forces. The sensed physical data is evaluated and the governing process repeated continually. The continual evaluation is conducted using a microprocessor or a computer. The governing force is based upon considerations of the sensed physical data and the goal in order to direct the system of forces to facilitate accomplishment of the goal.

The individual is interested in evaluating an achievement index to subjectively govern the level of intrinsic force provided. The achievement index is a subjective ratio of an effectiveness index to a discomfort index. The effectiveness index rates the ability to achieve the desired goal by a percentage of a total effort that was provided by intrinsic forces. The discomfort index is an indicator of subjective discomfort relative to the system of forces present. Ergonomic variables are altered according to whether the magnitude of the achievement index is strong or weak subjectively.

Pain tolerance is also evaluated. Ergonomic variables, including force applied at the interface and rate of motion, are altered when the pain tolerance has either been exceeded, or when the pain tolerance has not been exceeded and the goal has been met.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 10 may be considered one possible distal segment with the top surface used as the distal interface. The redundancy of available axial rotation serves to neutralize opposing angular moments encountered within the components when engaged with a moving proximal segment. The distal interface can deviate in any direction, along a radius from the ball member which is free to move in the vertical plane.

FIG. 27 is a schematic representation of the primary plane as it relates to different interface configurations. 1 Refers to the primary plane as parallel to flat surfaces on both sides of the interface. 2 Refers to the primary plane being parallel to a flat surface, as in 1 above, and tangential to a contoured surface. 3 Refers to the primary plane in relation to two contoured surfaces, in which the plane is seen to vary in spatial orientation depending on the relationship of the two surfaces of the interface. In any case, the primary plane is seen to be located tangentially to both surfaces, as shown. Thus the primary plane establishes the reference point for the understanding of force transmission at the interface. Static forces may mount either parallel or perpendicular to the primary plane, whereas, the independent claim below notes that dynamic forces are only allowed to mount parallel to the primary plane, unless either surface fails structurally or is configured to withstand translation perpendicular to the primary plane. Motions generally available at the primary plane are a function of the surface configuration. A flat surface allows for axial rotation, and lateral translation of a flat surface and axial rotation, rolling, and lateral translation of a convex member surface. A convex contoured surface will allow axial rotation, rolling and angular displacement and circumduction of a flat, convex, or external concave member surface, however the angular displacement and circumduction here are noted to be in reference to the former convex surface, than in relation to the latter members mentioned, and so, are not actual forms of revolution for the member, but reflect the need to combine motions of several joints to accomplish the degrees of freedom necessary for the angular displacement. A concave contoured surface will not generally accommodate a flat surface, unless the edges are configured to interact with the surface. A convex member is however allowed to axially rotate, roll, revolve in terms of angular displacement, circumduction and various combinations thereof. Wherein any of the above ramifications permits longitudinal translation perpendicular to the primary plane, then the vital motions of oblong structures, that being translation, rotation, and revolution may be combined to bring about a myriad of dynamic movements and static postures to facilitate efficient functioning and reduced joint stresses. Further, the joint play motions may be exploited to optimize available motion about a joint, which is not completely addressed by motions designed with Cartesian coordinates in mind.

FIG. 32 is a schematic drawing of the basic unit of the device, that of a member with a plurality of surfaces. Members articulate at an interface to subsequently be arranged in a variety of ways to exploit the degrees of freedom desired for movement, positioning, and force application. Some faces do not interface with other members. These faces retain the ability to transmit energy, whether it is in the form of radiation, as in electromagnetic waves or light, conduction, especially related to force and torque transmission, convection, as with hot and cold temperatures, and vibration, particularly related to positional displacement and sound wave. These free faces may represent sensors of the above energies, or effectors, capable of emitting such energies. The main energies of concern are the conductive force and torque transmission and the electromagnetic flux transmission, particularly as they relate to the ability to govern the degree of inertia (DOI) at the interface. Other forms of energy may be sensed for diagnostic purposes or emitted to facilitate in the completion of the activity. Temperature, positional displacement, sound, and light all may assist in focusing the awareness on a body part or assist in the actual release or building of body tensions for the purpose of achieving a skill. At the interface, direct conductive energy affects the system of forces as outlined in the governance section to modulate the friction of the surfaces, one relative to the other. Magnetic flux may add to the inertial resistance to movement with a positive affinity, either with the proximal surface having a positive charge and the distal surface having a negative charge or vise versa. The magnetic flux may subtract from the inertial resistance to movement if the charges are like, both positive or both negative, such that the surfaces urge a separation and thus a tendency to move and not to remain still. In the latter case, the proximity has also been affected in that it may vary, further affecting the magnetic flux affinity. The proximity, or the contact or separation of the interface surfaces, may be manipulated as well utilizing a barrier to limit contact or an attachment member to limit separation. The former not only may affect the proximity, but also the affinity of a magnetic flux by altering the magnetic permeability of the barrier. Barriers may also be configured to assist motion or resist it variably. A bladder may be used as a barrier, either relative to one member or surrounding the entire interface as an enveloping capsule. Additional barriers may be utilized within the bladder. The bladder may also assist in smoothing motions that are out of plane of the structure of the device or the operator. A plurality of magnetic flux generators may be positioned in parallel on such a bladder or barrier. An additional type of barrier may be a rolling member, as in a bearing or a wheel. Such a rolling member may be made to assist or resist displacement at the interface in numerous ways. A motor may be attached to the rolling member to provide stereotypic, programmed, or responsive motions. The rolling member may be associated with an electromagnetic source capable of generating displacement. Such displacement may be associated with a mechanical valve component capable of making motion variably unidirectional. The rolling mechanism may be controllable by the operator dynamically and manually or via computer program. Any force providing source, whether associated with a rolling member or otherwise may be governable such that the device is fully responsive to the motions of the operator, so that the device can function alternately as a passive system or an active system or a system capable of dynamic active and passive variability in real-time to accommodate random positions and motions in free space, while providing the necessary forces to support the achievement of the goal.

FIGS. 33–37 illustrate cross reference of two variables each from negative infinity to positive infinity in a graphed map format, that displays all real and imaginary numbers relative to the two variables described in the governance section as net intrinsic force (NIF) and net extrinsic force (NEF).

FIG. 33 is a general representation of this variable map.

FIGS. 34–37 each highlight one of four different regions of the general representation shown in FIG. 33. Each region is considered to be one of four main analyses to be made relative to the real numbers of each variable.

FIG. 34 illuatrates the south quadrant, which cross references both NIF and NEF, from zero to negative infinity for each, desginated as (-NIF, -NEF).

FIG. 35 illustrates the west quadrant, which cross references NIF from zero to negative infinity and NEF from zero to positive infinity, desginated as (-NIF, +NEF).

FIG. 36 illustrates the north quadrant, which cross references both NIF and NEF, from zero to positive inifinity for each, desginated as (+NIF, +NEF).

FIG. 37 illustrates the east quadrant, which cross references NIF from zero to positive infinity and NEF from zero to negative infinity, desginated as (+NIF, -NEF).

DETAILED DESCRIPTION OF THE PREFERRED EMBODIMENTS

Figure 1:
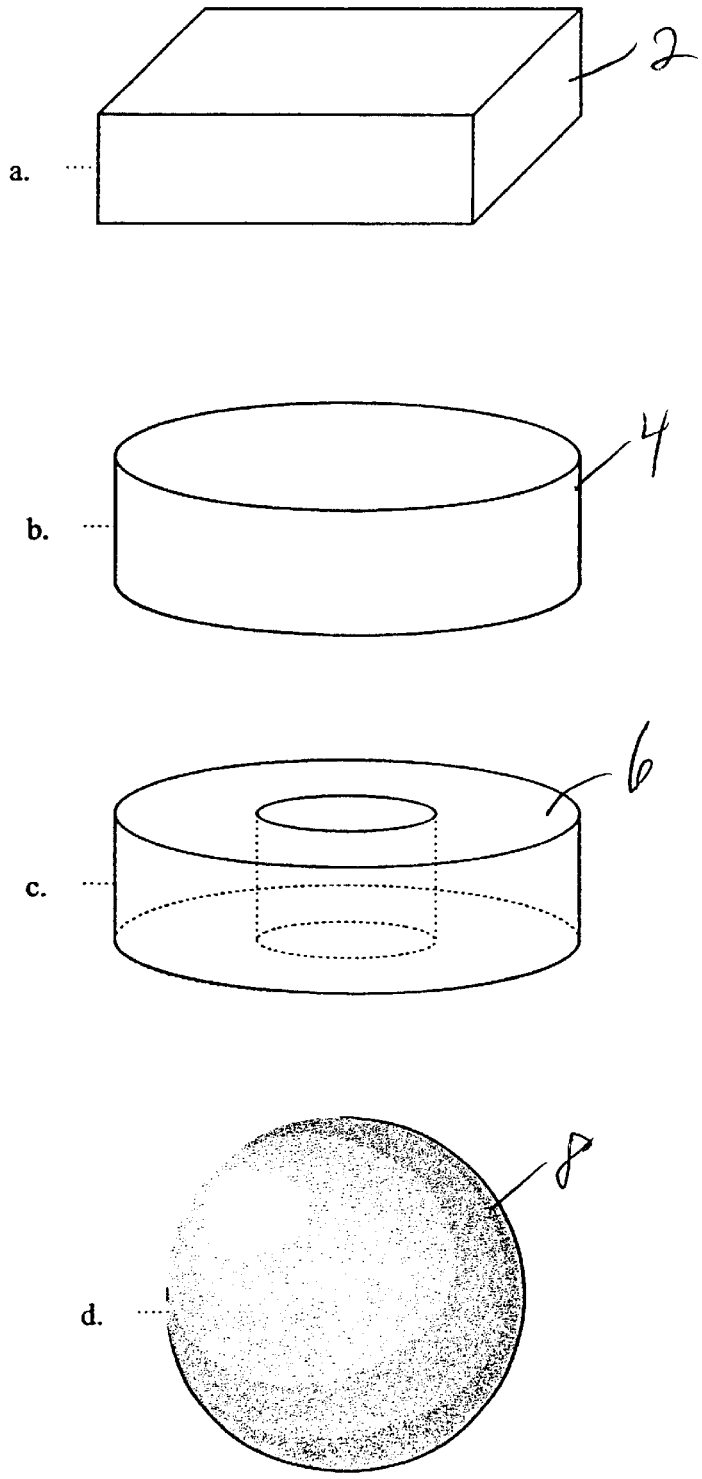
FIGS. 1*abcd* is a perspective view of four basic shapes of articulating surfaces, which may be incorporated into either a proximal segment or distal segment, for the purposes of articulating with a respective flat or curved surface.

Individuals who perceive an actual or potential threat to physical well-being seek medical attention. Sensed pain or functional disability or both may result from activity across the spectrum from functional decline to high performance activity.

Performance issues generally stress muscle contraction capabilities, whereas functional disability issues often stress range of motion capabilities and pain related to usage. The former deals with the efficiencies of how much can be done, whereas the latter generally deals with whether or not it gets done at all in the usual way, or making compensations to accomplish the task in an alternate fashion.

Many types of doctors attempt to treat such problems. Physiatrists (Fizz-i-a-trists) happen to specialize in treating patients suffering from pain and disability. These doctors practice in the field of Physical Medicine and Rehabilitation. Physiatrists coordinate multiple disciplines, as indicated, to address the problems related to pain and disability, including: doctors, nurses, social workers, psychologists, clergy, as well as physical, occupational, speech, vocational, and recreational therapists. Orthotist, prosthetists, and other technical specialists are also called in where indicated. In all, chemical, physical, spiritual, cognitive, communicative, familial, social, financial, vocational, recreational, and habitual support issues are addressed by this field s multidisciplinary approach.

Other medical fields which may involve themselves in the care of pain and disability include: Family Medicine, Internal Medicine, Neurology, Orthopedics, Rheumatology, Psychiatry, Neurosurgery, General Surgery, and other surgical specialties. These disciplines often contribute to the cognitive, chemical, or surgical approaches to pain and disability, but do little in the way of providing effective conservative physical approaches.

Whereas the cause of pain is not always certain, and treatments to reduce pain vary accordingly, improvement of physical function generally involves the implementation of a physical approach, regardless of etiology. Allopaths, Osteopaths, Chiropractors, Physical and Occupational Therapists, and trained masseuses and other technicians, all may provide various physical approaches.

All too often, however, the most socially sanctioned health care provider in the western medical model, the Allopath, or Medical Doctor, is incapable of providing effective direction in physical approaches. Most medical practitioners disregard these concerns completely or disparagingly as matters of Alternative Medicine, or leave them to physical or occupational therapists to muddle through. The standard Allopath lacks both the knowledge to guide and to follow the therapist with regard to physical approaches.

The overwhelming fact remains, accordingly, that many patients have come to their wits end with the western medical model and have instead found solace in physical approaches of one forms or another generally through other providers.

Physical approaches to pain and disability generally are considered forms of exercise or touch. Both relate to whether physical energy is expressed or absorbed by the body.

Individuals engaged in physical approaches may be considered an active participant, a passive recipient, or some combination thereof. Activities which require an additional person to manually assist the individual, in order to achieve the desired postures or motions, are called Manual Approaches. Activities which may carry out independently by individuals are prescribed as exercises.

Various manual approaches include surface or deep tissue massage, Joint Mobilization, Myofascial Release, Muscle Energy Techniques, Postural Alignment Techniques, and other specific approaches, including the techniques of Rolf, Feldenkrais, Alexander, and Palates to name a few. Manual approach providers, other physicians, books, schools, health clubs, and the media each may be a source of instruction related to manual approaches.

Exercise methods include: stretching (range of motion= ROM), anaerobic activity (strength), aerobic activity (endurance), postural work (balance, stabilization) yoga, mindfulness (choices, motivation) meditation, activity-specific training (efficiencies of performance), martial arts, sports, work hardening, Exercise means include: weights, pulley cables, elastic materials, friction, machines (gym, in-home)

Activities of daily living, self care, and mobility skills especially rely on a person s ability to function physically.

Current attempts to become fit stress aerobic and anaerobic exercises. These terms are a means of describing the process the body uses to derive energy. Aerobic exercises prompt the body to derive energy by a process using oxygen. Anaerobic means without oxygen.

Activities requiring immediate, large energy outputs are accomplished using a starch already stored in the muscle tissue. This process of energy production does not require oxygen. These activities cannot be performed for long durations due to limited supply of the starch. Activities which are done continuously, at far less than maximum output, which elevate the heart rate for long durations may be provided energy by a process which is more efficient in providing energy than by breaking down starch. This more efficient means of energy production, however, requires oxygen, and so is called aerobic.

The two forms of energy production are called into play by the body depending on the current activity of the body. Lifting as much weight as you possibly could once, or just a handful of times would be fueled by the ready energy source already in the muscle. Walking, jogging, swimming, or biking 20 minutes or more would initiate the breakdown of fats in the body for energy.

High load, low repetition activities are considered anaerobic, whereas, low load, high repetition activities are considered aerobic The body generally produces energy the most efficient way possible. This process utilizes oxygen, and so is called aerobic energy production. Oxygen assists the breakdown of fat which is mobilized during aerobic activities. When demand for energy surpasses the rate of production by aerobic metabolism, starch, already stored in muscle (or liver) tissue is mobilized to meet the immediate or substantial need. Energy production by starch breakdown does not require oxygen, and so is called anaerobic. Fatigue occurs once these stores are exhausted.

The metabolism active during fatiguing activities burns starch without using oxygen, whereas, the metabolism active during continuous activities utilizes oxygen to burn fat.

On a chemical level, the body produces energy by several processes, each a form of metabolism. As the body moves from continuous activities to fatiguing activities, it switches energy production processes from one which utilizes oxygen, aerobic metabolism, to one which does not use oxygen, anaerobic metabolism. Thus, it is convenient to call low load, high repetition activities aerobic, and high load, low repetition activities anaerobic.

While aerobic and anaerobic activities are used commonly for strengthening and conditioning, they are not always appropriate for the individual with disability or pain.

Functional movements accomplish a task of some kind. An individual must be able to perform a motion before the movement can be considered functional. Stiffness, pain, weakness, or poor control may restrict a person s functional level. Individuals in this situation may not be able to move, let alone lift, the affected body part against gravity, without support of some kind. Here, active motion, or even active-assisted motion, of the body part may prove impossible without pain or injury. In other words, the person has lost a degree of independence and now requires assistance to that degree, or injury is likely to occur. Aerobic or anaerobic conditioning is not indicated for these individuals.

These individuals need a means to unweight the body part sufficiently to use the minimum amount of muscle activation possible in order to begin moving again. Because this is largely impossible nowadays without the assistance of another individual, many such patients are instructed instead to rest the body part. The body tends to protect injured tissues by spasming neighboring muscles to absorb tension affecting that area. Motion generally becomes restricted in such areas, especially over time. If tension transmitted to these areas, however, surpasses the ability of the spasm s dampening effect, pain occurs. This pain, generated by stiffness, causes disfunction in a particular region of a person s otherwise available range of motion.

Some individuals hurt in such a way that they are able to move a given body part well, except in a particular region of their available range of motion.

The location of this region of stiffness varies widely from person to person.

Stiffness promotes further stiffness, as use generally causes discomfort prompting a person to refrain from the activity, and lack of use, or disuse, allows further adhesions to fortify the existing ones. A person is left feeling trapped in a painful body whose function is slowly collapsing. And we accept this as a natural aging process.

What is needed is a means of assisting the stretching effort of each and every body part in any posture whatsoever, despite the influences of gravity. A person needs the ability to be able to place controllable increments of tension into tight tissues in order to progress stretching tolerances from gentle, near-zero load tolerances to tolerances enduring significant load. The effects of gravity generally confound these attempts drastically by acting on and pulling on body parts involved, and forcing the individual to activate proximal structures to stabilize the body part in space. The stabilization effort may put the stiff and painful region on significant tension, more than presently tolerable, even without added load.

Manual approaches accomplish this very assistance. The limb or body part may be unweighted to any degree by the provider. Tensions in the limb are sensed by the provider in such a way that motion may be directed either into an area of restriction, away from it, or in some pattern relating to the region of restriction. In this way, subtle motions may be delivered by the provider or initiated by the receiver at or near the region of stiffness and pain without the need for the receiver to activate numerous muscle fibers related to that area, for stabilization. Force applied at the intended site may be considered effect, or signal, whereas other forces applied in the region, for stabilization purposes or otherwise, may be considered side effect, or noise. The goal then is to maximize the signal to noise ratio, or the effect to side effect ratio, so to speak. Without controlling for the effects of gravity, significant noise is created physically. Additional noise has the effect of distracting the patient from the task at hand, in addition to being potentially painful.

Relaxation, thus, is key to effective stretching. Any effort made to successfully relax the patient pays dividends on stretching, and often on pain relief as well. Attention and focus on the area of stiffness and a knowledge of the proper way to load the area, allows a new awareness to develop regarding the nature of the cause of musculoskeletal pain. Pain from tight tissues is not always understood as such until the tight tissues relax their hold, and the patient is able to appreciate the release of tension experienced in association with the relief of discomfort.

Once a patient senses the relief of discomfort associated with the release of tension of tight tissues, and the lengthening event which occurs, an awareness develops that tissues have a certain tension tolerance, based on their orientation. When the orientation is in proper alignment, tensions are dissipated properly. When alignment is altered, tissues either do not receive or transmit tensions without undue strain and potential damage to the region.

Tissues out of proper alignment no doubt respond to tension, as noted above. Too much tension causes pain or harm, whereas less tension, often subtle tensions delivered to or near the region will have the effect of shifting the tissues into proper alignment. The difference between too much and just enough tension is a subtle matter which a patient will not grasp unless given the opportunity to experience it. This knowledge is not well disseminated in the medical community let alone among the public.

Manual approaches exploit these principles but they do so with the assistance of a health care provider.

This Dependency on another individual must be weaned progressively for Independence to be regained. Accordingly, the positions and motions achieved with manual assistance are transitioned into exercises when these activities can be performed Actively.

Regarding exercise, neglect or too little physical activity may cause disuse, whereas too much physical activity or the wrong approach may cause injury or abuse. The proper approach to exercise, as well as the proper intensity, frequency, and duration will not only maintain one s current physical capabilities, but may serve to improve what is already available.

Developmental milestones track cognitive and motor skill acquisition in youngsters. These skills continue to develop or diminish throughout life, according to the nature and degree of habitual physical activity in one s chosen lifestyle. One s repertoire of physical capabilities extends from the developmentally simple to complex as fundamental tasks are stabilized and balanced, promoting acquisition of progressively more coordinated and synchronized motions.

Neglect and injury, or disuse and abuse, largely are the factors which hurt or even harm the body, reversibly or irreversibly, acutely or chronically. Tissue tightness, weakness, and pain both result from and promote further disuse and abuse, in a vicious cycle.

Injury and various problems often affect one s physical capabilities. Structural damage, pain or simply disuse may profoundly disable an individual acutely or chronically.

Aging itself is thought to be a disabling influence.

The capacity for human motion is defined by the fitness of its component parts.

Muscle contraction across joints provides for human motion. When the effort of the contraction surpasses the load of the involved body part, motion occurs. If muscles contract concurrently, they may do so synergistically or antagonistically. The agonist, or prime mover of the intended motion, acts in a direction opposite its antagonist and in a direction which is facilitated by a synergist. If muscle tissue contracts but no motion occurs, the contraction is said to be isometric, which may happen if an agonist is unable to mount an effort above that required to move a load, or alternatively if both agonist and antagonist cocontract with equal force neutralizing motion. Such cocontraction is the basis of stabilization of a body segment such that a different segment benefits from controlled motion.

Motion cannot occur without a base of support. The closer the segment is to the base, the more proximal it is. Segments become more distal the farther from the base they are.

As such, proximal stabilization is required for distal motion to occur.

Functional performance can be understood to exist along a continuum from a completely functionally disabled person to, say, an elite athlete at one s career peak. Somewhere in between exists normal capacity. Each person exists on this continuum for each task considered, and may be seen as: requiring complete assistance in carrying out the task, dependent, requiring varying degrees of assistance, needs assist, or not requiring any assistance to complete the task effectively, independent. Normality varies depending on the task in question. For the majority of the population, independent walking is generally acquired in infancy, whereas scaling a cliff is impossible without complete assistance throughout life. Guidance, memory aids, or tools may supplant the physical assistance of others or be all that is needed by some to complete certain tasks. Obviously, while many tasks have been conquered by humans, many have yet to be attempted.

Similarly, a persons approach to acquire skills or exercise is limited by the current level of physical condition and capacity. For any person, some tasks require facilitation to be acquired, others may be performed despite ample resistance to do so. Skills also diminish if not honed for some time. Disease and disability further impact a person s ability to perform, reversibly and irreversibly. Aging itself is believed by many to be disabling. A person s physical capacities, then, may be seen as being in flux. Use it, or lose it, but stay out of harm s way.

Thus the spectrum of ability in carrying out a task. While some may be able to carry out a task enduring great resistances for numerous iterations, others may be able to do so only once, twice, or not at all, even against near zero load. Such is the spectrum from the disabled, through normality, to high performance. For each task of interest, an individual must first acquire the prerequisites of the skill (the range of motion, strength, balance, stability, coordination, timing, and endurance) to be able to perform the skill even once. Having completed the task once, repeating the task against greater load and time constraints further hones performance. Attention to mindfulness and safety to prevent overt and covert sources of harm reduces risk of injury and subsequent incapacity.

To this end, persons of all functional levels endeavor to augment their capabilities by various means. Persons with medical conditions, physical ailments, disabilities of various kinds generally encounter additional barriers to improving their functional well-being. Even natural healing mechanisms in the body may be seen to hinder physical capacity over the long-term.

Inflammation, the body s chemical response to harm of any scope, promotes fibrosis, or scarring. The presence of these adhesions may serve to stabilize initially, but eventually their presence may restrict needed motions, cause pain, and insidiously rob an individual of various functions previously enjoyed. Thus the root of much physical loss in life.

To counteract these processes, individuals may strive to achieve positions and postures previously lost to regain their range of motion, and attempt progressive motions involving these positions and postures to rebuild their functional repertoire. Often such individuals are unable to due so by their own means. The force of gravity alone frequently prevents the acquisition of such postures, or if such postures are attained, current means available to the public do not sufficiently address how to facilitate motion and subsequently wean an individual from the need of assistance. Awkward postures and motions requiring poor biomechanics can similarly be addressed without much of the confounding effects of gravity, while focusing on motion in desired planes or combination movements.

Contractions occur when activated or reflexively to support the muscle when it is placed on tension. Contraction may be understood as a force acting on the muscle tissue to shorten it. Stretching, on the other hand, involves forces acting on muscle tissue to lengthen it. Thus the two forces are antagonistic, and may be imposed on the same muscle simultaneously. If these moments are of equal force, they will be neutralized, and if they are the only forces acting about the joint of concern, the muscles length will remain constant, another means of isometric contraction. If the shortening moment surpasses the lengthening moment, the muscle will shorten and the event is said to be concentric contraction. If, instead, the lengthening moment surpasses the shortening moment, the lengthening muscle will be said to be undergoing eccentric contraction. Concentric contractions are often found to accelerate joint motion in the direction of agonist pull, whereas eccentric contractions are found to decelerate joint motion in the direction of the agonist pull. The lengthening moment above may be due to an external force (the push or pull of a load, e.g.) or an internal force (the antagonist, or one of its synergists). Therefore, what is a shortening moment for an agonist is a lengthening moment for an antagonist, and vise versa. If cocontraction occurs, any joint motion involves a combination of concentric and eccentric contractions, depending on the perspective of which muscle is the agonist. Such is the nature of fine control of joint motion under load.

Both agonist and antagonist fire to finely controlled degrees to balance the summation of the forces involved to accomplish the intended motion. The less the load, the less the cocontraction required to provide stabilization and fine control. Fine control under significant load cannot occur skillfully, and often safely, unless such control was established under conditions of reduced load, absent load, or motion facilitated by external assistance.

Humans experience motion physically in terms of distance, velocity, acceleration, force, work, and power. In relation to the ground, other objects, and animals, human motion is frequently described in kinematic and kinetic terms, the former referring to the linear and angular displacement and positional rates of change, and the latter referring to mass, force, and gravity, among other issues.

The musculoskeletal and neuromuscular systems account for the mechanics and the control of human motion respectfully. Motion control involves energy transduction by the neuromuscular system from chemical to physical. The musculoskeletal system generates force required to accelerate, maintain, or decelerate all or part of the body relative to its current state of inertia external forces must be taken into account when considering human motion including gravity, other objects, of various mass moving at various rates, etc.

Natural history and its problems (dynamic)

The structures of the body normally respond to the types and degrees of human motion. Immobilized muscle and bone experiencing immobilization or low levels of activity than previous tend to wither, whereas, the quality of bone muscle, cartilage, and other tissues improves with usage, to a point. Less than normal usage is associated with brittle bones, weak, atrophic muscles, and poor joint alignment and subsequent mechanics. Moderate usage above normal loads promotes stronger bones and muscles and smoother articular ROM and mechanics. In this way, human capacity for motion adapts to usage patterns.

Human capacity (supply) strives to meet usage patterns performed/required (demand)

When supply can meet the demand of the motion the body is physically healthy/conditioned. The body may lose conditioning or become injured if there is a supply/demand mismatch. Tissues are injured if the demand is much greater than the supply, especially if the load is high or even with low load and high repetition or body configuration with poor mechanics is used even for short time or near (but not) proper mechanics for long time.

Ergonomic variables are studied in attempt to understand why the body is injured by various motions or positions. When tissues are disused or abused pain and dysfunction often result. Pain and dysfunction may promote further disuse or injury depending on a person s conduct. Rehabilitation approaches to promote function and dissuade dysfunction include medical, cognitive, emotional, spiritual, and physical approaches.

Each person s habits is the end result of a life s physical motion behavior patterns. No chemical will undo this effect. Physical approaches are offered via manual medicine practitioners with significant success rates. research is difficult to conduct using manual medicine approaches due to the bias and control issues inherent to this approach.

Several means of applying manual medicine involve movement in the following ways: distraction-compression, circumduction, rotation. Human-device motion is easier to study than human-human interface, as a device may objectively record feedback and vary output quantifiably without bias.

Therefore, a device is needed to provide for these motions without the need for an observer-interface.

The present invention is a method for assisting or resisting postures or motions related to the joints of humans and devices. With reference to the drawings which illustrate preferred embodiments of the present invention for purposes of illustration, FIG. 1*a* is a rectangle 2 or square, or any such form exploiting ninty-degree angles. FIG. 1*b* is a disk 4, or any form exploiting both flat and curved faces. FIG. 1*c* is a ring 6 or any such topological form with flat and/or curved faces having one, or more than one, hole. FIG. 1*d* is a solid or hollow body, depicted here as a sphere 8, where the articulating face may be either external or internal.

Figure 2:
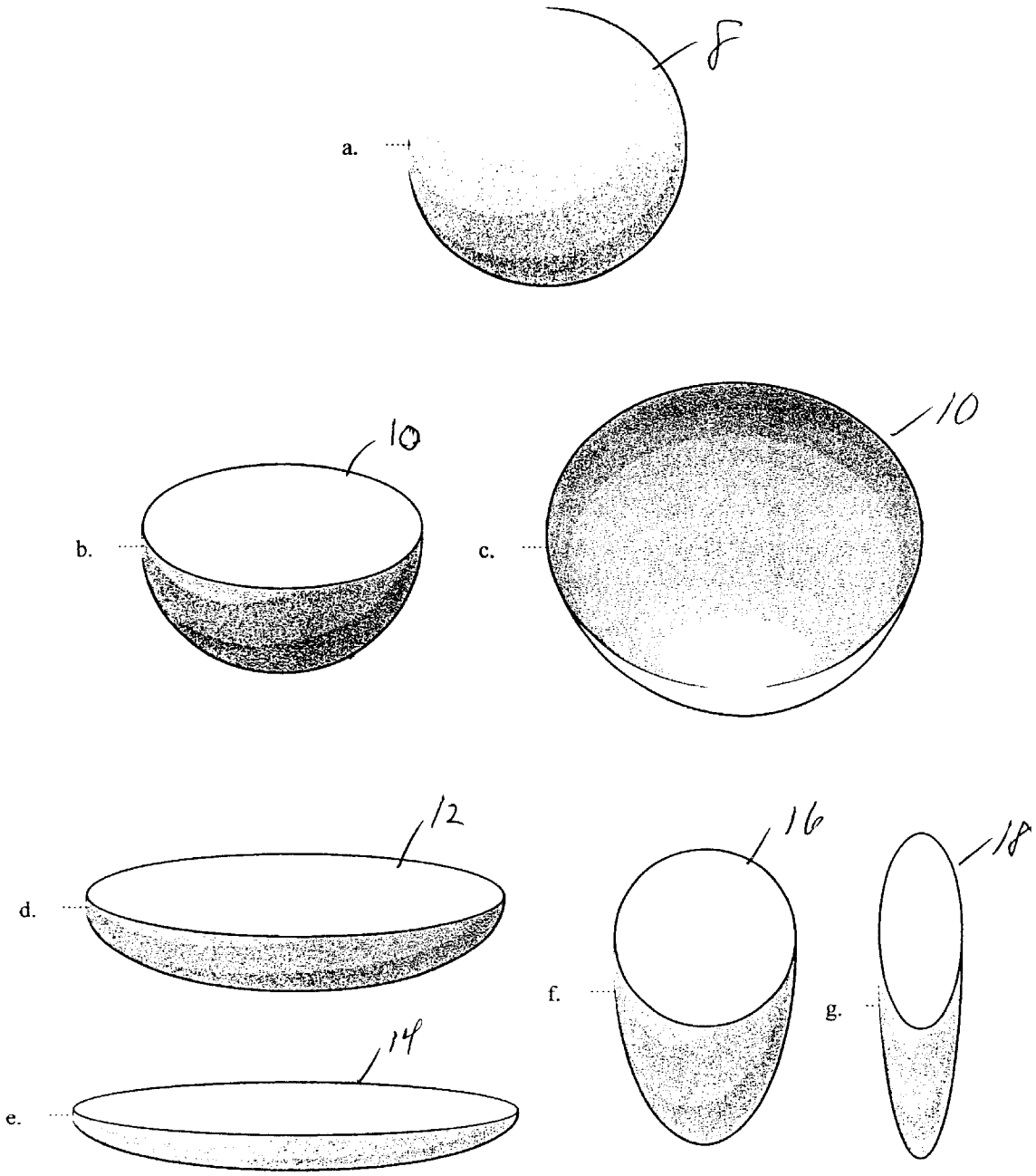
FIGS. 2*abcdefg* is a perspective view of a solid or hollow body and sections of the body in various distortions.

FIG. 2*a* is the body 8 illustrated in FIG. 1*d*. FIG. 2*b* is a sectioned sphere 10, or body, emphasizing the convex aspect as the articulating face. FIG. 2*c* is FIG. 2*b* from a more top-perspective view emphasizing the concave aspect as the articulating face. FIGS. 2*defg* each represent convex articulating surfaces 12–18 of various distortions.

Figure 3:
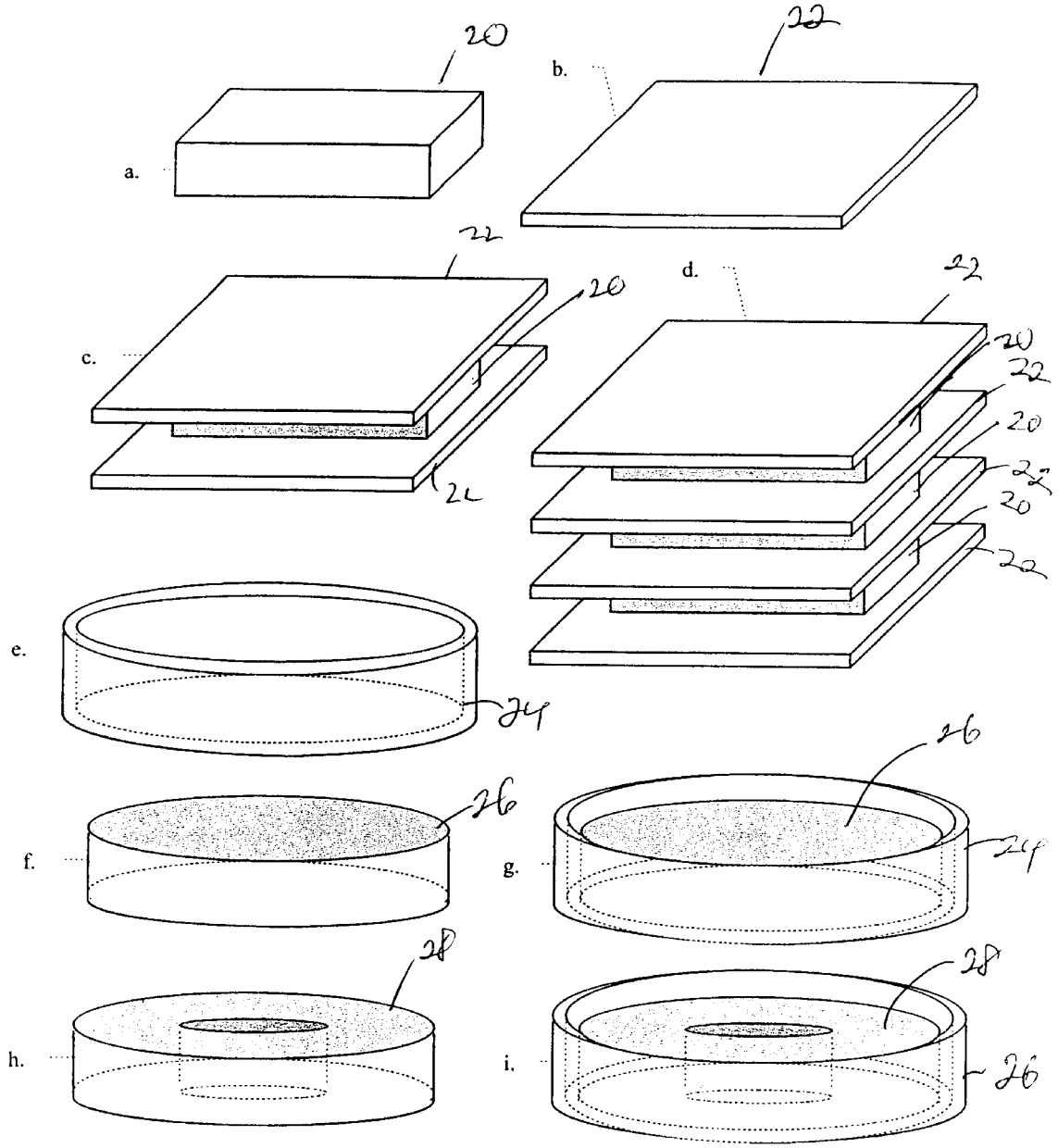
FIGS. 3*abcdefghi* is a perspective view of components of commercially available magnets.

FIG. 3*a* illustrates a basic ceramic ferrous magnet 20. FIG. 3*b* illustrates a conducting metal 22. FIGS. 3*c* and 3*d* illustrate the combining of magnet and metal 20 and 22, done for the purpose of varying the magnetic force. FIG. 3*e* illustrates a conducting metal casing 24 in the form of a cylinder with one closed end. FIG. 3*f* illustrates a disk magnet 26, and FIG. 3*g* illustrates the disk of FIG. 3*f* mounted within the casing of FIG. 3*e*. FIG. 3*h* illustrates the ring magnet 28, and FIG. 3*i* illustrates the ring 28 mounted in the casing 26 of FIG. 3*e*, as well.

Figure 4:
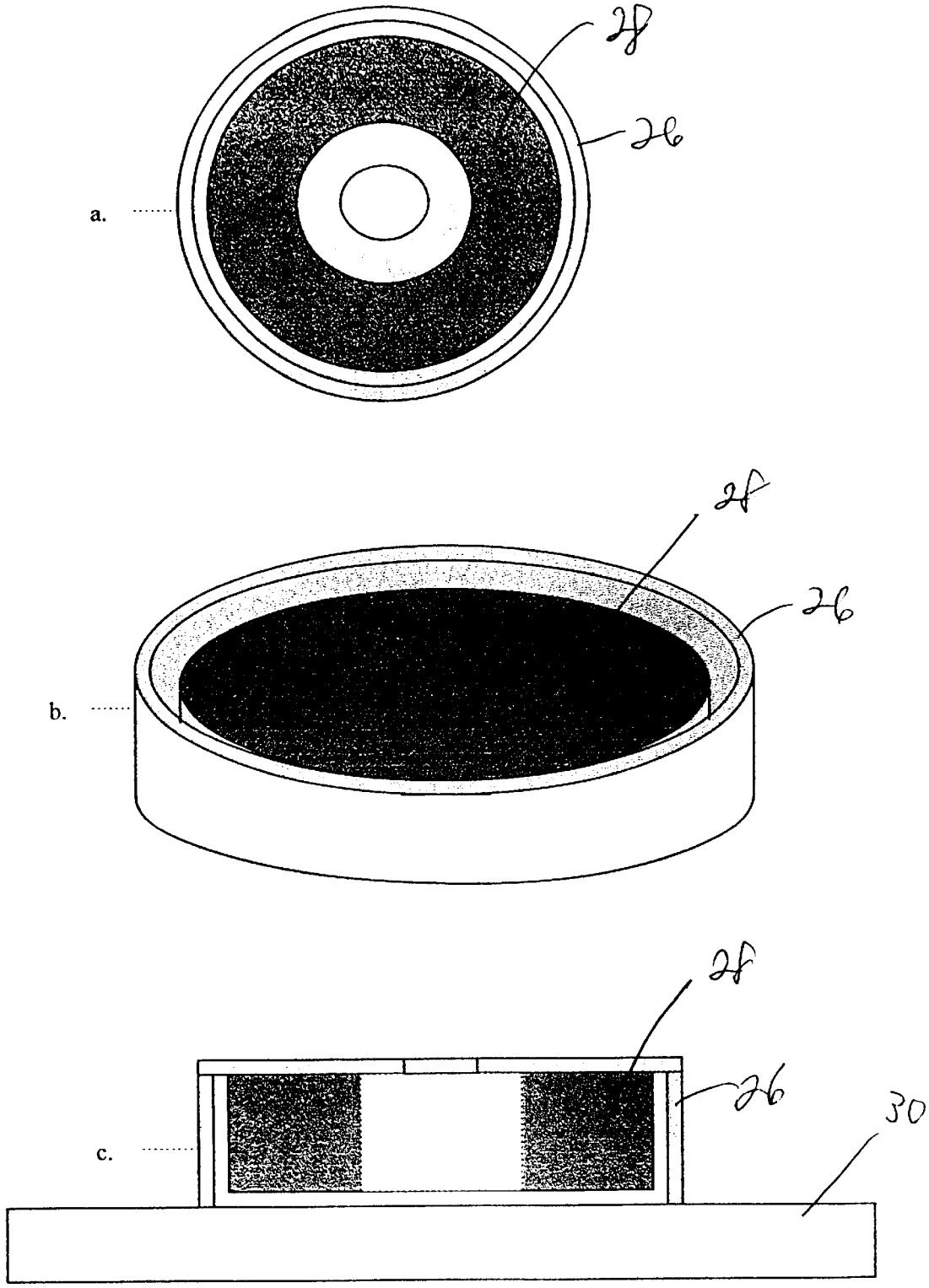
FIGS. 4*abc* illustrates the ring magnet mounted in its metal casing, and the relationship of the two to an articulating surface.

FIG. 4*a* is a bottom view, whereas FIG. 4*b* is a perspective, bottom view of the magnet in its casing. FIG. 4*c* is a sectional view of the housed magnet articulated, or engaged, with, and superior to an articulating surface 30, another conducting metal.

Figure 5:
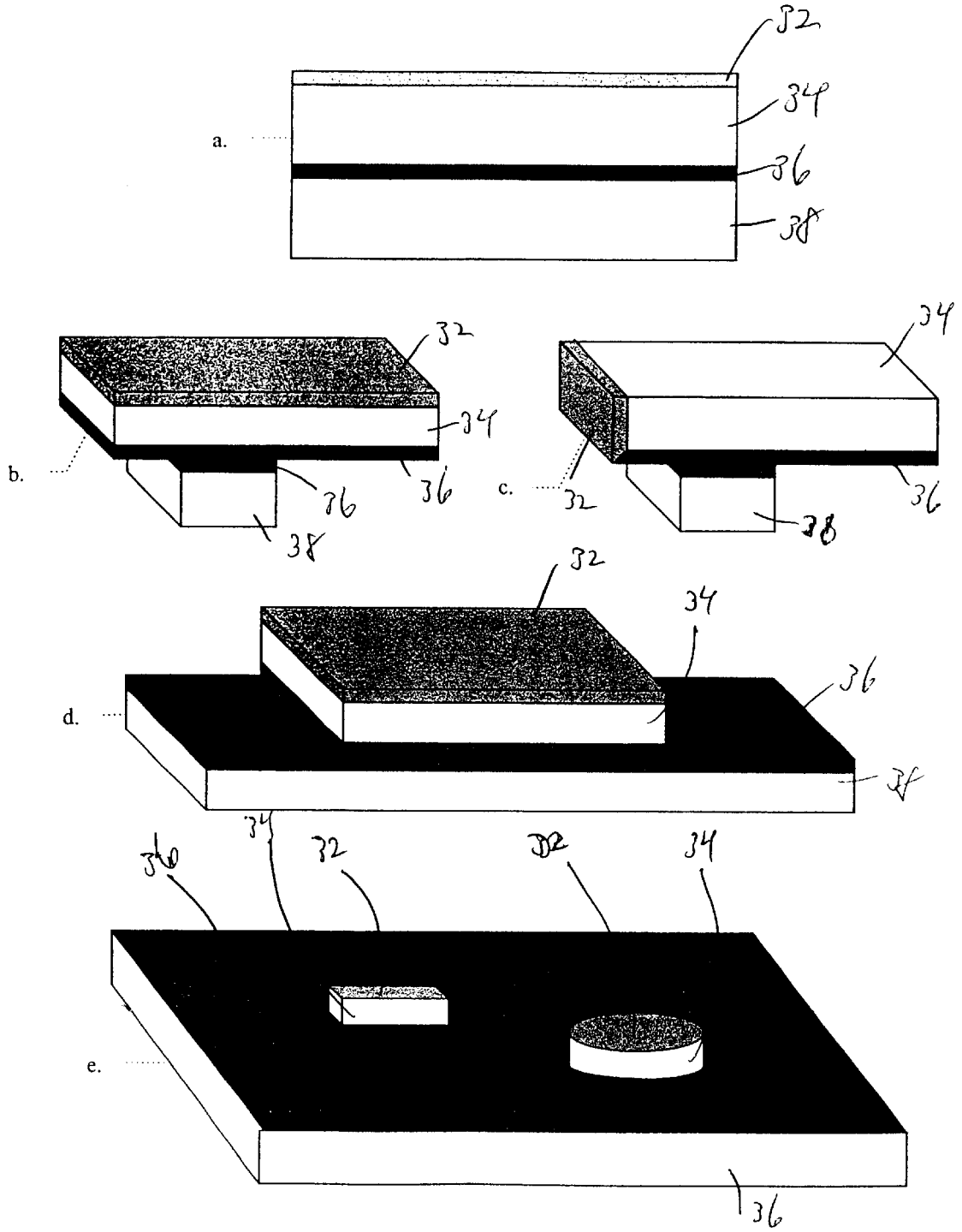
FIGS. 5*abcde* illustrates the concepts of proximal and distal interfaces, and proximal and distal segments of the preferred form of the device of the present invention.

FIG. 5*a* is a diagrammatic, sectional view of the invention. This diagram illustrates four portions of the invention schematically, the proximal interface 32, the proximal segment 34, the distal interface 36, and the distal segment 38, from the top portion to the bottom. FIGS. 5*bcde* each are variations of FIG. 5*a* in perspective, diagrammatic views. FIGS. 5*b* and 5*c* illustrate the distal segment relatively smaller than the proximal segment, while engaged at the distal interface. FIGS. 5*b* and 5*c* differ with regard to the placement of the proximal segment, which conceptually may be any portion of the proximal segment other than that portion desired for use as the distal interface. FIG. 5*d* illustrates a relatively larger distal segment engaging with a proximal segment at the distal interface. FIG. 5*e* shows the distal segment to be much larger than the proximal segment, as with a surface.

Figure 6:
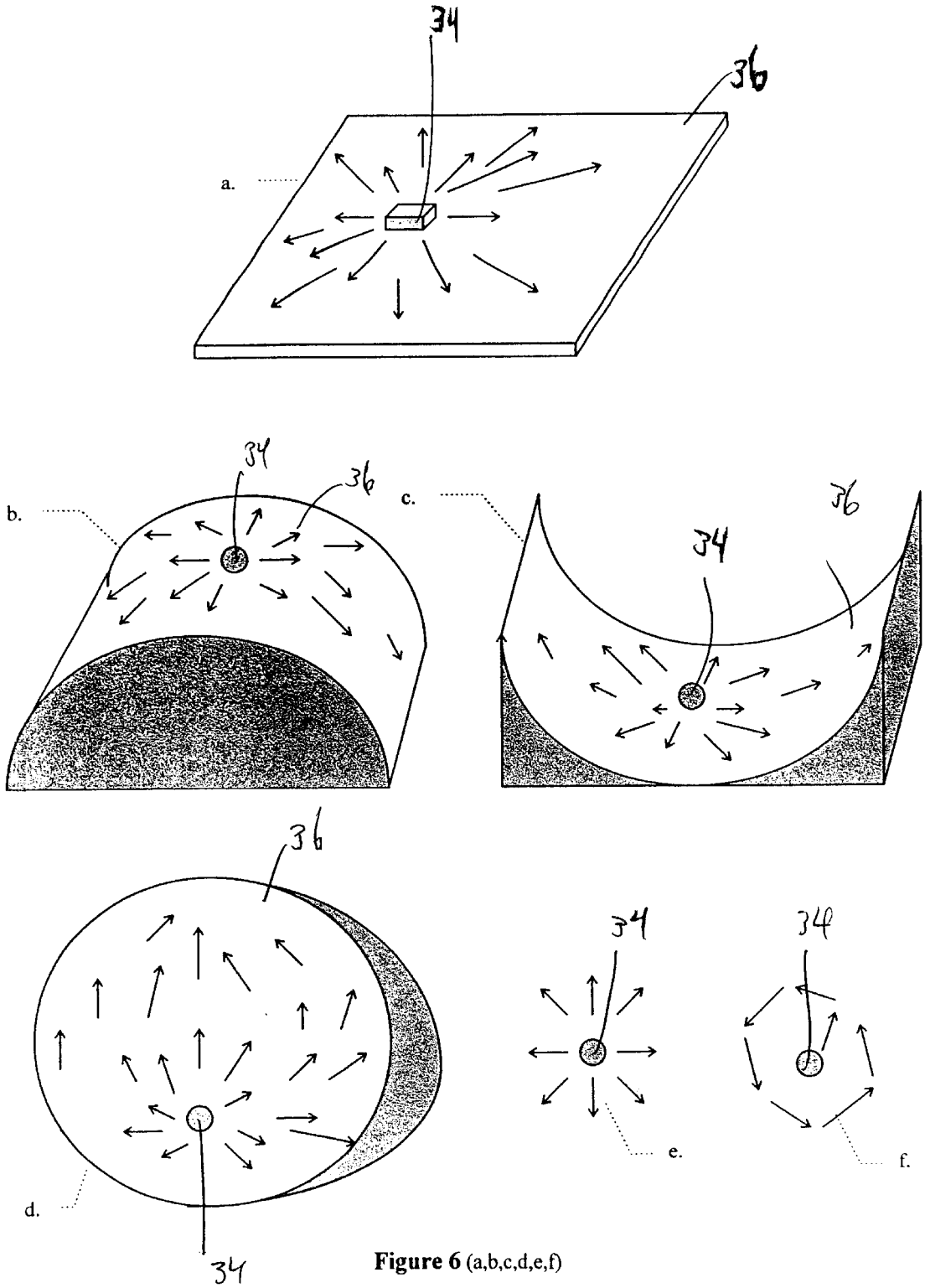
FIGS. 6*abcdef* primarily illustrates variations in distal segment configurations, in regard to surfaces, as well as variations of motion patterns of the proximal segment when engaged at the distal interface.

FIG. 6*a* is a diagramatic, perspective view of a surface 36 like the distal segment shown in FIG. 5*e*. FIGS. 6*bcd* each illustrate curved variations of the flat surface in diagrammatic, perspective views. FIGS. 6*b* and 6*c* illustrate convex and concave distal segments respectively, while FIG. 6*d* illustrates a proximal segment engaged on the concave aspect of a hemispheric-shaped distal segment. FIGS. 6*e* and 6*f* illustrate the potential of the proximal segment to move in any direction perpendicular to the surface of the distal segment, as also shown in FIGS. 6*abcd*. FIG. 6*e* emphasizes that at any point on the surface of the distal segment, motion of the proximal segment is possible in any direction. FIG. 6*f* emphasizes that movements applied to the proximal segment over time may combine to conform with any pattern along the topological surface, such as the crude circle shown.

Figure 7:
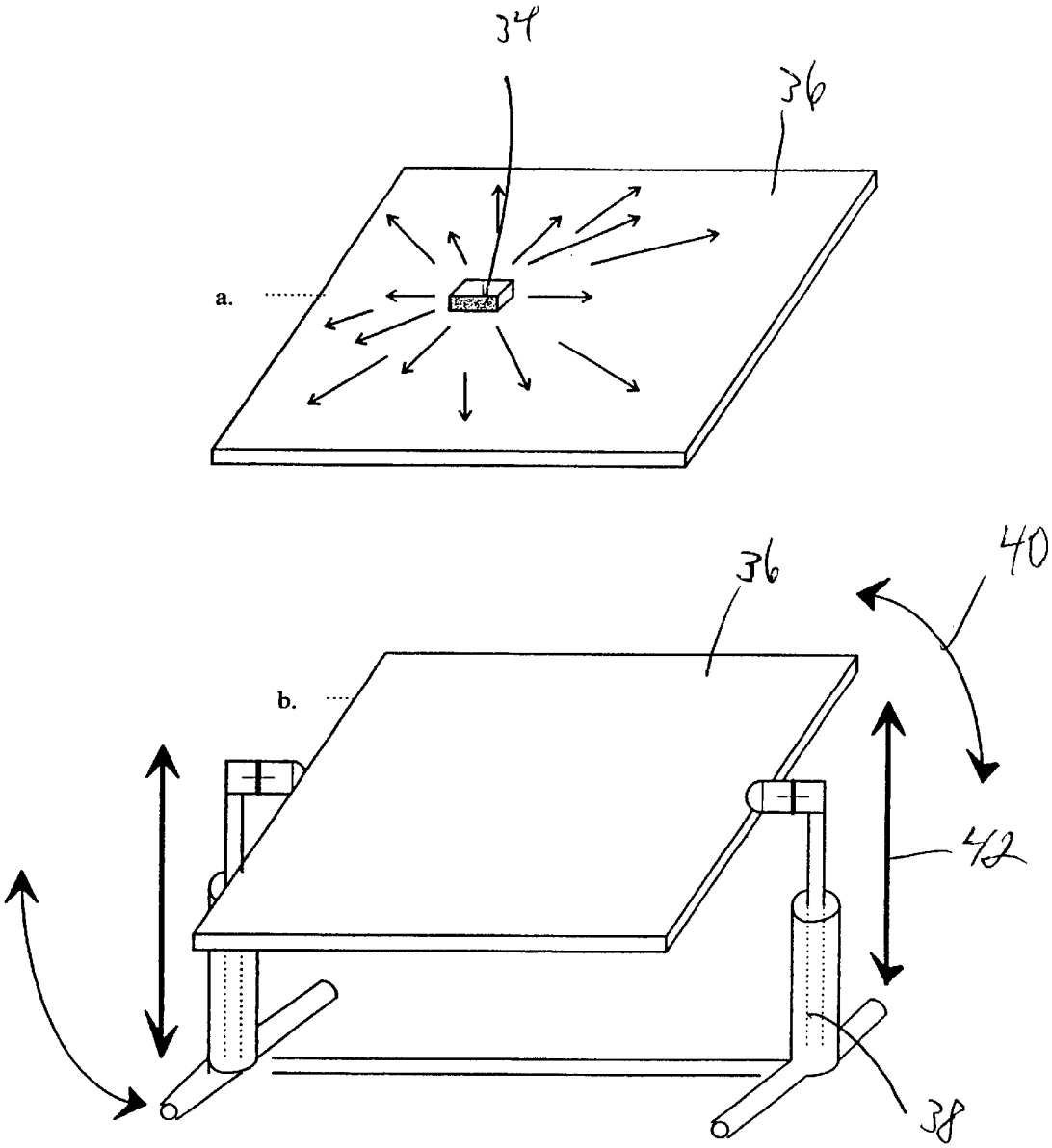
FIGS. 7*ab* is a diagrammatic, perspective view of FIG. 6*a* and an example of means to lend motion to the distal segment interface.

FIG. 7*a* is similar to FIG. 6*a*. FIG. 7*b* illustrates a distal segment which incorporates the distal interface 36 of FIG. 7*a*, while also incorporating a means 38 to provide rotation 40 of the interface about a horizontal axis and translation 42 of the interface in the vertical plane.

Figure 8:
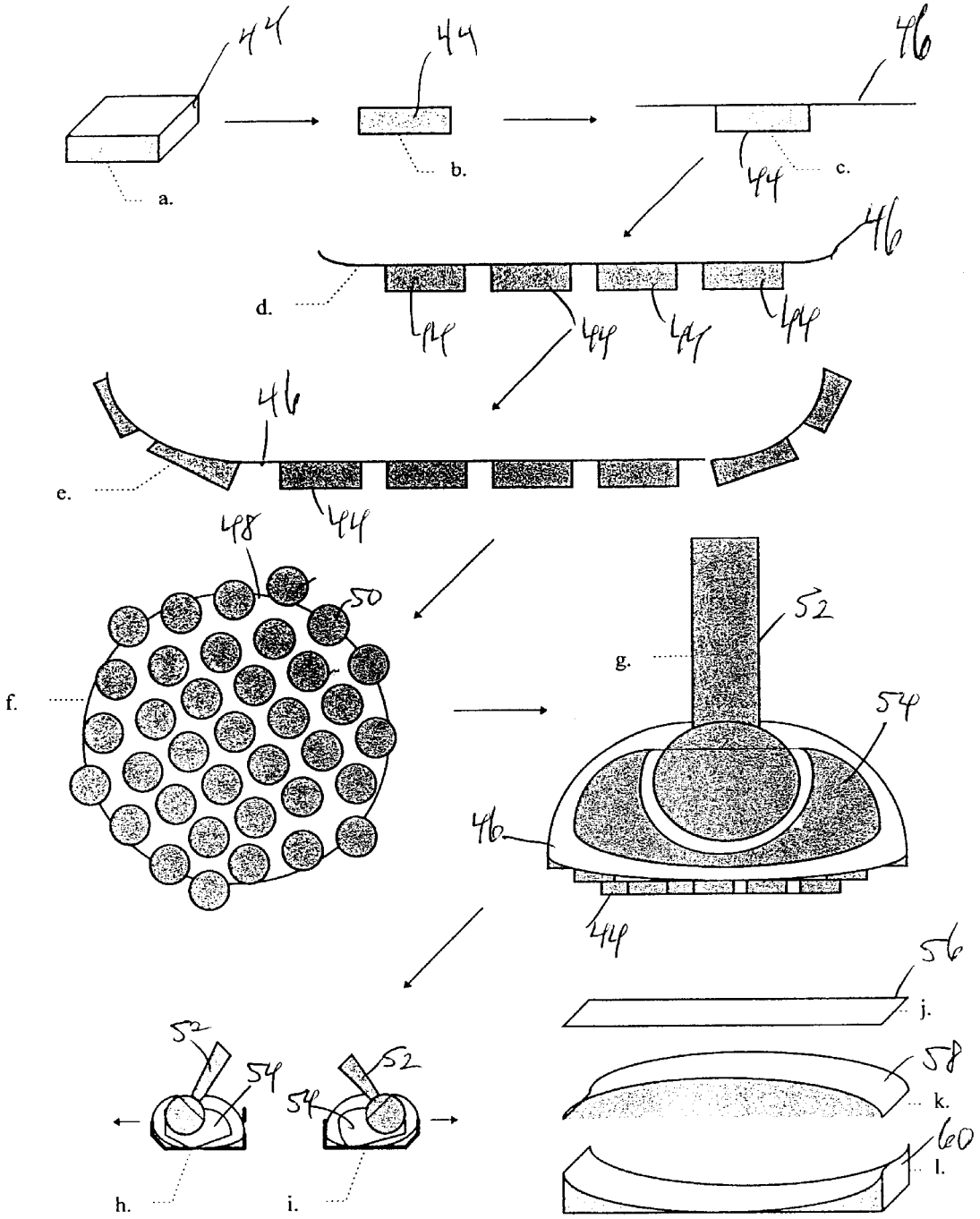
FIGS. 8*abcdefghijkl* illustrates a ramification of the use of magnetic force by coupling multiple magnets in series (or in parallel—not shown) attached by means of a maliable, pliable, or otherwise deformable material, affixed ultimately to a rigid or semirigid member.

FIGS. 8*a*, 8*b*, and 8*c* illustrate first a perspective view of a magnet 44, then shown in section, finally shown affixed to the deformable material 46. FIGS. 8*d* and 8*e* illustrate section views of additional magnets affixed to the material, even, as shown in 8*e*, on portions out of the primary plane of the other magnets. FIG. 8*f* is a bottom view of such a deformable material 48 with multiple magnets 50 affixed to it. FIG. 8*g* illustrates a proximal segment 52 embodying the multiple, affixed magnets of FIG. 8*f* at the distal interface 54. FIG. 8*g* illustrates other possible components of such a proximal segment as well including a rigid dowel affixed to a ball member, to which the deformable material is also affixed. Force is variably transmitted, however, as a bladder exists between the ball member and the distal interface, further allowing for variations in irregular architectures of distal segment interfaces or articular mismatch, and smoothing the transmitted forces in both directions. FIGS. 8*h* and 8*i* illustrate the proximal segment of FIG. 8*g* moving horizontally on a flat surface in the directions shown. Note the adaptability of the bladder and the deformable material to which the magnets are affixed. FIGS. 8*jkl* emphasize that this form of proximal segment is capable of adapting to many surfaces, including but not restricted to flat 56, convex 58, and concave 60 surfaces respectively shown.

FIGS. 9*a* and 9*b* illustrate the same component 62 in different perspective views. FIG. 9*c* is a section view of the same component shown in FIGS. 9*a* and 9*b*. While illustrated here diagrammatically in FIGS. 9*abc* as two longitudinal members 64 and 66 articulating transversely about a central cylindrical member, means for providing axial rotation 68 are numerous and not limited to what is shown. FIG. 9*d* illustrates a means of providing circumduction. This motion is accomplished with a universal joint, an elastic member displaced at one end, or a ball and socket 70 approach, as shown. Motion is possible in any direction from the neutral position, and in any pattern at a radius along the spherical topological surface of the ball, within the available range of the articulation. FIG. 9*e* primarily emphasizes one of several means to provide translation, shown here in the vertical plane 72. While not every means to provide circumduction and translation also provide for rotation, those illustrated in FIGS. 9*d* and 9*e* do.

Figure 9:
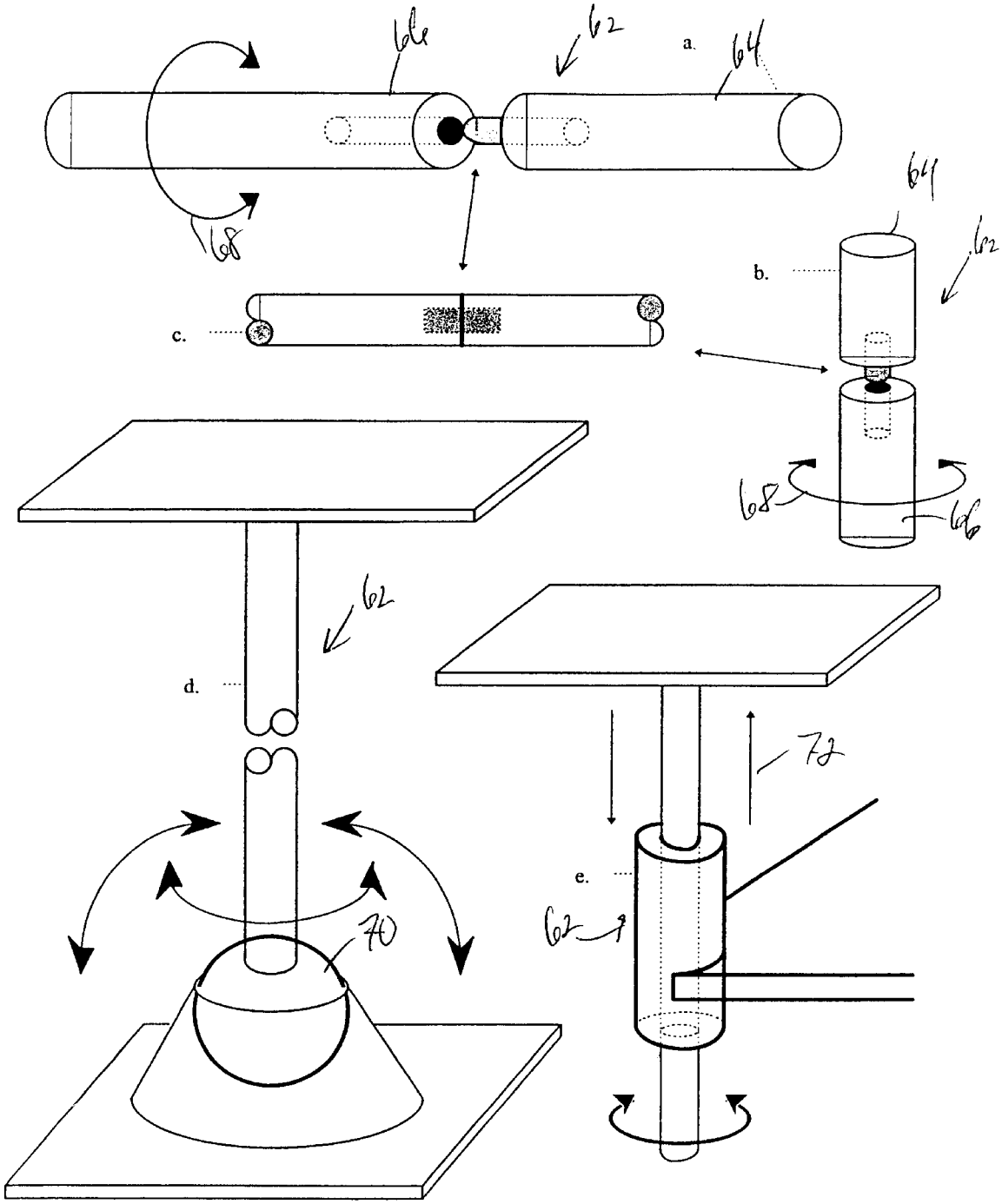
FIGS. 9*abcde* illustrate means of providing displacement of components within either the proximal or distal segments, in order to optimize the stabilization or mobilization properties of the proximal or distal interfaces.
Figure 10:
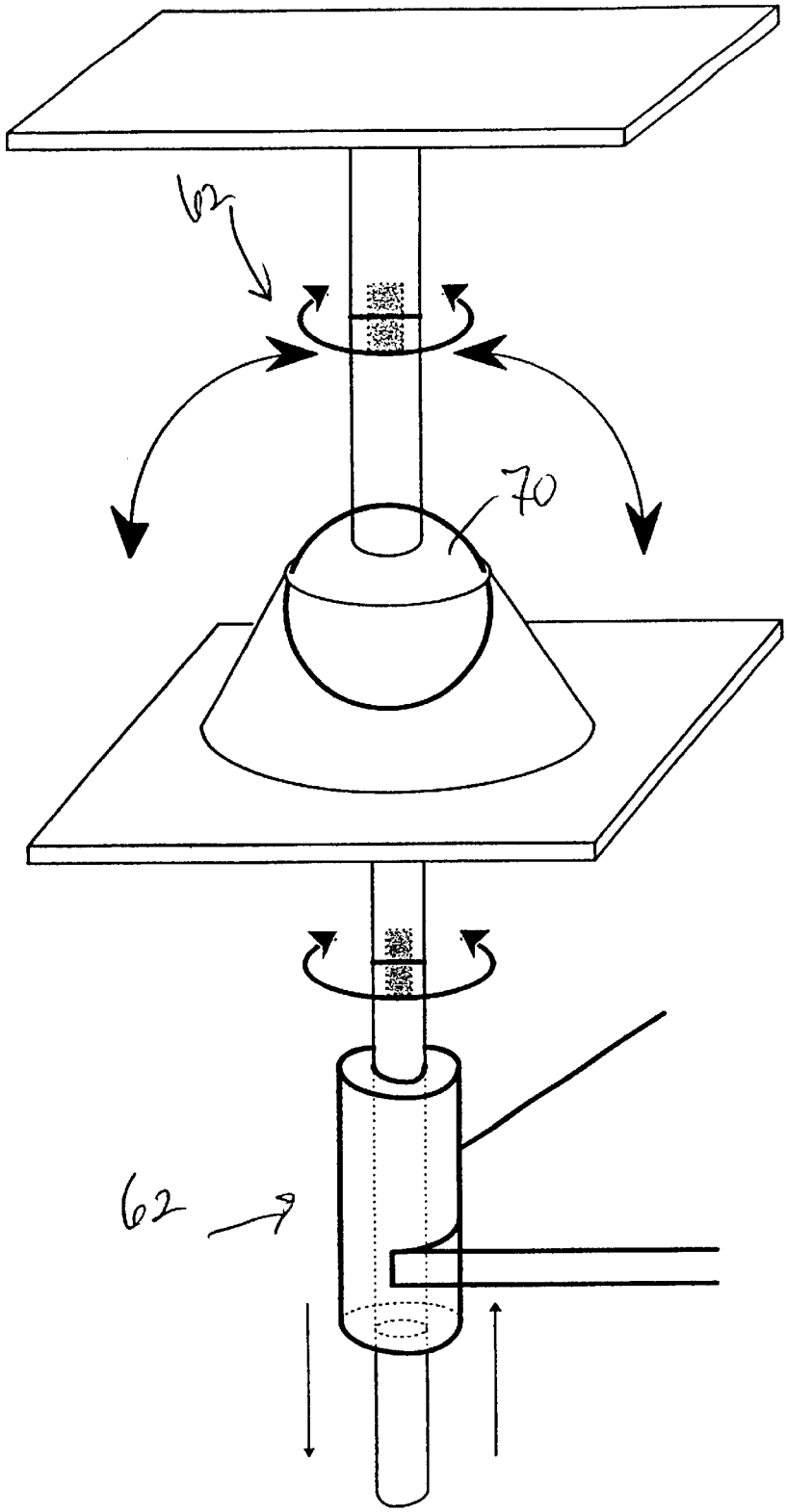
FIG. 10 is a perspective view of the components illustrated in FIG. 9 combined to provide motion in circumduction, axial rotation, and translation.

FIG. 10 is a perspective view of the components 62 illustrated in FIG. 9 combined to provide motion in circumduction, axial rotation, and translation. FIG. 10 may be considered one possible distal segment with the top surface used as the distal interface. The redundancy of available axial rotation serves to neutralize opposing angular moments encountered within the components when engaged with a moving proximal segment. The distal interface can deviate in any direction, along a radius from the ball member 70 which is free to move in the vertical plane.

Figure 11:
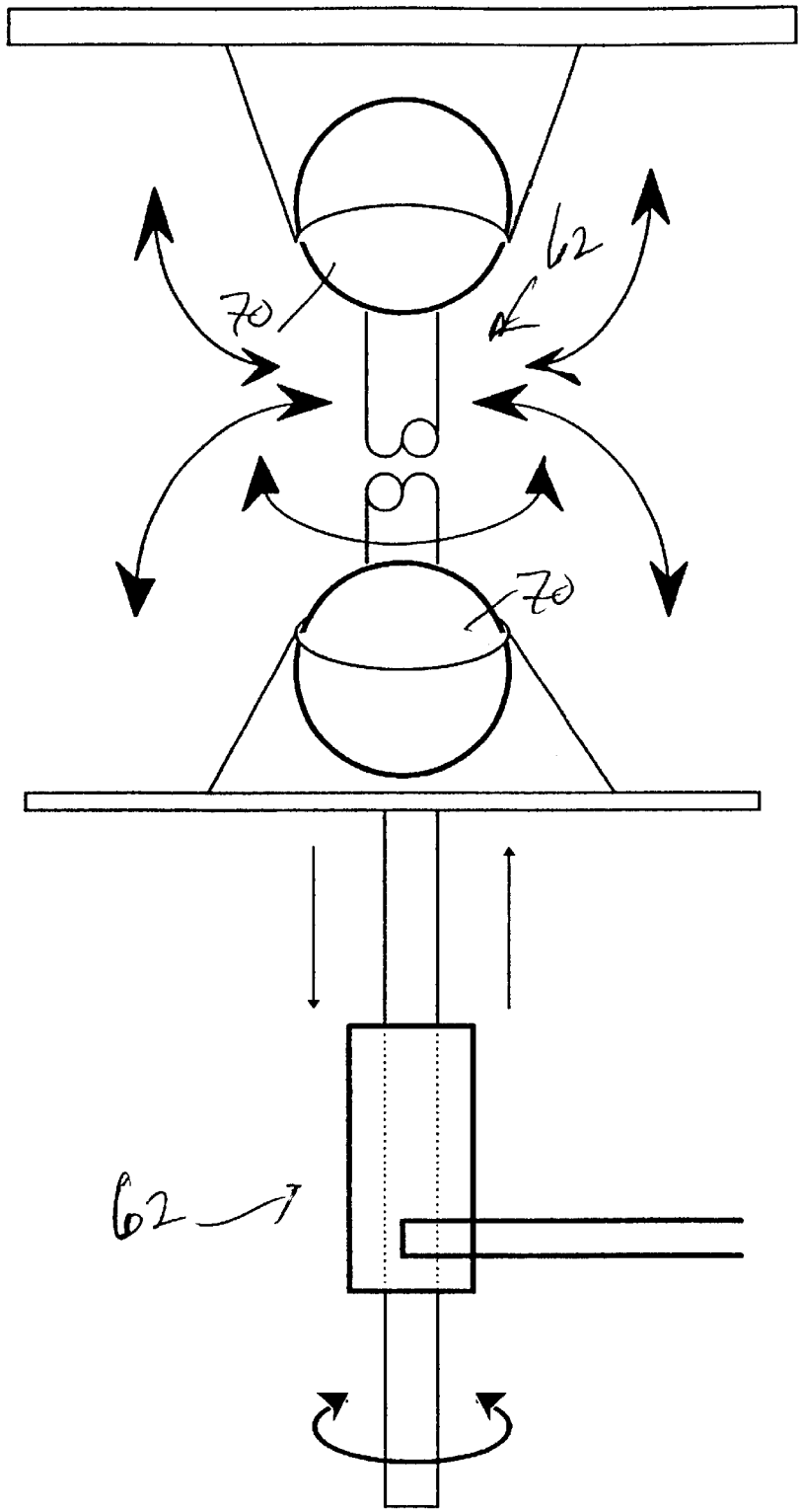
FIG. 11 is a perspective view of FIG. 10, omitting the means of axial rotation illustrated in FIGS. 9*abc* (for the purposes of clarity only) while introducing another means for circumduction, as shown. This distal segment now has the capability of reversing the circumduction moment, out of the original verical axis, in addition to the motions mentioned for FIG. 10.

FIG. 11 is a perspective view of FIG. 10, omitting the means of axial rotation illustrated in FIGS. 9*abc* (for the purposes of clarity only) while introducing another means for circumduction, as shown. This distal segment now has the capability of reversing the circumduction moment, out of the original verical axis, in addition to the motions mentioned for FIG. 10.

Figure 12:
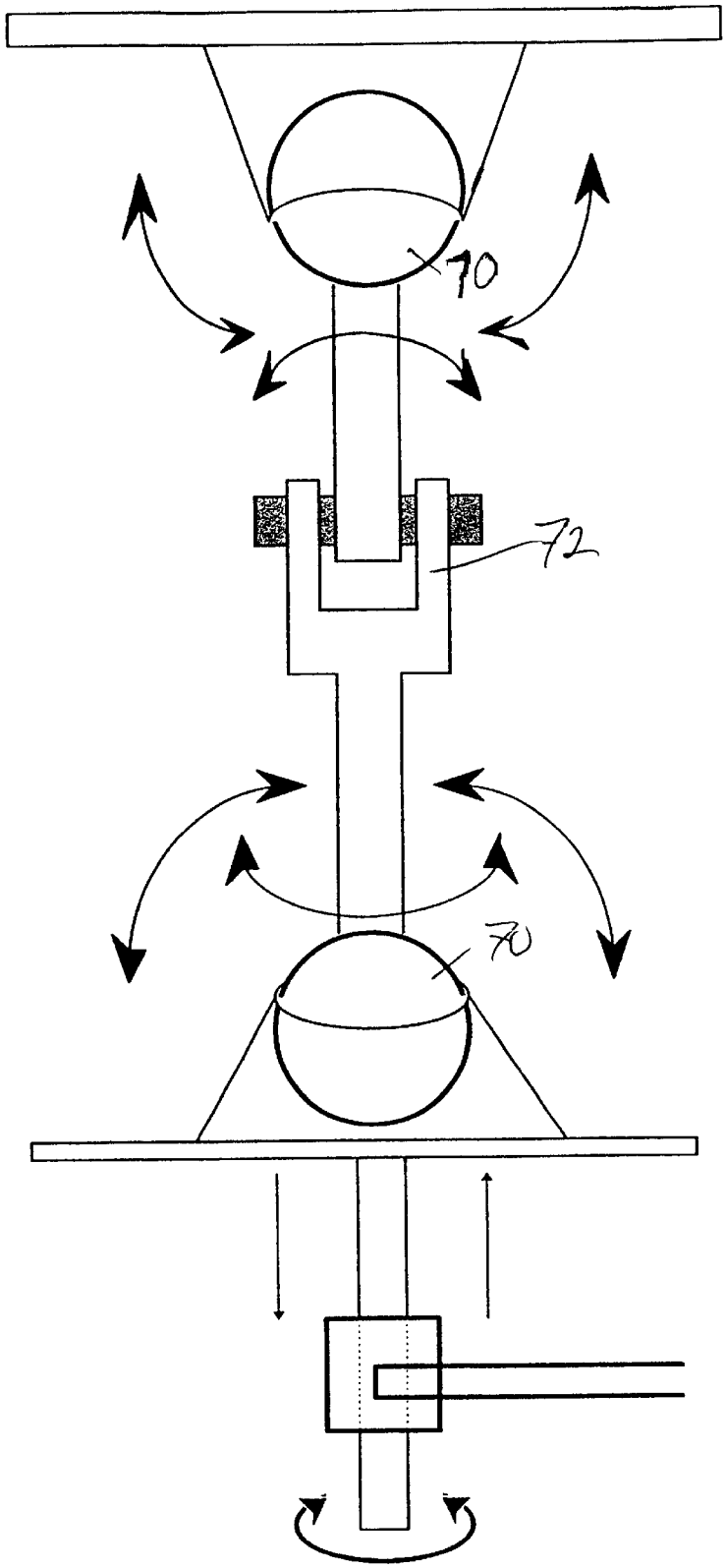
FIG. 12 is a perspective view of FIG. 11 with an additional hinge component between the two means of providing circumduction. This distal segment is afforded the ability to position the distal interface freely in space, as long as the translational component is as long or longer than the longest segment from hinge to ball.

FIG. 12 is a perspective view of FIG. 11 with an additional hinge component 72 between the two means of providing circumduction. This distal segment is afforded the ability to position the distal interface freely in space, as long as the translational component is as long or longer than the longest segment from hinge to ball.

Figure 13:
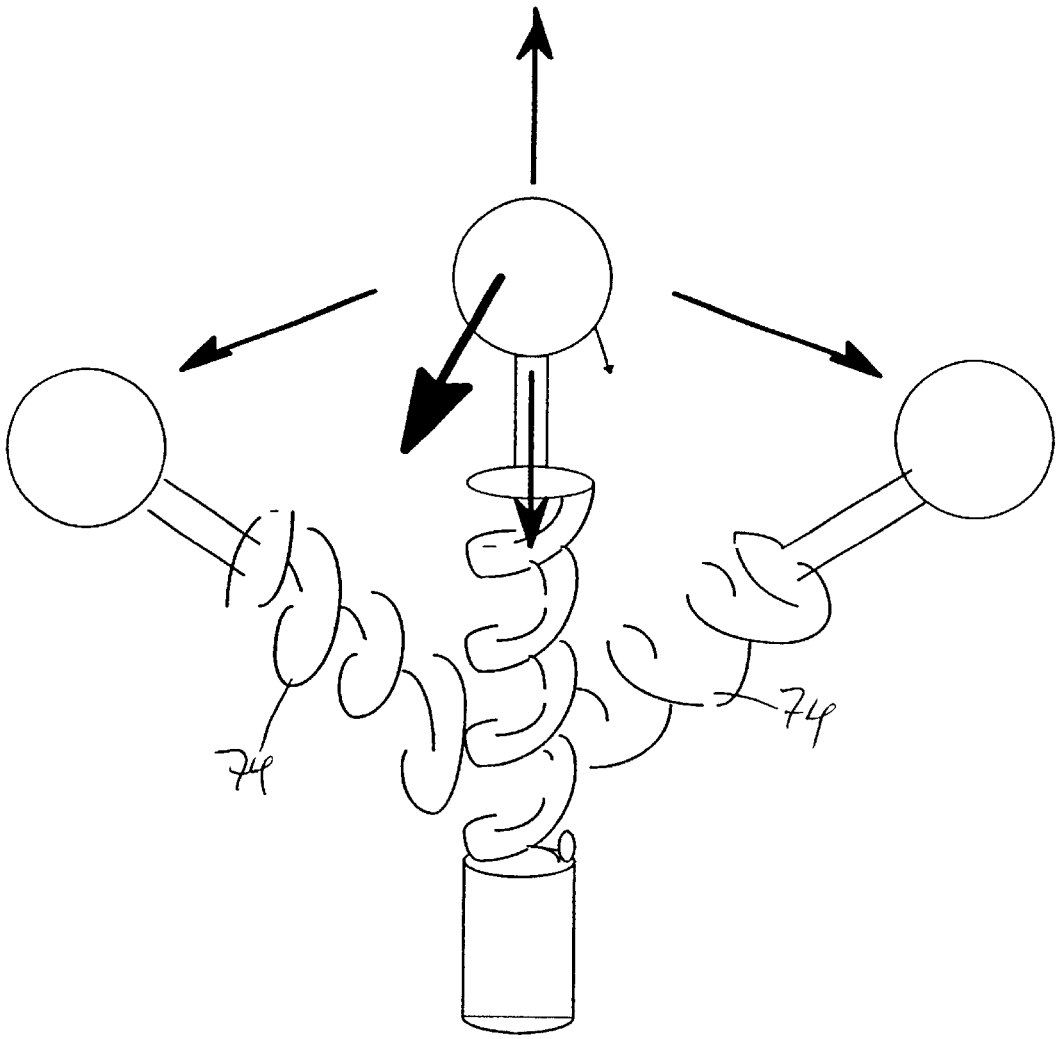
FIG. 13 is a schematic perspective representation of an elastic member capable of providing a combination of circumduction and longitudinal translation, as alluded to when discussing FIG. 9*d*. Illustrated here as a spring, this elastic member has the capability to shorten and elongate, while at the same time the free end may be allowed to move in any direction relative to the neutral position.

FIG. 13 is a schematic perspective representation of an elastic member 74 capable of providing a combination of circumduction and longitudinal translation, as alluded to when discussing FIG. 9*d*. Illustrated here as a spring, this elastic member has the capability to shorten and elongate, while at the same time the free end may be allowed to move in any direction relative to the neutral position.

Figure 14:
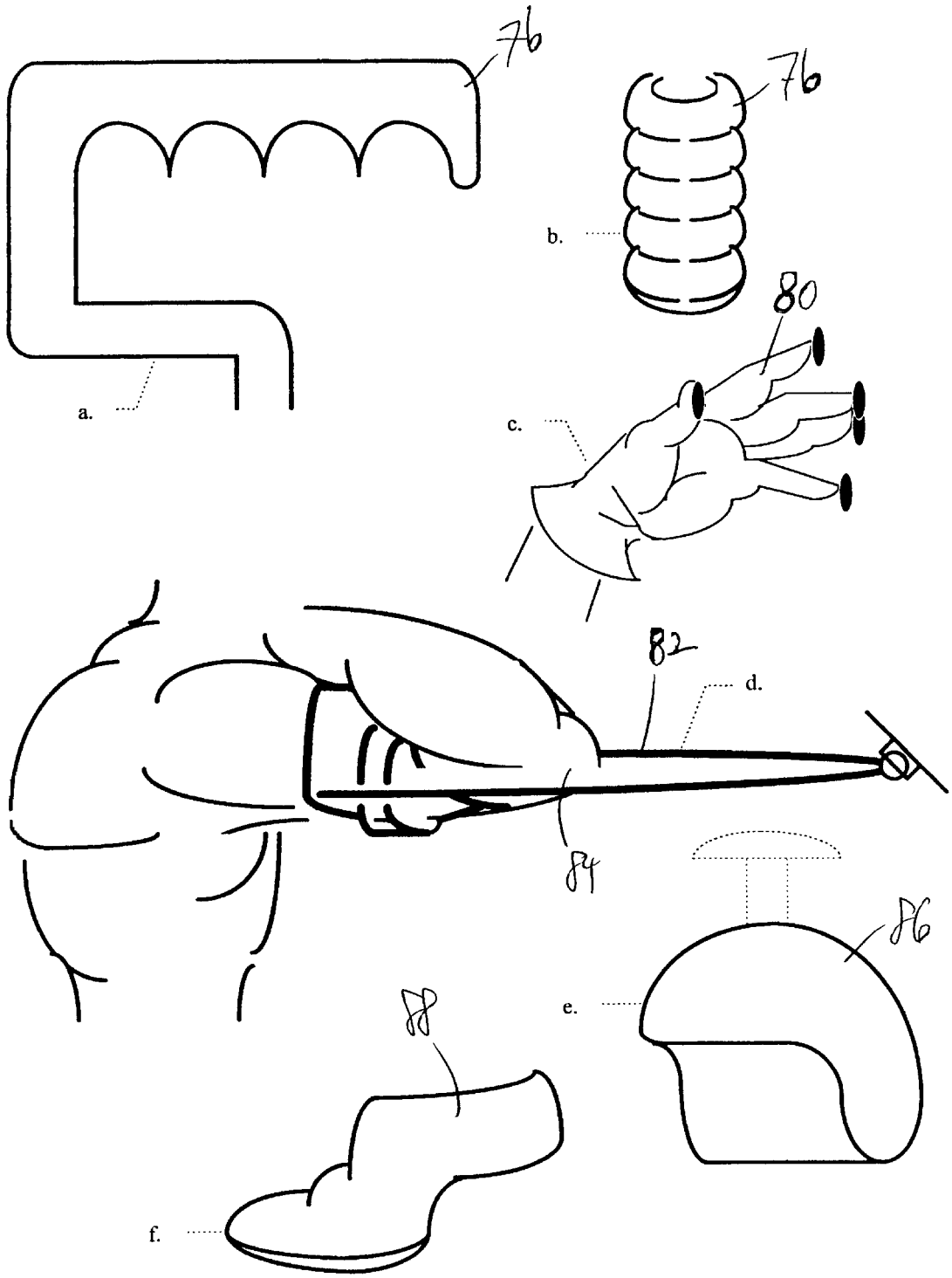
FIGS. 14*abcdef* illustrates only a few of the types of proximal interfaces which may be utilized by the proximal segment to transmit physical force between the person and the distal segment.

FIGS. 14*abc* illustrate some ways the proximal interface may conform to use by the hand such as handles 76 and 78 as well as a glove 80. FIG. 14*d* illustrates upper arm stabilization by means of a strap 82 such that motion of the proximal segment reflects that of the elbow 84. FIGS. 14*e* and 14*f* illustrate fixing the head and foot using a helmet 86 and shoe 88 respectively to transmit forces to the proximal segment from either the neck or ankle movers. Any external portion of the body which moves conceptually may be fixed in such a way as to form a proximal interface.

Figure 15:
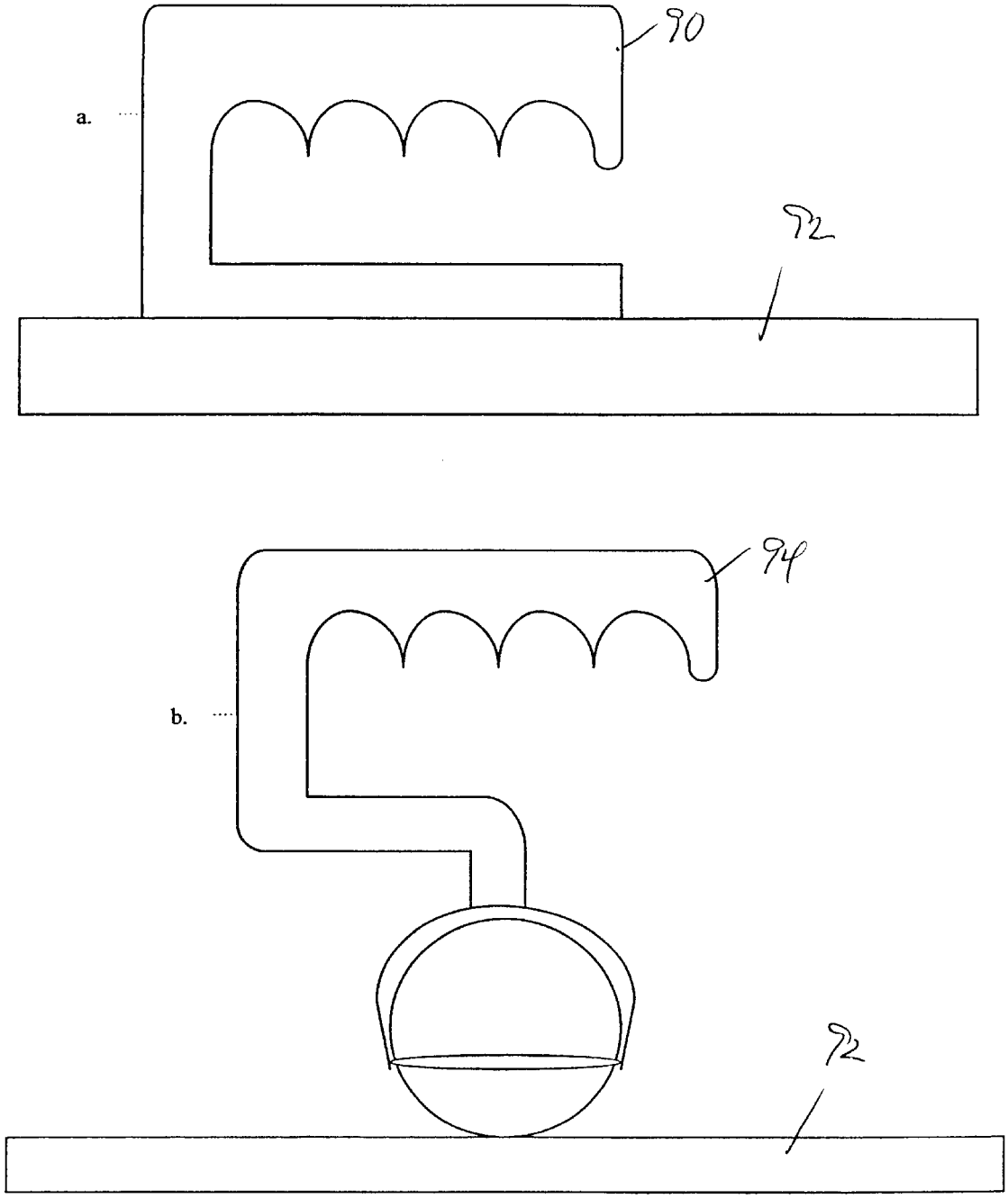
FIGS. 15*ab* is a sectional view of proximal interfaces as they may relate to proximal segments, distal interfaces, and distal segments.

FIG. 15*a* illustrates a proximal segment in the form of a handle 90 interfacing with a distal segment 92 at the distal interface. This view illustrates how the proximal segment may be formed in such a way that it interfaces with both the person and the distal segment without requiring additional parts. FIG. 15*b* illustrates a modified proximal segment 94 from FIG. 15*a*, in that while the proximal interface is the same, the distal interface is changed to one providing circumduction instead of lateral translation.

Figure 16:
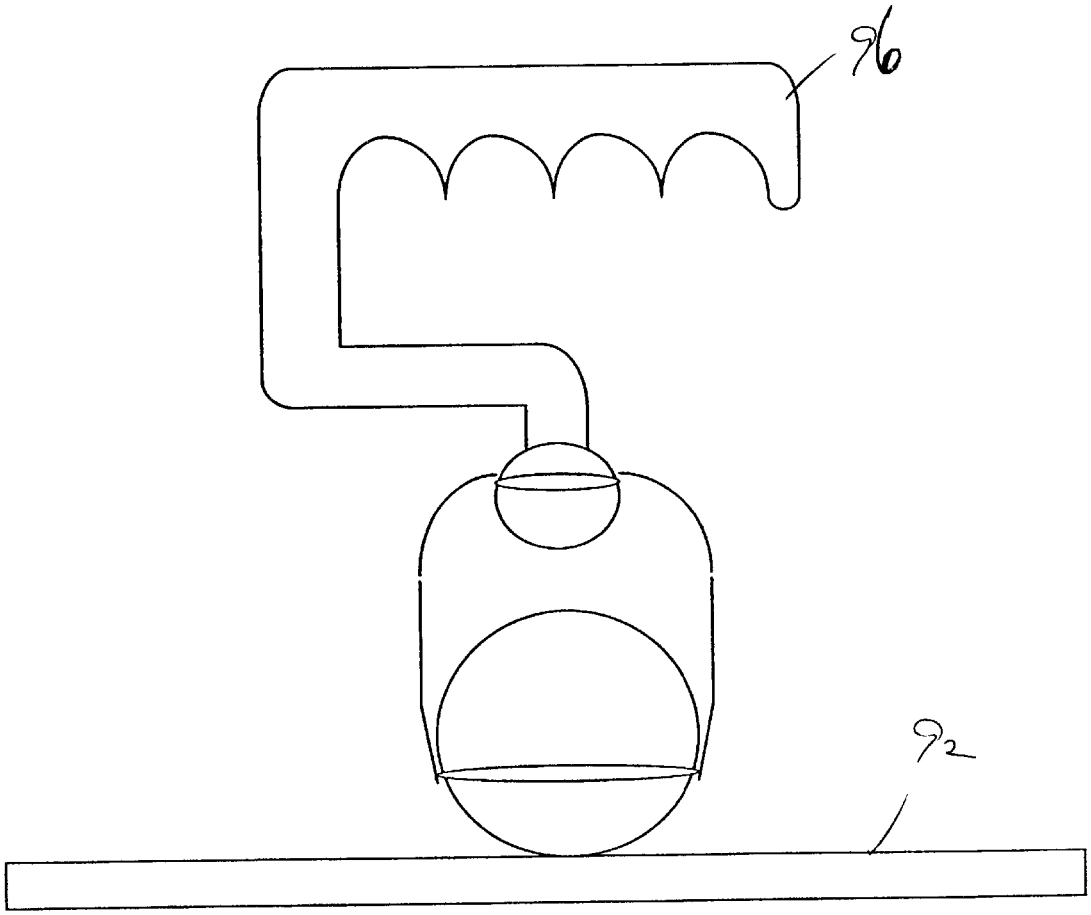
FIG. 16 is a sectional view of FIG. 15*b* with an additional means of circumduction for the proximal segment. The redundancy of circumduction allows opposing circumduction moments to neutralize when the proximal segment is in motion, affording greater ease of use and comfort to the user.

FIG. 16 is a sectional view of FIG. 15*b* with an additional means of circumduction for the proximal segment 96. The redundancy of circumduction allows opposing circumduction moments to neutralize when the proximal segment is in motion, affording greater ease of use and comfort to the user.

Figure 17:
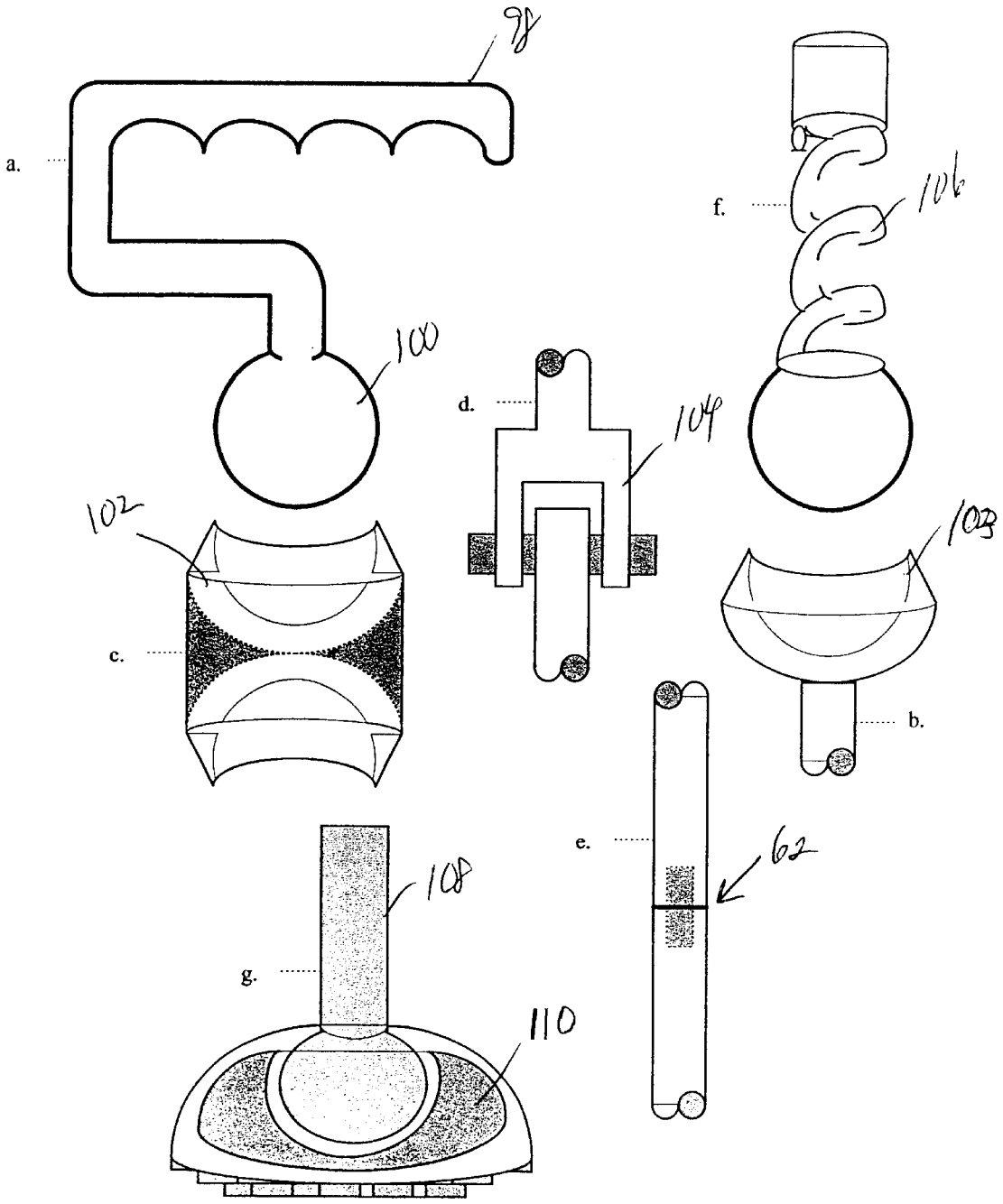
FIGS. 17*abcdefg* illustrates sectional views of some of the components which may be utilized in the construction of proximal and distal segments.

FIG. 17*a* is shown as a handle 98 connected to a ball member 100, and is meant to illustrate the typical proximal interface. FIGS. 17*b* and 17*c* illustrate the socket member 102 of the ball and socket articulation, the latter of the two with two rather than one female parts 103. FIGS. 17*d*, 17*e*, and 17*f* respectively depict the typical means of providing angular displacement (hinge 104), axial rotation, and an alternate means of circumduction plus longitudinal translation (free-end spring 106). FIG. 17*g* illustrates a proximal segment which behaves similarly to the component in FIG. 17*f*, in that the way the rigid member 108 is affixed to the deformable material, coupled with the action of the bladder 110, enabling loose circumduction and translation out of a fixed axis. A means to axially rotate this proximal segment is needed given the relationship of the ball member on the bladder.

Figure 18:
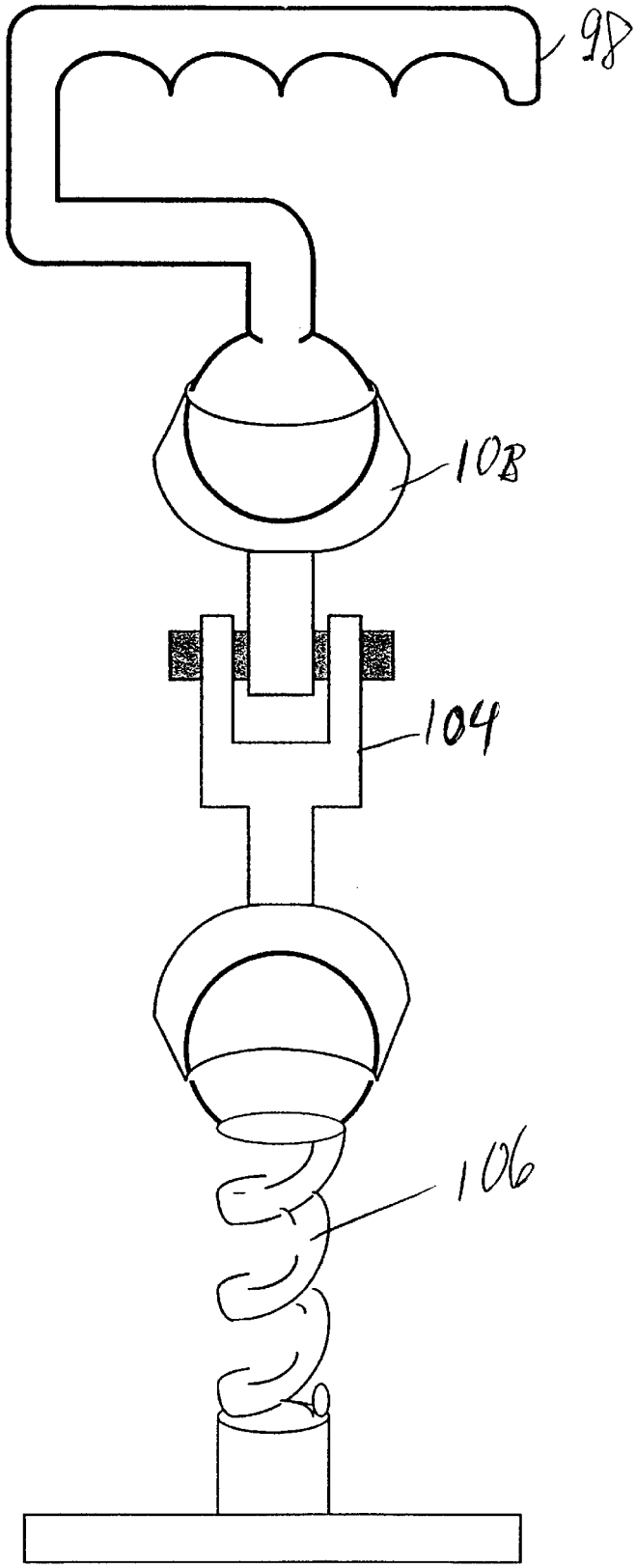
FIG. 18 is a sectional view of some of the components illustrated in FIG. 17 combined to provide motion in circumduction, axial rotation, and angular displacement.

FIG. 18 may be considered one possible proximal segment with the handle serving as the proximal interface and the bottom surface used as the distal interface. The redundancy of circumduction and axial rotation serves to neutralize opposing angular and rotatory moments encountered within the components when engaged when the moving proximal segment is engaged with the distal segment. These components allow free positioning of the proximal interface in space relative to the contour of the distal segment.

Figure 19:
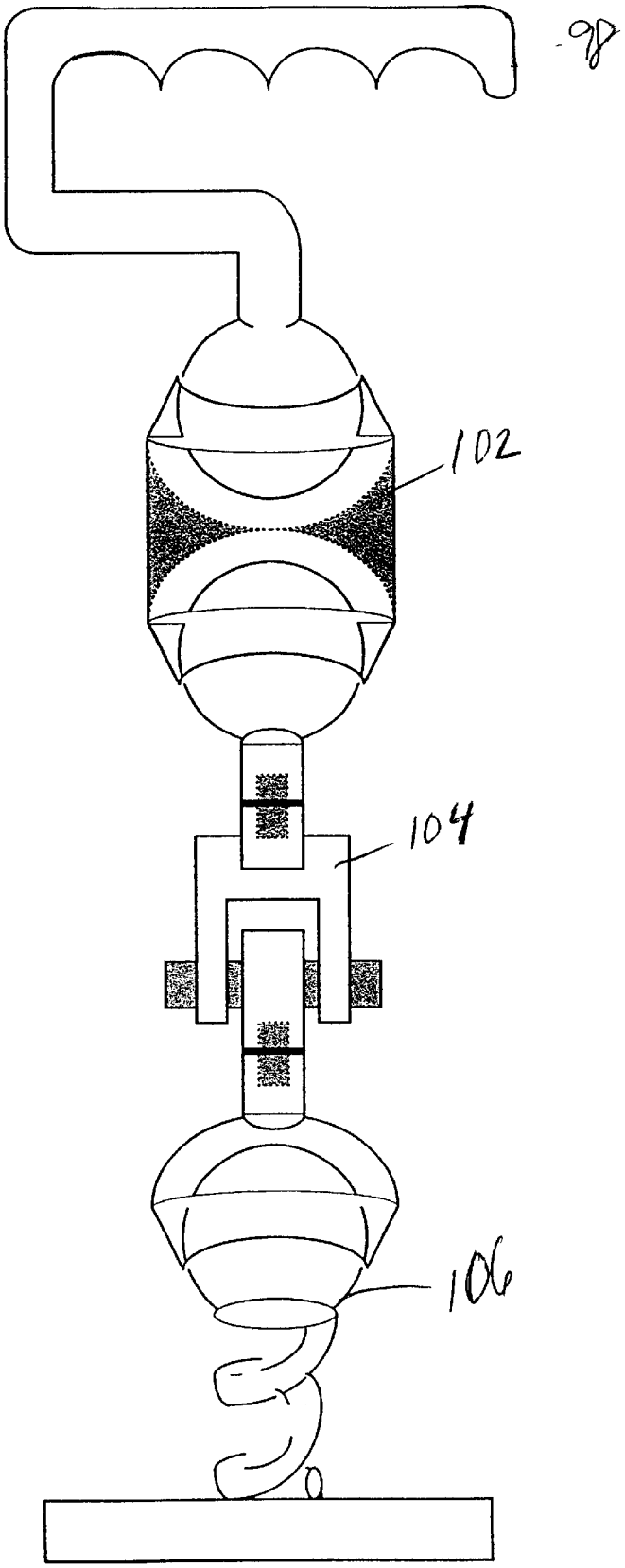
FIG. 19 is a sectional view of FIG. 18, with the addition of one means of reverse circumduction and two serially placed means of axial rotation.

The rotatory moments in FIG. 18 would tend to mount in the region of the hinge joint, but these are diminished by the added redundancy in FIG. 19, with freer motion in space being the result. This embodiment is representational of the human upper extremity and may be used as a proximal segment engaging at its base with the distal segment, or it may be fixed at its base with variable and forseeably programmable resistances distributed in real time amongst its assortment of contained articulations. Such a device would serve to assist and resist postures and motions related to human movements in free space. While this embodiment enables the method of assisting and resisting postures and motions related to upper extremity motion well, different combinations of joints contained within the proximal and distal segments will likely be optimal for providing articular assistance and resistance in free space to other joints in the body. These motions are foreseeable and the means manufacture and use devices for this purpose are now available. The present embodiment utilizes a combination of magnetic and elastic forces chiefly to accomplish this end. Electromagnetics will likely be applied to this end. Computers will likely generate programs to alter the strength of electromagnets selectively, both statically and dynamically in real time. effectors with generate power will likely be mounted on such devices, as muscles are mounted on bone and joint, for the purpose of better control of robotic motion in space. Motion sensors, motion amplifiers, accelerometers, dynamometers, electrogoniometers, and force plates will all find a purpose relative to motion control refinement of robotics and devices related to, and responsive to, human motion. Patients suffering from pain or seeking the means to stretch their limbs will be able to accomplish their goal initially with much reduced effects of gravity. Eventually, once electromagnetics, computer programming, motion sensors and effectors, robotics, and virtual systems are brought to bear on this method, devices such as these will be able to be used not just therapeutically, but diagnostically as well, as therapeutic patterns emerge. The physical unwinding patterns revealed will shed light on the winding process of adhesions and stiffness which accompany sprains, strains, post-inflammation fibrosis, and all injuries on a macro and micro scale. These patterns will be used to discern which activities of normal usage are advantageous or deleterious to physical well-being and contribute in no small part to our understanding of the physical effects of aging.

Figure 20:
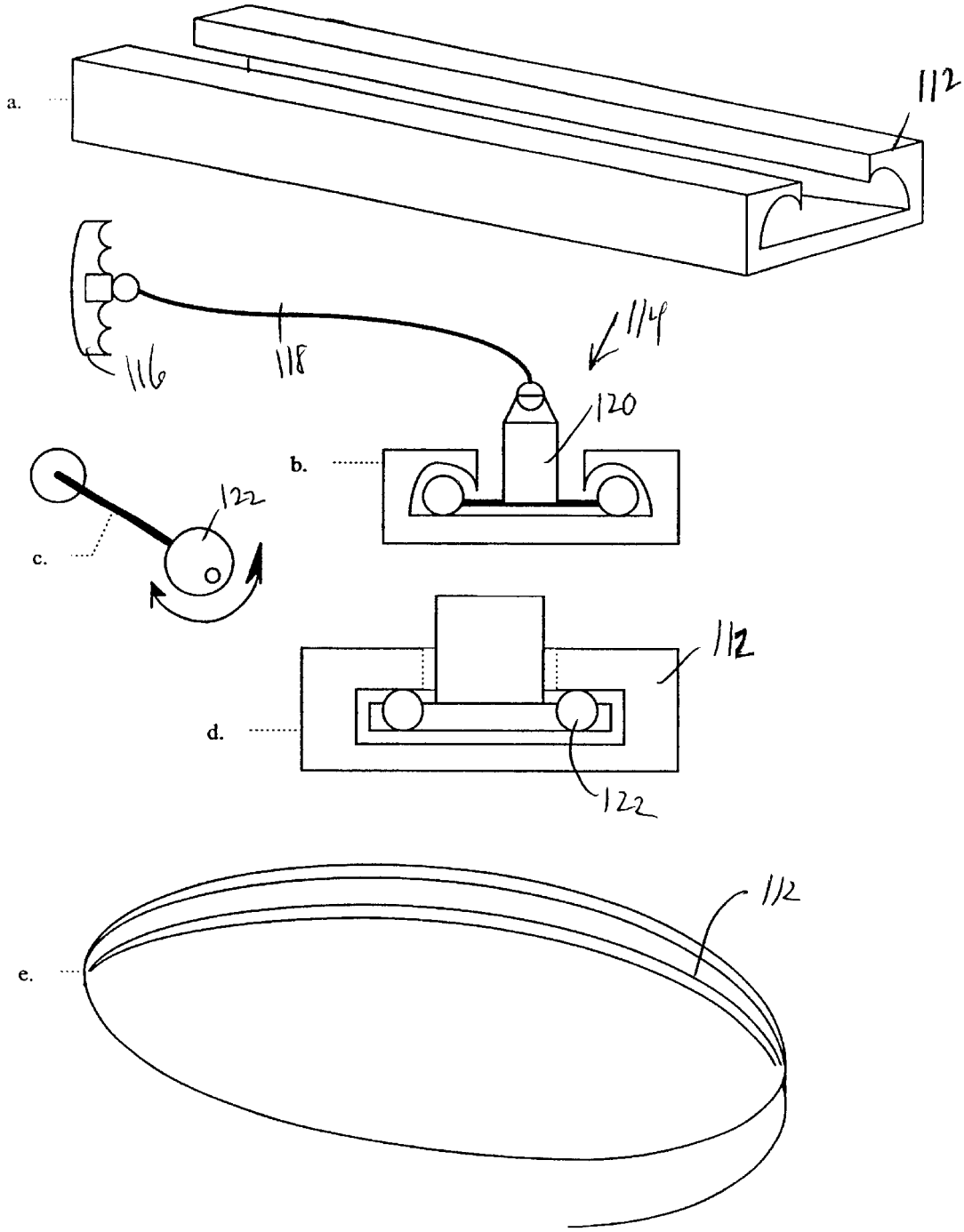
FIGS. 20*abcde* illustrates a ramification utilizing a track system.

FIG. 20*a* is a perspective view of a straight segment of track 112, which serves as the distal segment. FIG. 20*b* is a sectional view which illustrates the proximal segment 114 consisting of a handle 116, a string 118, rope, or semi-elastic means of providing longitudinal traction (or compression-not shown), with appropriately formed magnets or ballbearings 122 housed at the distal interface 120. FIG. 20*c* is an enlarged perspective view of an axle-type member meant to emphasize the rotatory nature of one possible embodiment. Bearings, wheels, magnets may articulate with a containing concave surface as in FIG. 20*b* or otherwise. An alternate form of articulation is shown in FIG. 20*d*. FIG. 20*e* is a schematic perspective view of a distal segment in the form of a circular track, peripheral or adjacent to the user. Appropriately shaped circular motions of the proximal interface would pull the proximal segment around the track. Similarly, alternating to and fro or back and forth motions of the proximal interface would pull the proximal segment to either side of a straight track, such as in FIG. 20*a*.

Conceivably, (any pattern and its opposite) may be modeled by a track system. A track system could easily make use of variable friction for resistances. Tracks may also be devised in such a way that the pattern may be adjusted, much like changing the rail of the train.

Figure 21:
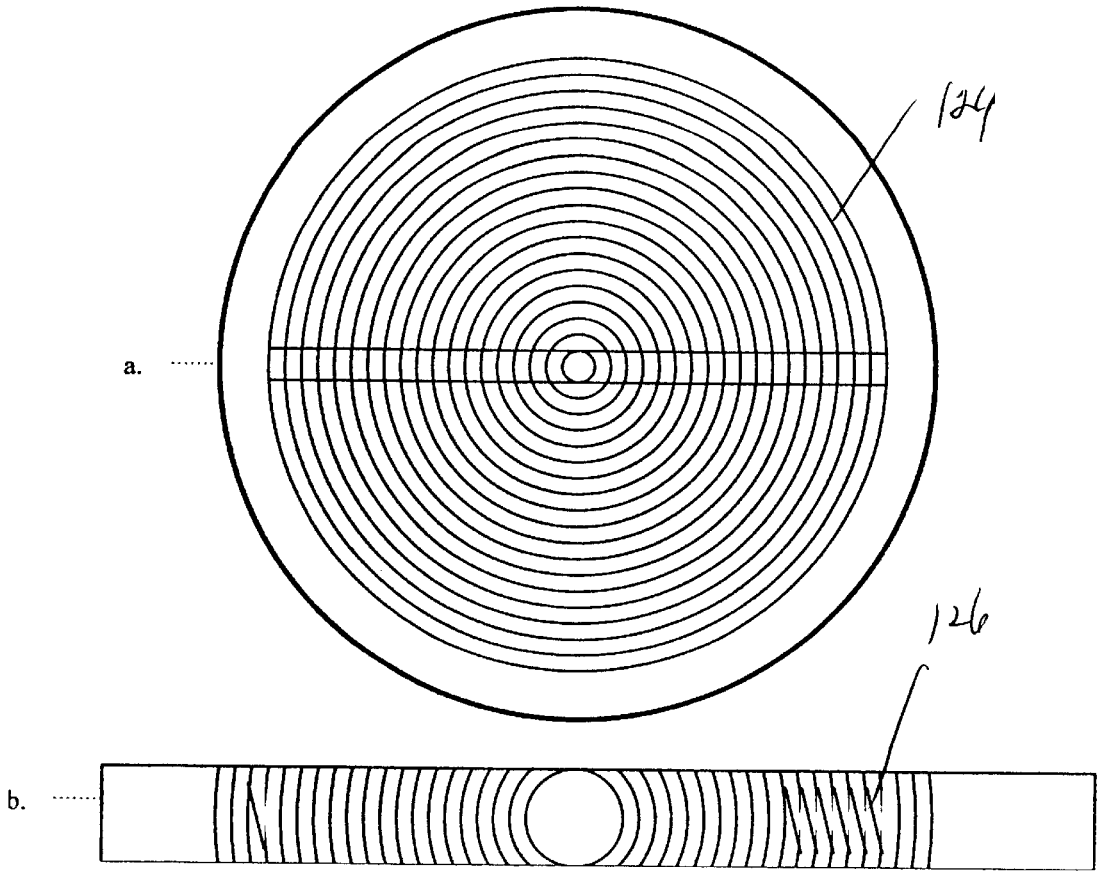
FIGS. 21*ab* is a front view of a track system which is capable of adjusting its path available for motion.

FIG. 21*a* is a system of circular tracks 124 which serves as a distal segment for a proximal segment such as the one illustrated in FIG. 20*b*. The horizontal bars are for illustration only, as they serve to demarcate the borders of a section of FIG. 21*a* which is enlarged and modified in FIG. 21*b*. FIG. 21*b* illustrates that for each radius of curvature on this track there is a portion 126 which adjusts either centripetally or centrifugally to allow passage of the proximal segment to the neighboring circular track when open. In this way, proximal interface motions could be made to vary in predicable ways utilizing a track system. Significantly, the distal segments housing such tracks could be formed in various shapes and contours, and could contain joints affording various degrees of freedom in space to the track itself.

Figure 22:
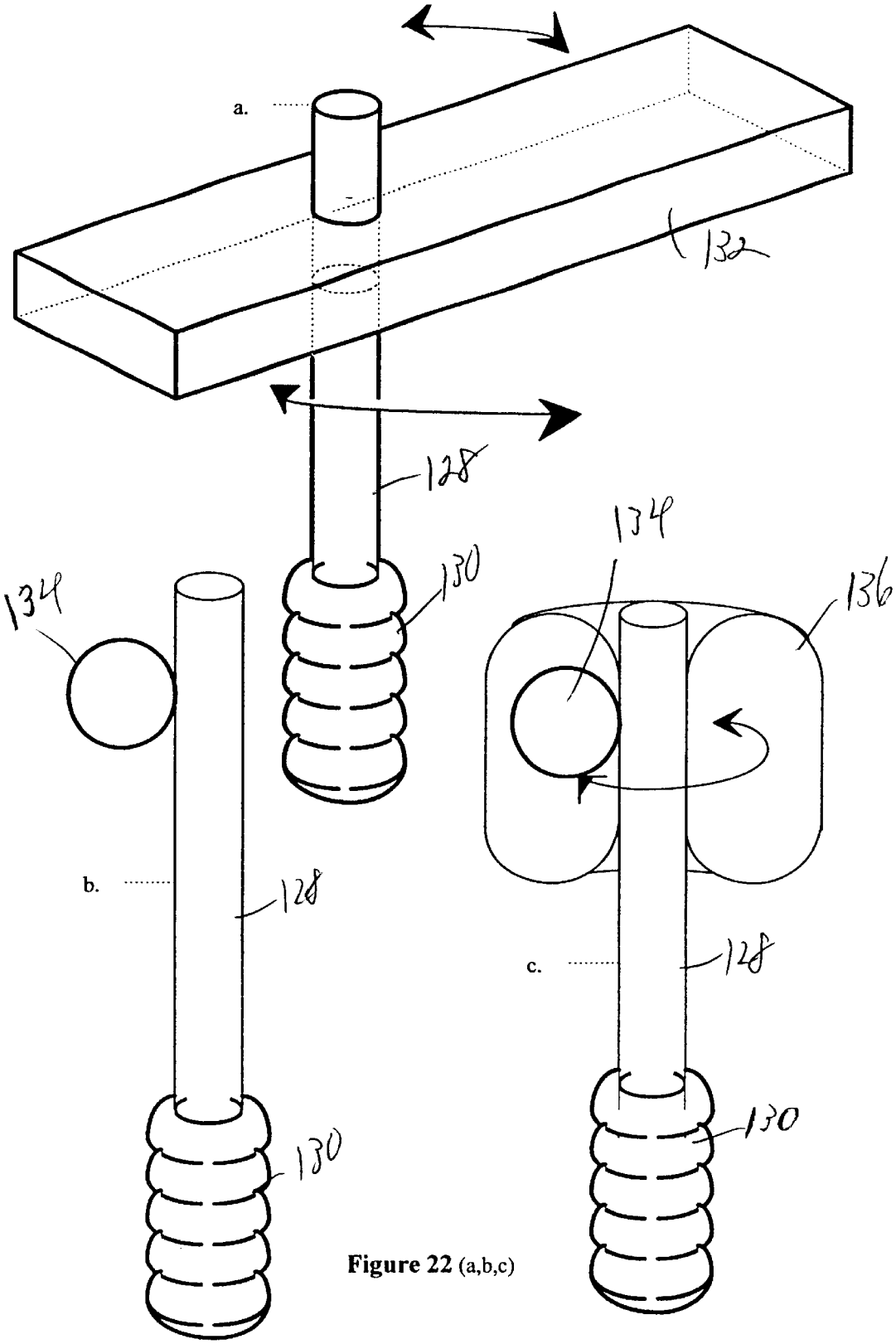
FIGS. 22*abc* is a perspective and sectional perspective view of a ramification where the distal segment is not stabilized, but remains free to move.

FIG. 22*a* illustrates the vertical component 128 which is the proximal segment, utilizing a handle 130 at the proximal interface and engaging the horizontal distal segment 132 at a cylindrical distal interface. This distal segment is free to rotate about the vertical axis of the proximal segment when the proximal interface is moved. FIG. 22*b* illustrates the magnetic attraction of the proximal and distal segments, shown here as a rod and sphere 134 in perspective. FIG. 22*c* is FIG. 22*b* with the addition of a containing structure 136 relative to the moving distal segment. A free distal segment affords the benefit of free motion in space but lacks the unweighting benefit of some methods incorporating a fixed distal segment.

Figure 23:
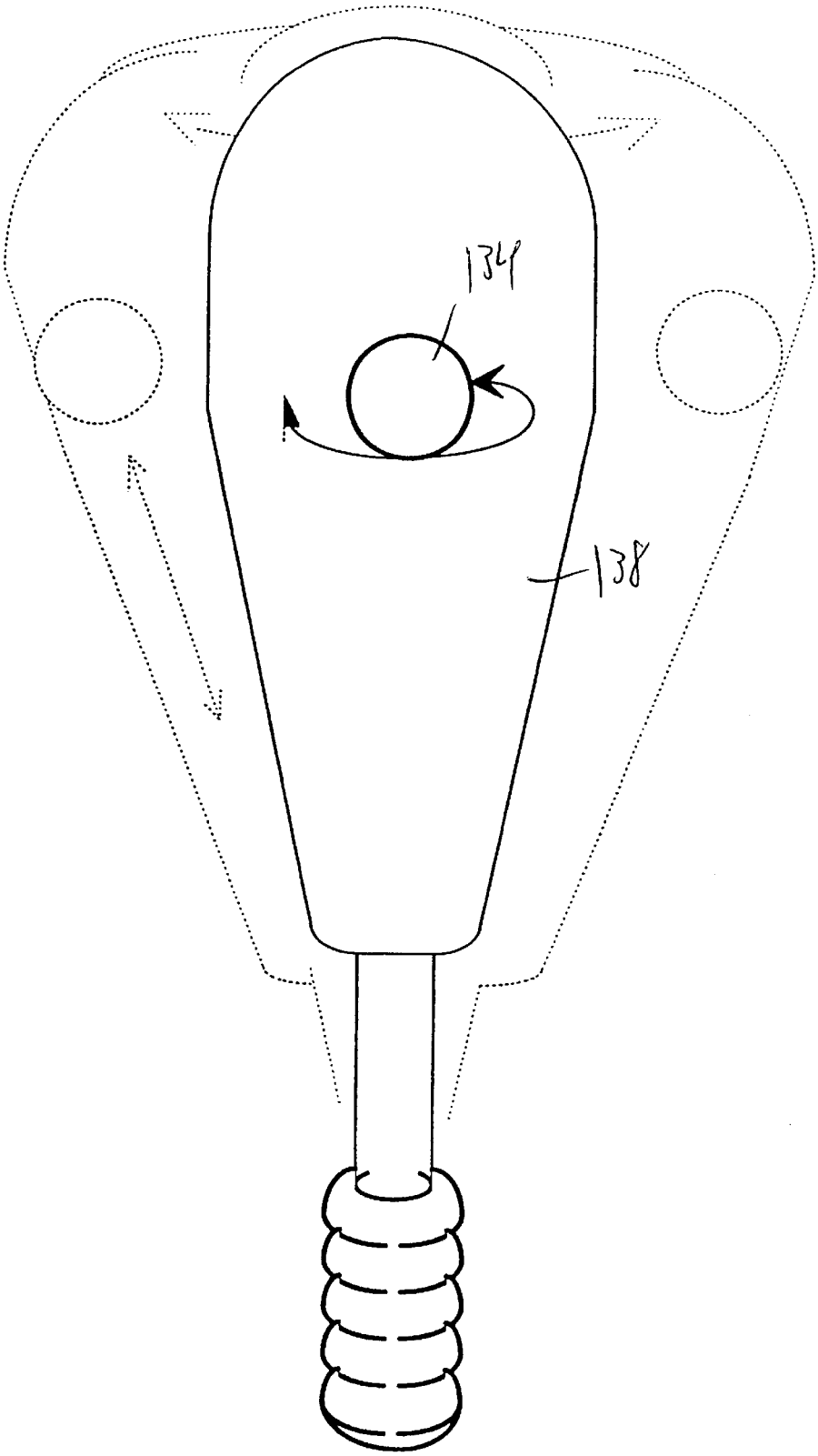
FIG. 23 is a sectional view of a ramification similar to FIG. 22*b* and FIG. 22*c* in that the distal segment is free to move, however, in this drawing, it is contained within a defined space. The defined space may be open, as shown in FIG. 23, or may contain internal tracks to direct the distal segment s path.

FIG. 23 is a sectional view of a ramification similar to FIG. 22*b* and FIG. 22*c* in that the distal segment 134 is free to move, however, in this drawing, it is contained within a defined space 138. The defined space may be open, as shown in FIG. 23, or may pontain internal tracks to direct the distal segment s path.

Figure 24:
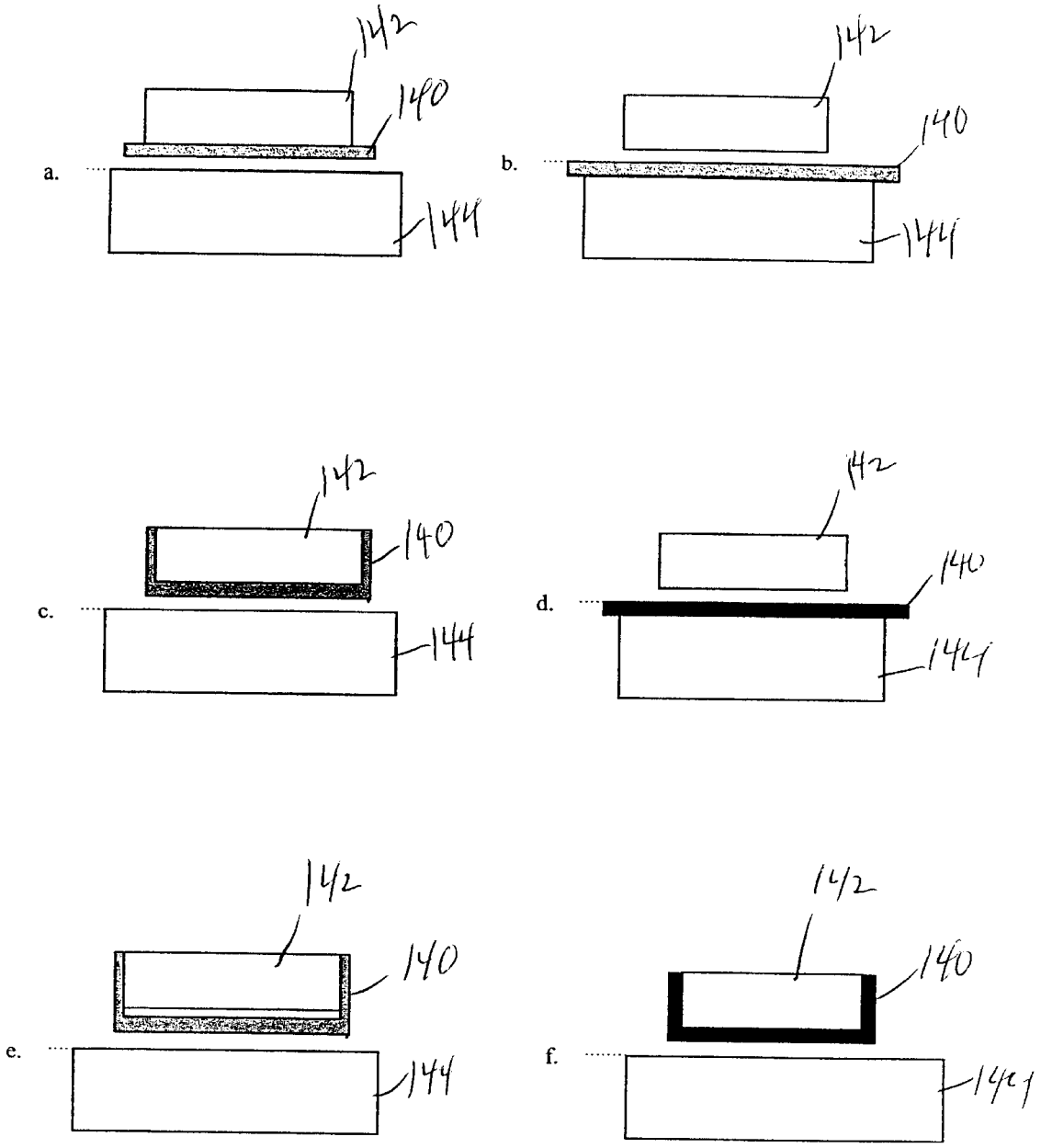
FIGS. 24*abcdef* is a sectional view of schematic proximal and distal segments with the addition of a barrier.
Figure 25:
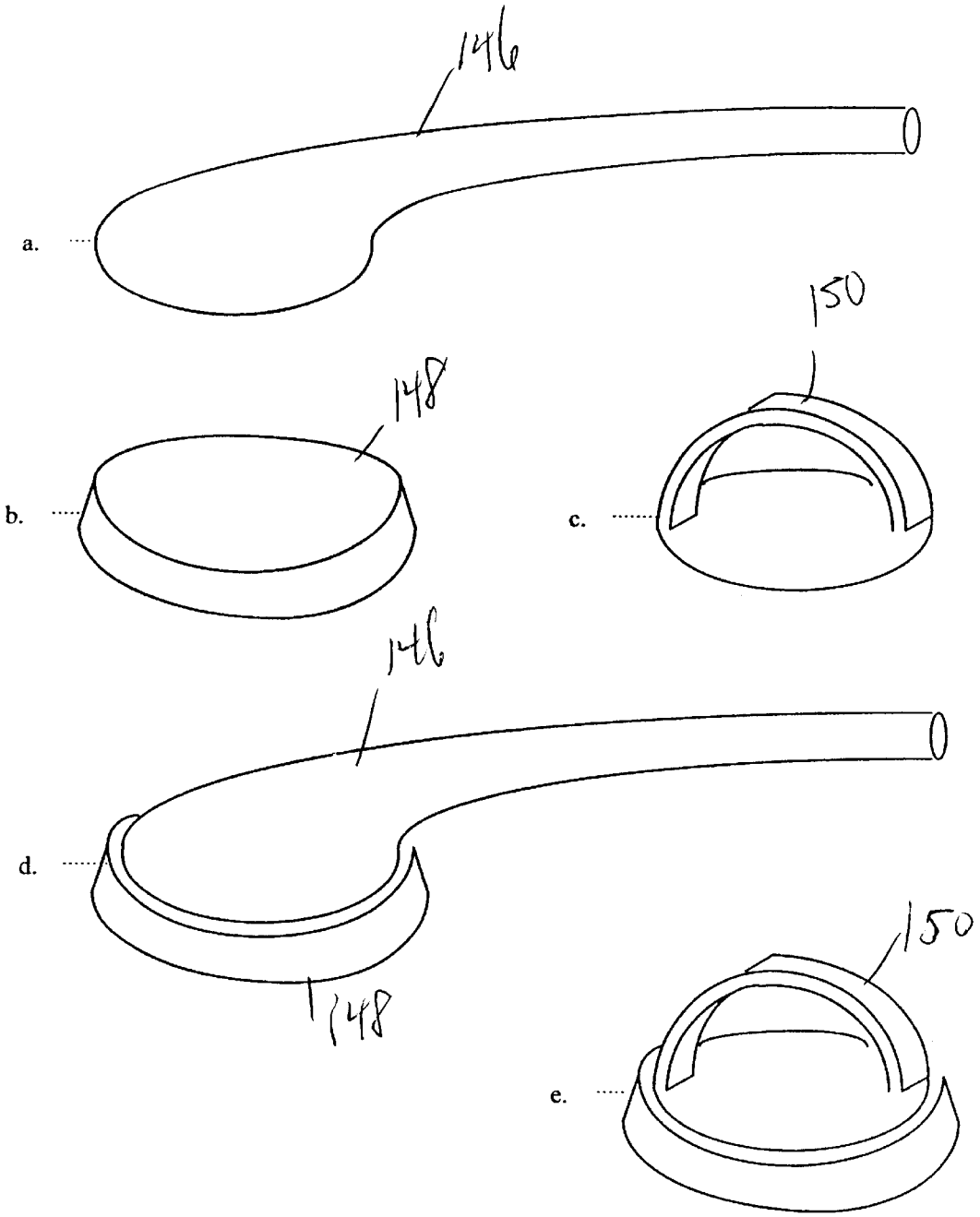
FIGS. 25*abcde* is a perspective view of various ways the distal interface may be mounted or coupled with the proximal interface (suggesting that the proximal segment may have interchangeable parts)
Figure 26:
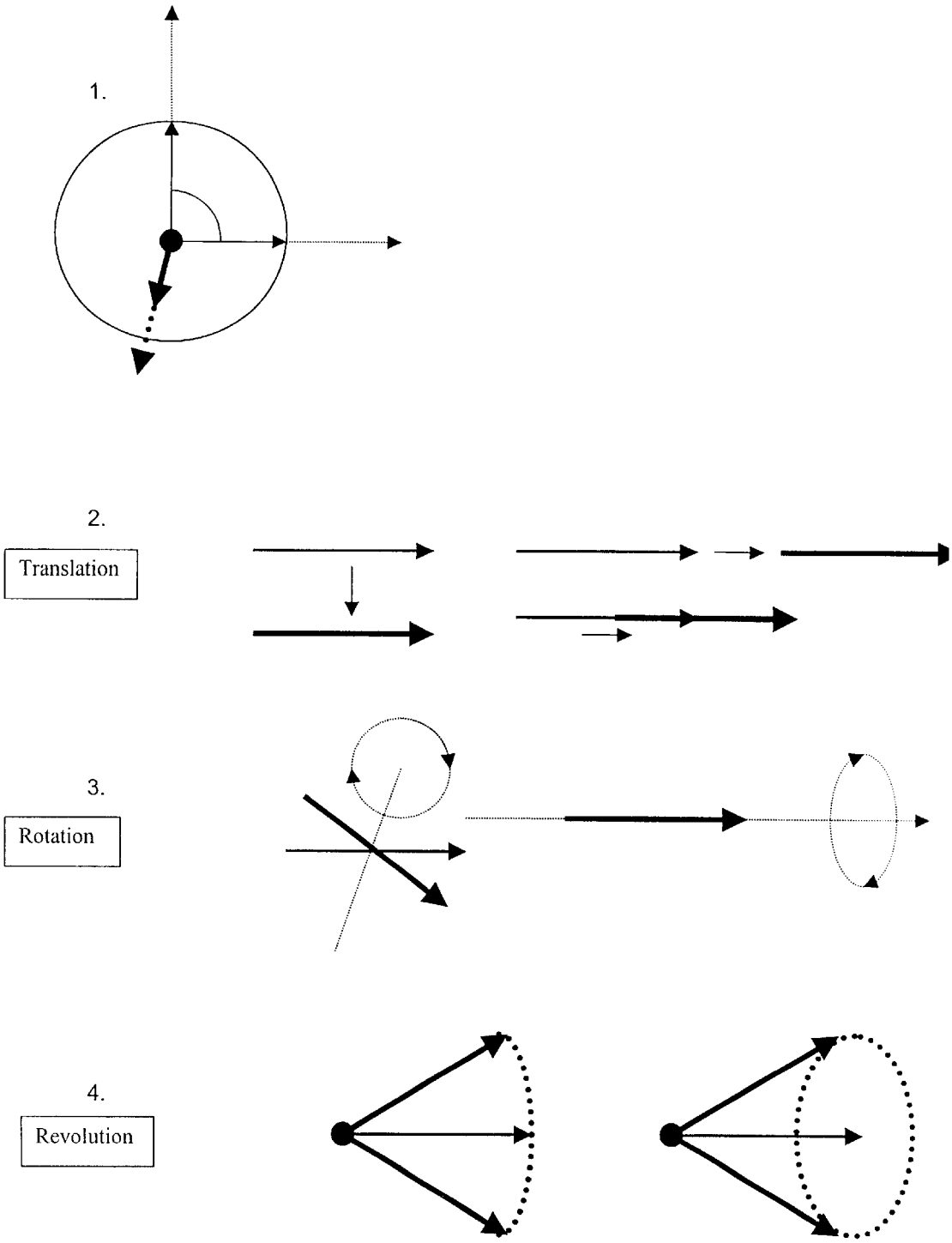
FIG. 26 is a schematic representation of spherical coordinates and motions. 1 Refers to a center point, a radius, and angle, and a surface that comprises a sphere. Displacement of the radius, or the longitudinal axis as it is referred to in the patent, may occur in relation to three general types of displacement, comprising a translation, a rotation, and a revolution. 2 Refers to two forms of translation, the first being Lateral translation whereupon the whole axis is made to move to the side, and the second of the two demonstrates longitudinal translation whereupon the axis is seen to either advance directly in the path along its axis outwardly (in reference to a center point) or to retreat toward the center point along the same axis. The diagram shows two ways of understanding an image of advancement along the axis. 3 Refers to Rotation about an internal axis. The first of the two shown demonstrates an axis piercing the longitudinal axis from the side, about which it rotates. The second diagram shows rotation about the central longitudinal axis itself. 4 Refers to revolution, or rotation about an axis that is not internal. This axis may be at the edge of the longitudinal axis as shown, or may be far more distant from the edge. Points are seen to orbit about such an external axis. The two diagrams represent two common motions that the body performs relative to a set point, which may be arbitrary. The motion of the center point remains relatively fixed while the opposite end of the longitudinal axis is seen to move along the surface of a sphere. The first of the two diagrams demonstrates simple angular displacement through an arc, or arcuate motion. If the axis is repeatedly alternated through the set point with equal arcs on both sides, the motion is known as angular oscillation. The second diagram demonstrates the free end of the axis to be orbiting about the set point. This motion is known as circumduction. Obviously, a combination of arcuate and circumductive motions may be seen to take a random path on the surface of the sphere, which may be the case for the fingertip at the end of an outstretched arm as well. The combination of revolution, rotation, and translation provides for all the motions available to the respective parts of the body. The body goes further however by implementing redundant degrees of freedom to account for a balancing effect on the mounting tensions in a body part. Joint Play is a phenomenon too which accouts for a smoothing out of motion and a reduction in the extraneous stresses transmitted to and absorbed by the component body parts. The fact that human activities are structured around the Cartesian Coordinate system, whereas the body is designed around the Spherical Coordinate system suggests that the body routinely absorbs undue stresses via joint play that cause havoc for the various joints. Conformity with the spherical coordinate system would reduce the magnitude of stresses the joints face, and would have a beneficial affect on the preservation of body structure, many of which regularly degenerate at a rapid pace for many individuals today, including the bones and joints, as well as the muscles/tendons and neurovascular bundles, all of which are found to adhere to other internal structures over time, accounting for the collapsing volume of available range of motion over time, falsely seen as an inescapable part of the aging process. By providing a device capable of accommodating for body movements, taking into account the design of the body articulations, This device provides the means to passively respond to an active use of the device by a person, or provides for an educational device if configured to move in ways which assist understanding of such motion, where driven by a force source.
Figure 28:
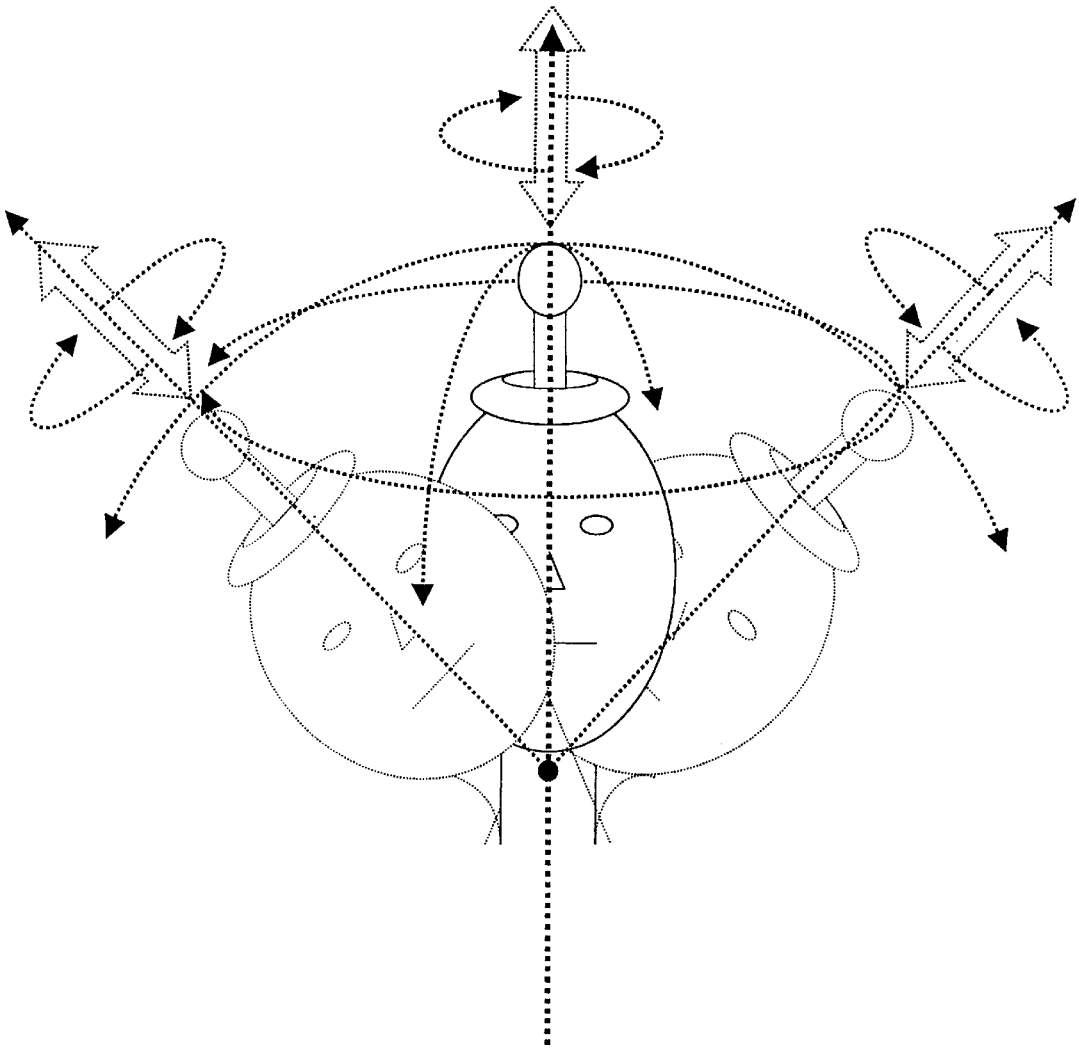
FIG. 28 is a schematic drawing of the application of this device to the head and neck. Zero reflects the rough center point of revolution about the neck. 1 reflects the longitudinal axis of the head and neck in the neutral position, which may be called the meridian of the crown of the head. The head and neck are shown to be capable of 2 axial rotation about this axis, as well as 3 angular displacement or arcuate revolution and 4 circumduction about the surface of the sphere. The longitudinal axis may be made to allow for longitudinal translation as shown by 5. 6 refers to the fact that displacement of the surfaces of the interface along a structure, such as a sphere affords each subsequent interface location the benefits of force interaction about the interface, that of static and dynamic forces mounting relative to the primary plane as stated above, which may itself shift depending of the surface configuration. In this way, each new point is found to have a determinable degree of inertia in every direction of available motion as provided by the interface. As such, sufficient degrees of freedom designed into the device allow a predetermined and variable degree of inertia in every direction, from every point in free space. Spherical coordinates will permit efficient interfacing with humans, animals, and robotics, or any other self contained entity, however, Cartesian coordinates may still serve to benefit some purposes.
Figure 29:
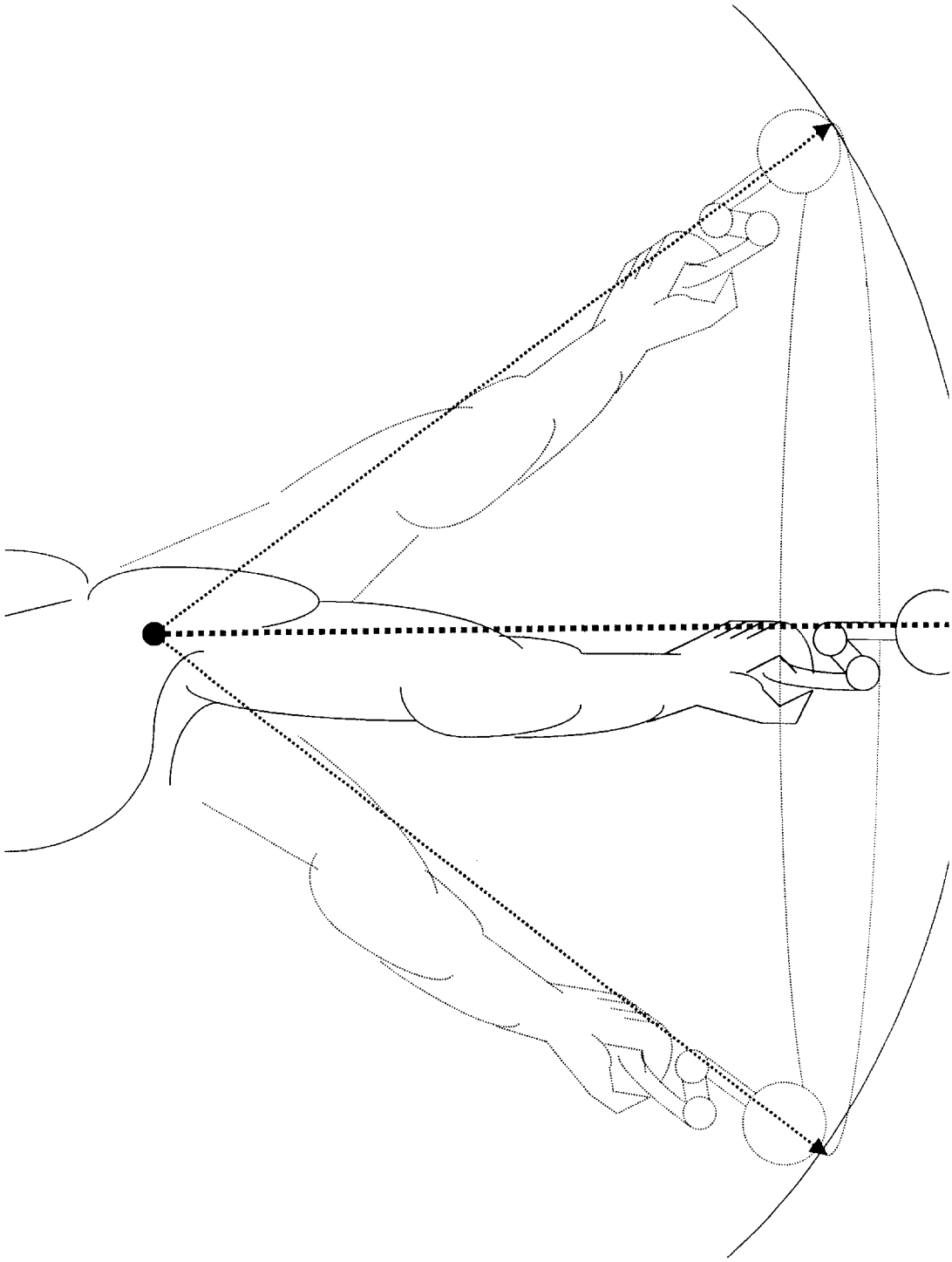
FIG. 29 is a schematic drawing of an outstretched arm utilizing a simple device involving a concave surface. This diagram is not as involved as the head and neck diagram, leaving out axial rotation, longitudinal translation, and the images of the moving primary plane and its forces. This diagram is intended to show a central point eminating from the shoulder, as opposed to the other joints of the arm, seen in subsequent images.
Figure 30:
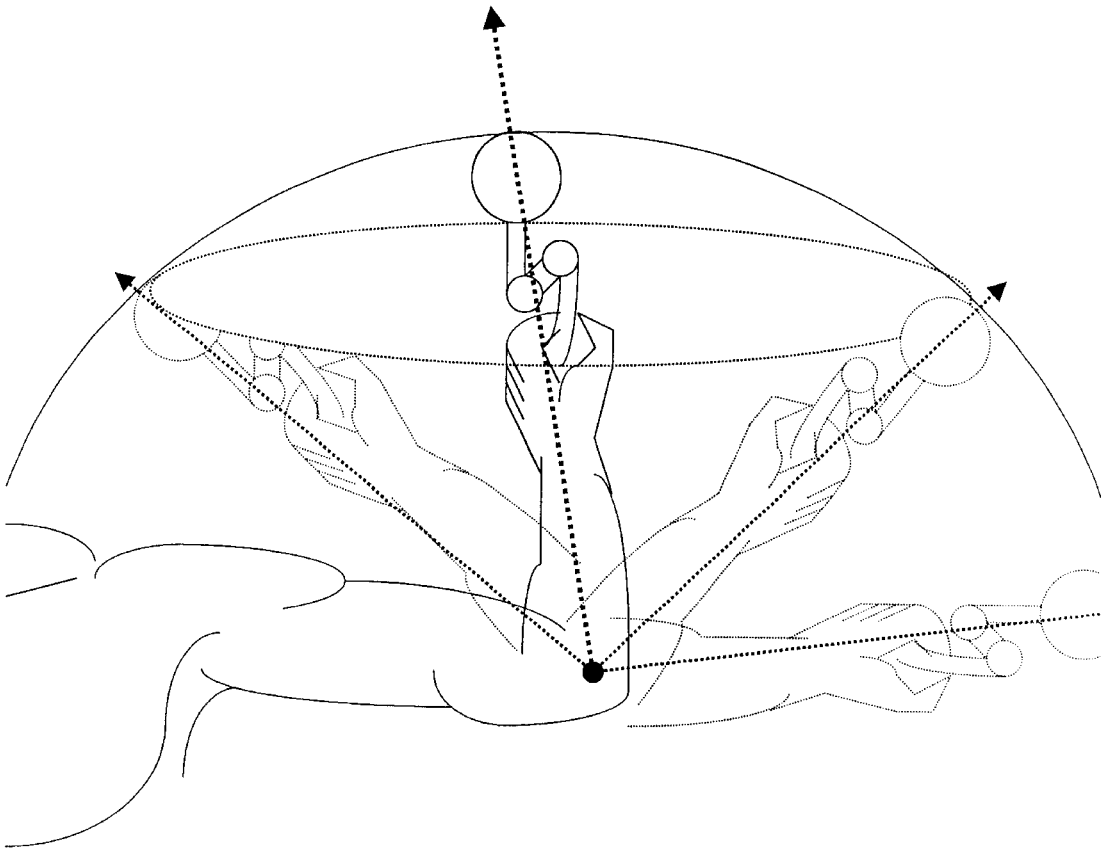
FIG. 30 is the same device now revolving about the elbow to show its functional significance.
Figure 31:
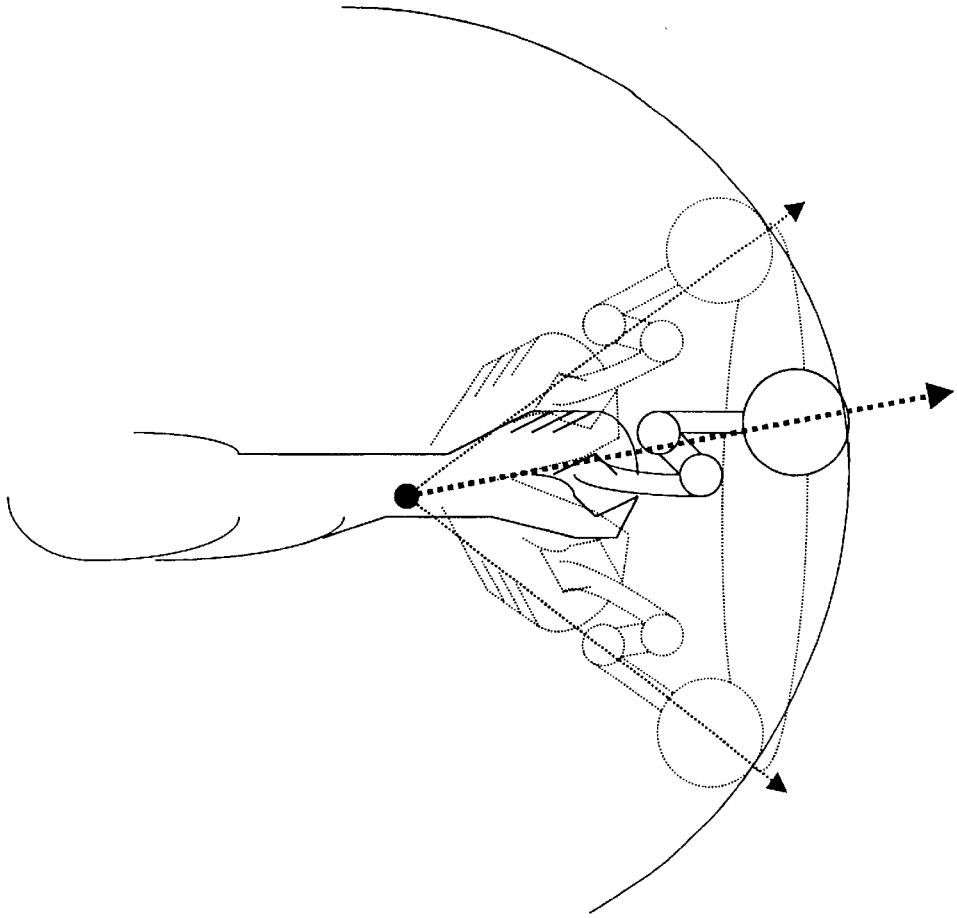
FIG. 31 is the same device again, this time at the wrist. The same components exist as they did for the head and neck, as with the elbow and shoulder, and the application of the device to the neck, back, or limb is applicable in a myriad of ways, limited only in that the application involves force transmission for the purpose of a function.
Figure 33:
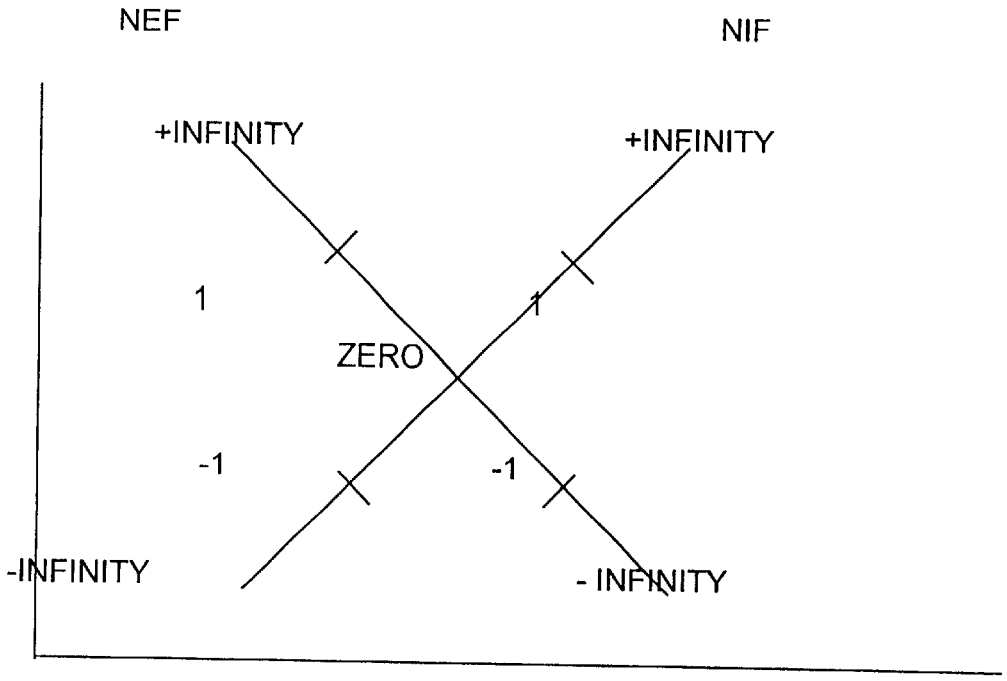
FIGS. 33–37 illustrate details of governance more fully explained below. In particular.
Figure 34:
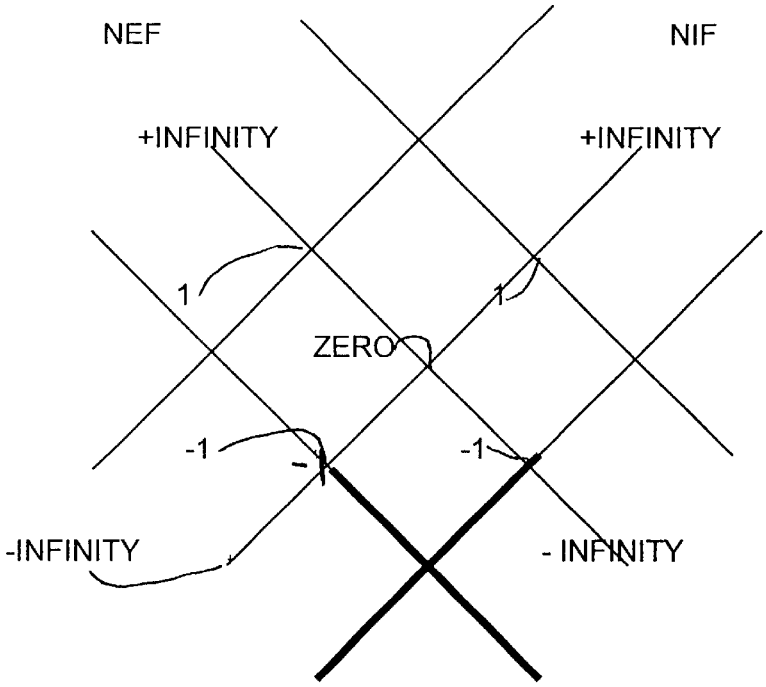
Figure 35:
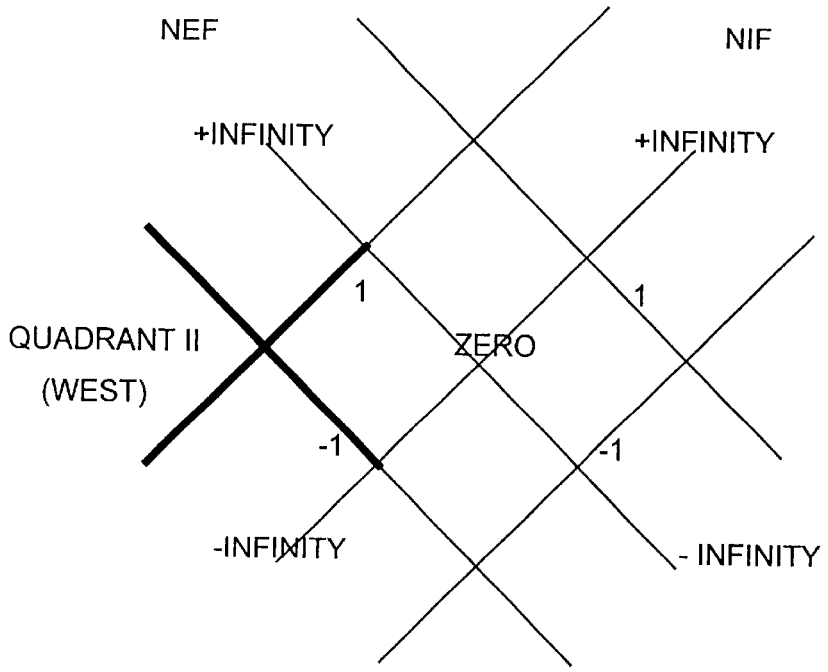
Figure 37:
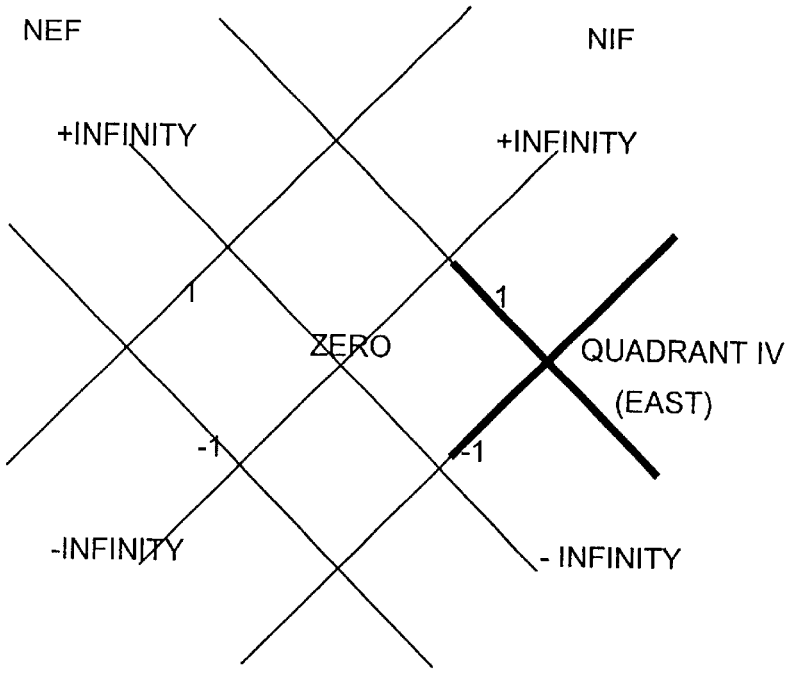
Figure 36:
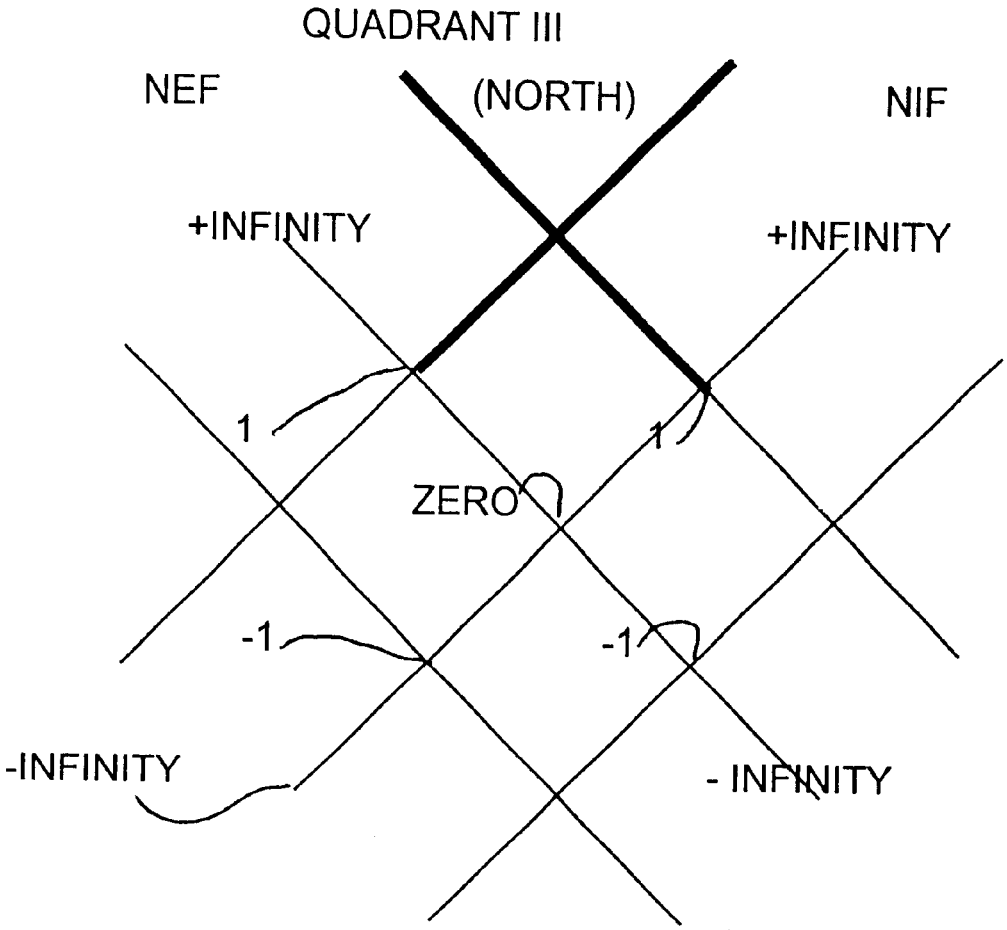
Figure 38:
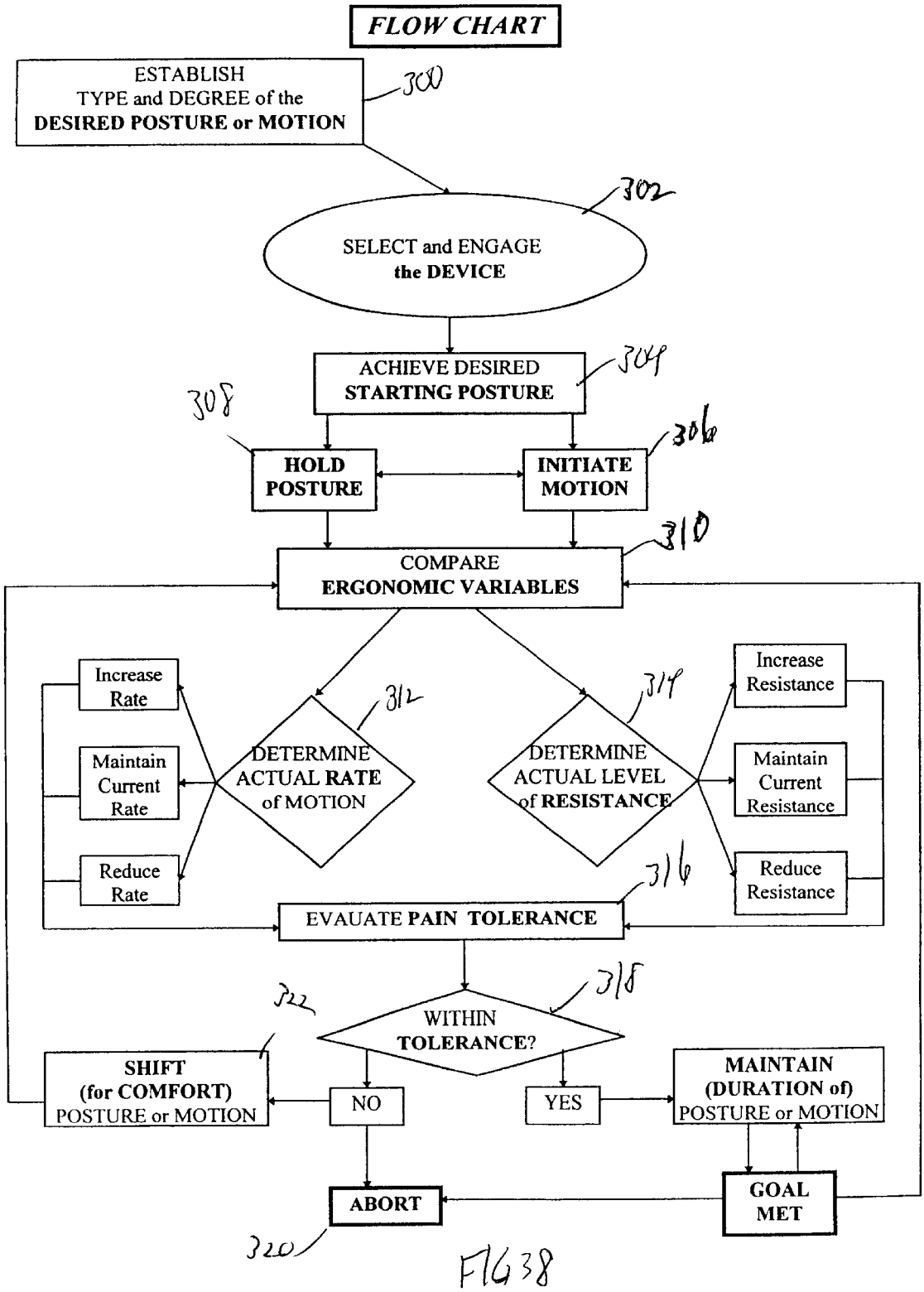
FIG. 38 is a flow chart illustrating the process for using the preferred embodiment of the current invention.

FIGS. 24*a*, 24*c*, 24*e*, and 24*f* each illustrate the barrier 140 coupled with the proximal segment 142. FIGS. 24*b* and 24*d* illustrate the coupling with the distal segment. FIGS. 24*d* and 24*f* suggest that different materials, textures, thicknesses or other variations on materials may be used for the barrier. FIG. 24*e* suggests that the distance between the proximal segment and the barrier itself may be varied FIGS. 25*a* and 25*c* are proximal interfaces 146 which may be mounted by various known mechanical means 150 to FIG. 25*b*, the distal interface 148 of the proximal segment 146, as shown in FIGS. 25*d* and 25*e*, respectively. Magnets of different strengths may be interchanged in this way, conceivably with various forms of proximal interfaces;

The individual is interested in evaluating an achievement index to subjectively govern the level of intrinsic force provided. The achievement index is a subjective ratio of an effectiveness index to a discomfort index. The effectiveness index rates the ability to achieve the desired goal by a percentage of a total effort that was provided by intrinsic forces. The discomfort index is an indicator of subjective discomfort relative to the system of forces present. Ergonomic variables are altered according to whether the magnitude of the achievement index is strong or weak subjectively.

Pain tolerance is also evaluated. Ergonomic variables, including force applied at the interface and rate of motion, are altered when the pain tolerance has either been exceeded, or when the pain tolerance has not been exceeded and the goal has been met.

Relative to human motion, the method consists of interfacing a device with a person s body part. For convenience only, a limb shall refer to any part or portion of the body which is to be coupled with the device. Such distinction may be afforded, for instance, to the head, forehead, jaw, mouth, arm, shoulder, elbow, wrist, palm, finger, leg, hips, thigh, knee, shin/calf, ankle, foot,. heel, toe, trunk, back, waist, buttocks, or any other body part.

Device segments are considered extensions of the body: termed proximal when closer to the body, and distal when farther. The device is comprised of two, or more, segments: the proximal segment and the distal segment. The proximal segment is coupled with and stabilized by a person, at the proximal interface (handle/orthotic/fixation device, etc.). The distal segment is stabilized otherwise. The distal segment may be engaged with the proximal segment at the distal interface (surface, track, etc).

At the distal interface, each segment houses a magnet, to exploit either repulsive or attractive forces; or, attraction may be exploited where one segment houses a magnet while the other houses a metal. Alternatively, electromagnets may be used for both surfaces to exploit either attraction or repulsion.

The distal segment surface is variably contoured. The proximal segment s distal interface surface is structured to engage the distal segment s surface. In this way, the distal interface surfaces are articulated or coupled. The topologic surfaces may vary to suit the motor pattern desired [(track: linear/curvilinear) (surface: planar/contoured)]. Distal segment surfaces examples include spherical: about the head, central axis (shoulder, hip, elbow, knee), or housing the entire body, or cylindrical: about the wrist and arm.

The distal interface of each device is configured to exploit an intended motion. By fixing motion to a plane, contour, or track, etc., motion is controlled. In this way, a desired motion may be exploited by selecting a particular device which has been designed to control the motion appropriately. When the proximal and distal segment surfaces are engaged, then, the intended motion is restricted to the plane/contour/track of the chosen device.

Human motion however is not linear, but radial in nature, and thus conforms to the architecture of the joints and the physiology of the supporting structures (bone, cartilage, capsule, ligament, tendon, muscle, connective tissue, skin, vessel, and nerve). In order for device motions to conform appropriately to human motions, while imposing as little restriction to human movement as possible, the distal interface architecture must accommodate well to radial motions generated at the proximal interface by the limb.

Furthermore, a joint must be able to withstand forces which act on the joint out of the plane of intended joint motion. Additional motions termed joint play are available in human joints to allow for such forces. Similarly, the device accommodates out-of-plane forces by incorporating additional ancillary joints, housed within either the proximal segment, distal segment, or both. By allowing for variance of the intended motion, ancillary joint motions prevent frequent disengagement of the distal interface surfaces, and effectively smooth-out the intended motion providing added comfort to the limb at the proximal interface. Both the proximal and distal segments may house joints independently, in series, in parallel, or both, affording various motions.

Human functions in space are in many ways like a motion picture. Sequential still frames combine to demonstrate the illusion of motion. Similarly human movements may be understood as a succession of infinitely brief postures. Human movement however is no illusion but is instead the manifestation of a continuous summation of a system of forces into a resultant net force, which has properties of direction and magnitude, and thus determines the orientation and degree of body movement changeably over time. An equilibrant force is one, which brings the system of forces into equilibrium, thus halting movement and promoting a posture of the body. Forces are said to be static when in equilibrium and dynamic when a resultant net force compels motion. Dynamics comprises both the study of Kinetics and Kinematics, the former dealing with mass and force and the latter dealing with position and motion, apart from the affects of force. Further, one force may add to the force of another synergistically or subtract from it antagonistically. In either case, the combination of forces may benefit a person, synergistically in the case of assisted effort and antagonistically in the case of resisted effort. Assistance or resistance may benefit a function by improving its effectiveness or its efficiency.

Individuals of every functional status stand to benefit from assistance or resistance of a task. Many forms of assistance benefit dependent and passive disabled individuals whereas many forms of resistance challenge the capabilities of elite athletes, thereby providing them benefit. Conversely, resistance to movements or postures may also benefit many individuals undergoing physical rehabilitation, whereas assistance to movements and postures benefit elite mountain climbers as well. In this way, a spectrum of physical functional status may be understood to exist, where at one end completely dependent passive individuals reside and at the other end independent elite athletes of every stripe reside. Every level of function lies in between, as does normality.

In short, a novel approach to assisting and resisting positions and motions relative to the functions of humans and devices will profoundly affect current shortcomings and future advances in this regard.

The goal of the current patent is to provide a device capable of accommodating for random static and dynamic human functions with defined degrees of freedom such that these functions are capable of being assisted and resisted.

A spherical coordinate system, rather than the better known Cartesian coordinate system, more suitably accommodates the architecture of human skeletal articulations and the postures and movements relative to the head, trunk, and limbs. This distinction underscores the vital role the act of revolution plays in human functions. Cartesian spectacles vex the appreciation of revolutionary body motions, by not accounting for them conspicuously. Accordingly, efforts to accommodate and improve human functioning have heretofore lacked sufficient emphasis on the inclusion and exploitation of revolutionary movements.

Spherical coordinates map space in terms of revolving a radius about a central point. Points along the radius take on variably arcuate movements in the process of revolution. The limits of a sphere in space are defined in this way.

This patent relates a longitudinal axis and a primary plane to these concepts. The radius represents the longitudinal axis. A plane tangential to the sphere at any point represents the primary plane.

Consider an example of a pointed index finger at the extreme end of an outstretched arm. The arm represents the radius, revolvable about a central point in the shoulder joint, capable of displacing the fingertip through an infinite array of arcuate movements, comprising a spherical surface. The longitudinal axis would thus traverse the center of the outstretched arm from the shoulder to the fingertip, and the primary plane would be perpendicular to the fingertip at every position of the finger, within the range of motion of the shoulder. The arm itself may rotate in both directions about the axis while the fingertip position goes unchanged. An outstretched arm may also be made to reach to varying degrees, effectively altering the longitudinal translation of the fingertip. Longitudinal translation may also be affected by extrinsic forces capable of pulling or pushing the outstretched arm along the length of the axis. Deformable soft tissues connecting the bones account for the subtle but existent longitudinal translation.

Now imagine the same outstretched arm with an object held by the outstretched fingers. For the purpose of this patent, the object may be understood as an extension of the body. Now the object is moveable along the same spherical path. This object may then be made to associate with the inner surface of a sphere. The common border between the object and the sphere represents an interface between appreciably convex and concave surfaces respectively. The object is said to be proximal to the body, in reference to the more distal sphere. The interface between the object and the sphere may be said to have a proximal surface on the object and a distal surface on the sphere. The kinematic interaction of these two surfaces is said to be the result of a kinetic system of forces, which operates at the interface. Similar forces exist if the object is made to interface with a flat surface instead of a sphere.

If the finger were to be made to move within a plane, as along a flat surface, then the primary plane would be parallel to that flat surface Given the prevailing spherical architecture of human joints, volitional displacement of an object by a single joint is generally angular and not linear. Objects may easily be displaced linearly by combining the degrees of freedom of multiple joints and by the contributions of joint play, which is the motion available at a joint, not under volitional control.

The to such a radius and a primary plane to a plane perpendicular to the radius and tangential to the sphere. As such this device exploits the forces present at the intersection of the longitudinal axis and the primary plane, particularly those which permit dynamic axial rotation and revolution of a member parallel to the primary plane at the interface.

This patent rests on the relationship of how two members move relative to the other at their common border or interface, having a primary plane, parallel to and between flat member surfaces or variably tangential to the interaction of contoured member surfaces. The primary plane functions to orient discussion related to forces at the interface. Force components parallel and perpendicular to the primary plane exist at the interface. Static forces exist both perpendicular to and parallel to the primary plane. Dynamic forces exist parallel to the primary plane also, whereas the device must be properly configured to permit dynamic forces to exist perpendicular to the primary plane, which is so claimed dependently subsequently.

The concept of the primary plane while perpendicular to the longitudinal axis is most usefully considered to be located at the extremity of the oblong moveable member or of any lever arm extending therefrom. The tangent to the crown of the head is parallel to the primary plane which is perpendicular to the long axis of the neck. As such, the intersection of the longitudinal axis of the neck with the primary plane of the crown with the head in the neutral position forms the meridian of the range of motion existent for the head in terms of neck motion. A neutral head posture may be likened to a neutral joy stick position. The extremity of the joystick may revolve about a central point while maintaining a given radius from that point, as if on the surface of a sphere. Similarly the crown may be displaced as if on the surface of a sphere with the central point displaceably located near the base of the neck. The crown may rest at the meridian or be displaced in any direction form the meridian latitudinally to a border which approximates a crude equator circumferentially said to be the barrier at the extreme range of motion for the head and neck in all directions from the meridian. In the neutral position, the longitudinal axis of the neck may also rotate in either direction as when shaking the head to signify no. Away from the meridian at any latitude, rotation and longitudinal motion in either direction may occur as well. Rotation through the meridian and latitudinal movement through the sagittal and coronal planes are Today head and neck range of motion measurements by the medical community are customarily limited to testing leftward and rightward rotation through the meridian and latitudinal movement to the barrier toward the front and back in the midline and toward each side in a plane perpendicular to the midline. The multitude of other movements, largely more functional ones still, used daily for a myriad of routine activities and insulted regularly by an array of debilitating processes remain as yet unexamined by the profession. Many resulting ailments again having root in the design of the anatomic componentry or the use thereof, so configured. Effectiveness and efficiency are measures best optimized by careful attention to the nature of a system s structure and function. Correspondingly, methods to assist and resist human functions bring about the greatest benefit when fully cognizant of the above. The head and neck signifies but one example amongst many where the spherical coordinate principles beg application, in that the body is organized about a central axis and several subordinate axes. The shoulders, hips, elbows, knees, wrists, ankles, and multiple joints in the hands and feet all may serve as the central point about which an axis revolves and therefore warrant close attention in this regard. Perhaps the most profound benefit will be recognized in relation to the trunk and lumbar spine. Low back pain is the most common musculoskeletal complaint noted by physicians, affects four-of-every-five lifespans, and costs employers billions annually.

Like the neck, the low back revolves about a central point and angularly displaces its longitudinal axis relative to spherical coordinates. Given that hard hones in the neck, back, and limbs are connected by soft tissues, there is often a mild degree of longitudinal compression and distraction available, providing play to the joint. The natural curves of the neck and back provide for further longitudinal translation of the spine that may not be readily apparent to either the examiner or the subject. Joint play motions go unnoticed largely because they are not accessible at will.

Joint play motions include motions available between the respective surfaces of the joint that are not under volitional control but exist to absorb extraneous joint stresses and to smooth out motion which may be irregular. Without play in human or mechanical joints, joint surfaces would tend to lock and forces wold not transmit properly causing undo stress and degeneration to surrounding joint architecture. Maintaining joint play in human joints is vital for prevention and treatment of mechanical degeneration or Osteoarthritis for these reasons.

Gentle translational displacement of the longitudinal axis generally benefits joint play. Lateral translation of this axis known as glide creates a dynamic shear force at the joint surfaces, whereas longitudinal translation of this axis known as compression or distraction creates a dynamic degree of compactness or separation of the joint surfaces, one relative to the other, having an affect on the proximity of the two. Similarly, rotational displacement of the longitudinal axis may benefit joint play. Rotation about an internal, centrally-placed axis known as axial rotation. Rotation about an axis at the surface or external to an object is known as revolution, where the object is said to revolve or orbit about a central point.

Governance

Governing processes rely on data. System governance considers data input and data output and a ratio thereof. Data relates to one or more variables. A variable may be absent or present. Where present, the influence or magnitude of the variable may be relatively low or high, relative to a standard or reference level. The reference level may represent a unit of some kind, a homeostasis, or any arbitrary measure. The absence of the variable may be of importance in a system. There may be a degree of absence, or magnitude of the opposite of the presence of the variable. Here too, there may be a reference level of the absence or opposite of the variable. In this way, the opposite variable s magnitude may be low or high relative to its respective reference level. In effect, the variable may be seen to exist at a magnitude from zero to infinity in both the positive and the negative direction. The reference level in both direction may be seen as the point of unity, either positive one or negative one. The continuum extends off in both directions from zero to infinity, comprising the set of real numbers. Cross-referencing two such variables allows for the two continuums to be analyzed in innumerable ways. The four main analyses to be made relate to the real numbers of each variable, either being positive or negative. As such, analyses include (+A, +B), (+A, −B), (−A, +B), and (−A, −B). Duel positive and duel negative groupings stress comparative influences, whereas mixed groupings stress contrasting influences. Each of these analyses can be cross-referenced separately, allowing for synthesis of the group ultimately.

Each analysis comprises the cross-referencing of two variables, either of which may be positive or negative in sign, ranging in influence or magnitude from zero to either positive or negative infinity. The coordinate spectrums are juxtaposed diagonally in respect to each other, with the zero point of each variable arbitrarily at the lower extremity of the continuum and the infinity symbol of each variable subsequently at the upper extremity of the continuum. The continua intersect at the point of unity for each, whether it be positive or negative. A horizontal line may be drawn below the X to represent the ratio of one variable to the other along its length, from zero percent of the total belonging to variable A and 100 percent belonging to B at the left, and 100 percent of variable A and zero percent of variable B at the right, with an equal percentage of each existing along a vertical line intersecting the point of unity. A vertical line may be drawn on either side of the X to represent the percent of each variable which is operable along its length, from zero percent to 100 percent for each variable. A horizontal line through the unity designates that each variable is operating at half of its capable capacity to do so. Alternatively, the horizontal and vertical lines intersecting the unity may represent a zone of homeostasis or relative normality, deviations from which are subject to governance, which has the effect of reinstating the homeostasis or normality. Each analysis may now be oriented according to its coordinates relative to the cross-referencing of one variable s primary continuum from negative infinity, through zero, to positive infinity relative to the other variable s primary continuum. Now the individual analyses, each with its own X configuration, fits into a space provided by a larger X configuration relative to the cross-referencing of the two primary continuums. Again, positive infinities arbitrarily grace the superior extremes of each primary continuum, while the negative infinities reside below accordingly. You will note the harmonic relationship of each minor analysis in reference to the major analysis. In effect, the duel positive, the duel negative, the mixed (+A, −B) and the mixed (A, +B) analyses reside at the North, South, East, and West quadrants respectively, although the orientation of each must allow the zero points on each minor cross-reference to touch the X of the primary cross-reference.

Herein lies the map of all real and imaginary numbers relative to these two variables. Any combination of these two variables has a place on this map. Wherein the two variables may be understood as existing at the extremes of a spectrum of their own, then the zero point represents the condition where the spectrum is neutral, irrelevant to the specified conditions, or outside of the experience of the agent for which the variables are being analyzed.

In the event that each variable is of the same class as the other, but related to separate agents, the analyses may be understood to reflect internal and external conditions relative to the A variable. As such, the variables may be seen to be working for each other in the vertical quadrants and against each other in the horizontal quadrants. The positive and negative designations are best understood as reflecting the presence of, and the varying influence or magnitude of, opposites. Which variable is attributed the positive sign or the negative sign is purely arbitrary; however, the distinction chosen is often for convenience or ease of understanding.

This mapping may be better understood in light of an example:

The system of forces, in the process of utilizing this device, is made up of intrinsic forces provided by the human to the device and extrinsic forces provided by the device to the human. These forces interact at the association portion, which either promotes a stasis or a dynamism at the interface. This tendency toward a position or a motion either is in support of the activity being performed by the human or is in opposition to it. Whether the forces at the interface support or oppose the action, the person may desire this interaction in reference to a particular goal In detail, the net intrinsic force (NIF) and the net extrinsic force (NEF) each promote either a position or a change in position, otherwise known as a motion. The four analyses in this regard reflect, as follows, the promotion of the same movement by both, the promotion of the same posture by both, the promotion of a motion by one and a posture or a different motion by the other, and the promotion of a posture by one and a different posture or motion by the other. With the NIF aligned on the rightward ratio and the NEF aligned on the leftward ratio, the analyses fall in the North, South, East, West quadrants respectively as before.

The state of each minor analysis is worthy of note here. The Northern quadrant demonstrates forces both of which support the same motion. Both the NIF and the NEF provide equal effort along a vertical line from the zero point through the unity point, whereas the ratio of contribution shifts along the horizontal line from 100 percent NEF and zero percent NIF at the left to zero percent NEF and 100 percent NIF at the right. The other quadrants have shifted in orientation such that the ratios are seen to form a perimeter around the zero point whereas the percentage of the possible variable that is operative emanates from the zero point to increase toward infinity, whether positive or negative in sign. Roughly, the percentage operable may be seen as radii directed from the center and the ratios may be seen as points orbiting the center. Alternatively, but likely less physiologically, one may perceive the coordinates for both the percentage operable and the ratio to reflect lines which are either vertical or horizontal intersecting the respective minor analysis X at the unity.

The Southern quadrant demonstrates promotion of the same posture by both the NIF and the NEF. The Western quadrant demonstrates promotion of balance, or positioning despite opposition to it. The Northern quadrant demonstrates promotion of the same motion; and the Eastern quadrant demonstrates promotion of power, or motion despite opposition to it. Both the Northern and Southern quadrants reveal a synergism between the NIF and the NEF, whereas the Western and the Eastern quadrants reveal an antagonism between the NIF and the NEF. All in all, depending on the functional goal, each combination can represent either an indicated or a contraindicated approach. The South supports acquisition of Range of Motion and opposes acquisition of Movement Coordination. The West supports honing Balance and opposes honing Power. The North supports acquisition of Movement Coordination and opposes acquisition of Range of Motion; and the East supports honing of Power and opposes honing of Balance. The functional goal directs the desired balance of NEF relative to NIF.

Generally, if static conditions are favored, an equilibrant force may be needed to bring the balance of NIF and NEF back into equilibrium, thus promoting a position. Similarly, if dynamic conditions are favored, a resultant force may be needed to tip the balance of NIF and NEF toward a desired prevailing motion, with a direction and a degree of magnitude. Knowing the goal of the activity, and being able to sense the NIF and NEF in the system of forces allows a governance process to apply variable forces where and when needed to guide the activity as desired.

Consider activity achievement for a moment. A task or skill must first be encountered before it can be accomplished. Generally, continued exposures and waning degrees of support may be needed for the skill to be accomplished with greater degrees of effectiveness. Once the skill has been qualitatively mastered, the participant may be incrementally opposed while achieving the skill to build quantitative degrees of efficiency. The pattern holds that dependent people may become independent people by affecting a decreasing degree of assistance as the individual s NIF is found to increase. Once the individual no longer need the assistance to perform the skill, the individual is said to be independent. Independent people may in turn desire to become athletic. They may do so by increasing the degree of resistance relative to the continued achievement of the skill under consideration. In short, the following sequence is needed to go from fully dependent to independent with a high degree of power: A) Complete assistance, no resistance; B) Partial assistance, no resistance; C) No assistance, no resistance; D) No assistance, partial resistance; and E) No assistance, complete resistance.

Posture is generally a prerequisite of Movement, as well. The five steps above may be used effectively initially for a posture and subsequently repeated for a motion related to that posture. Weaning assistance builds effectiveness and mounting resistance builds efficiency. Subsequently, the following steps may be optimized, relative to a posture and a related movement: A) Postural effectiveness; B) Postural efficiency; C) Movement effectiveness; and D) Movement efficiency. These four steps coincide with moving on the NIF/NEF map in the following respective sequence: South, West, North, and East, as mentioned above. When considering the ratios of these respective quadrants, exciting implications manifest as we tour around the map along this course. First consider quadrant I, the Southern quadrant. The horizontal line existent through its unity demonstrates the ratio of Intrinsic to Extrinsic postural support. Traveling from the right of this line to the left, the agent experiences a transition from zero percent NIF and 100 percent NEF to 100 percent NIF and zero percent NEF. A person moving in this position has just achieved independent functional status with regard to a posture, having been completely dependent previously.

Now consider quadrant II, the Western quadrant. Ascending along a vertical line that intersects the unity represents transitioning the ratio of the NIF supporting a posture 100 percent and the NEF supporting a change in posture (or a movement) zero percent to the NIF supporting a posture zero percent and the NEF supporting a movement 100 percent. Postural efficiency or balance is achieved in ascending this path.

Consider now quadrant III, the Northern quadrant. The horizontal ratio line which intersects the unity demonstrates a transition from 100 percent NEF and zero percent NIF support of a skill on the left to zero percent NEF support and 100 percent NIF support of that skill on the right. This movement has been achieved independently through the weaning of NEF as NIF became apparent. Lastly, quadrant IV, the Eastern quadrant, transitions the agent from activity effectiveness to activity efficiency as NEF progressively opposes the motion promoted by NIF. Accordingly, 100 percent NIF movement support and zero percent NEF positional support shift to subsequently provide zero percent NIF movement support and 100 percent NEF postural support. Here the activity is progressively resisted in the process of building power.

As such, posture is stabilized before movement is mobilized. The direction of the progression on the map in this case is clockwise. This direction is important for the purpose or goal of activation of a person, to increase their functional level of independence. This progression is important in the process of generating and maintaining life skills, especially in the first half of life. The opposite direction of progression is equally important on a subtler basis, as it is the progression toward rest, or relaxation and repair. This progression is especially important in stress reduction and the maintenance of the body during the phase of degeneration, or the second half of life. Dynamic motions are the focus of the clockwise progression, whereas static positions are the focus of the counterclockwise progression. Clockwise is to speed up toward performance and improve motor skills over sensory skills, whereas counterclockwise is to slow down toward awareness and improve sensory skills over motor skills. The former expands the capabilities; the latter expands the capacities.

Where a person has no experience with a skill, that person exists at the zero point relative to that skill. The interconnectedness of the ratios suggests that the acquisition of a skill relates to its nature. Some activities are stable postures or motions while others involve changeable postures or motions. The nature of the skill will determine the starting point and the direction of the approach to functional improvement as well. With continued exposure and an earnest effort at participating, individuals often gain a greater degree of influence or magnitude in the efficiencies and effectiveness of the motions and postures related to the skill, suggesting that the path takes on a spiral around the zero point, building in magnitude over time.

Depending on the goal of the person, governance of the respective force ratios, in the respective directions, at the magnitudes allowable will direct care most efficaciously. A person may accomplish this governance to some degree subjectively, however, current state-of-the-art is lacking in both the understanding and the means to instruct individuals on how to accomplish this on their own. Objective governance by means of a microprocessor or CPU will prevail as a means to both sense and affect the system of forces and other energies related to the device.

In order for the activity to progress as desired, the objective means will need to sense, transmit, process, and affect physical data. Processing of the data will involve the evaluation steps of recording sensed data, comparing actual data to ideal data, analyzing the significance of an identity or gradient related to the actual and ideal data, engaging the effector-mechanism responsible for the determined course of action, and reiterating the process continually. Physical energies will be transmitted to the device via sensors and from the device via effectors in order to govern the process. Sensors will consist of components which determine energetic, spatial, temporal, structural and functional parameters. Determinable parameters include: quality and quantity of radiation (electromagnetic waves including magnetic flux density, and light), conduction (force and torque), convection (heat), vibration (sound and positional oscillation) and gravity; position, length, volume, orientation, and magnitude; rate of change, rate of acceleration, time, duration. Magnetic flux and its governable effect on the degree of inertia (DOI) will be of particular interest, especially in regard to the predetermined and variable degrees of freedom of the articulated members. Real-time sensing of these parameters will afford continuous reference for activity modification. Effectors will provide forces for the purpose of supplying a resultant or equilibrant force to govern the activity. Additionally, effectors will facilitate the activity by use of energies, which enhance subjective awareness of the activity on a physical level as well as change the physical responsiveness to the tensions provided in order to optimize agent participation, effectiveness, and efficiency. Effectors, which create force or torque in order to affect the system of forces, include the use of a plurality of: magnetic flux sources, either for the purpose of affecting inertia directly or for the purpose of generating a motive force; motors; electromechanical fiber; hydraulics; and gears. Effectors generally are used to attach one member to another in such a way as to provide a conductive force at the interface. Forces may be directed by the specific locations on the members used for attachment, as with muscles and tendons, electromechanical fibers, and potentially hydraulics. Motors offer a method for continuous force generation and may be coupled with rolling or cam members to provide motion and variable forces as desired.

One goal is to facilitate the building or releasing of tensions in the system. As such the system is put under load. The body responds to the load by changing the orientation of the static equilibrant posture, subtly guiding the assistant or the assistive device to amplify the inherent motion in the system. The new orientation and position are held until release occurs, or amplification of the tension occurs as the case might be. Energetic modalities may be enlisted to assist in the subject s awareness and completion of the activity. Modalities are as described for energy transmission at the surface of the member. These motions will make themselves apparent in terms of translation, rotation, and revolution.

Associable portion may have numerous configurations, depending upon the goal of the activity. Unusual, but nonetheless functional association portions include a harness for the jaw, a gluteal trough, an ischial tuberosity donut, bladder pouces for hands or feet on variable height surfaces, lever arm extenders with propeller-like attachments or straps for free-end device handling by fingers, hand, toes, foot, heel, crown, nose, jaw, etc. The goal for each association is for the longitudinal axis of the object to be exploited in terms of the mounting forces at the interface relative to the primary plane. A person may position themselves in a flat or curved multi-tiered donut for the purpose of achieving Range of Motion and activities with variable inertias relative to the functions of the low back. A righting mechanism will return the individual to neutral upon completion of the activity or when desired. The device may be made to be modular, having detachable parts. The control switch will likely be on the proximal member as it is easily accessible.

Electromagnetic resistance may benefit the unweighting of the limb via imposed elevation coupled with a repulsion of the two faces. The repelling may allow elevation of a body part as desired and guided by a electromagnetic valve system. Soleniods may be used in parallel and series to create an electromagnetic fiber, capable of displacing attachment sites of a member in a predictable manner. The end result of the application of this device is likely to be profound.

DESCRIPTION OF THE FLOW CHART

The flow chart illustrates the process for using the preferred embodiment of the current invention. The desired posture or motion determines which device is to be selected (300). The involved limb and the type and degree of posture or motion pattern all must be considered when selecting a device.

Once chosen, the device is engaged, by both coupling the limb to the proximal segment at the proximal interface, and by coupling the proximal and the distal segments at the distal interface (302). Both proximal and distal segments may require additional set-up. For instance, the proper interchangeable part(s) may need to be selected and attached, as would be the case for detachable magnets of varying magnetic strength, polarity, or coefficient of friction. Similarly, barriers may be attached to either the proximal or distal segment surfaces at the distal interface as desired, in order to vary the magnitude of magnetic strength, the coefficient of friction, or both. The proximal interface may also be interchangeable, utilizing the same proximal segment, distal interface, and distal segment. Additionally, ancillary joints housed within either the proximal or distal segment may be modified to increase or decrease their utility or contribution to the overall degrees of freedom of the segment. In this way, the amount of play available and the resistivity of each joint, from fixed to freely moveable, may be altered. In the case of electromagnetic ramifications, these changes may be programmable or responsive to the positions and movements of the user.

Once the device is engaged, the desired starting posture is achieved (304). The starting posture, or position, is determined by the user's ability to remain engaged with the device, in terms of balance and limb stabilization. The force of gravity must always be considered. Some users may require assistance to achieve some postures. The preferred embodiment assists the user in the maintenance of a posture once achieved, not only due to the stabilizing effect of the magnetic attraction but also due to the inertial effect of the coefficient of friction. Having achieved the starting posture, the limb, or body, may be essentially at rest, or tension may be established in the system, in terms of a force moment, acting on both the person and the device.

Motion is initiated if a created force moment is sufficient to overcome the inertia associated with the coefficient of friction of both surfaces at the distal interface (306). Motion may be subtle or ballistic, patterned or random, functional or purposeless. Motion is caused by the user's intrinsic force, namely muscle activation, or some extrinsic force including gravity, the device (likely programmable), or another person. If the motion is directed, functional motions will be determined largely by the mechanical relationship of the users posture and the musculoskeletal apparatus involved. Further, the architecture of the distal interface and of the ancillary joints, as well as the user's available range of motion, strength, and endurance will bear on the motion achieved.

Alternatively, the user may refrain from moving as much as possible or elect not to move at all, in efforts to hold a posture (308). Prolonged stretching, isometric strengthening, joint stabilization, and balance may all benefit from this approach. The tensions required of such isometric approaches may be provided by the user's muscles or by extrinsic sources, and may be varied in time or degree, as is done with other forms of resistance.

Ergonomic variables consist of the posture or motion of the involved limb, and the rate, frequency, duration, and load parameters of a particular action (310). Postures are concerned with duration and load parameters. Motions are concerned not only with these parameters, but also with rate, and, if repeated, with frequency parameters as well (312 and 314). Each of these variables may impact on the user's comfort level, or pain tolerance, and so, must be compared as to their contribution and varied in their distribution and magnitude by the user accordingly. Generally, beginning with postures is easier than with motions. While holding a posture, forces may be mounted to create subtle, controllable motions. Motions which approximate postures are the easiest to first assume. These may include linear/curvilinear or circular/contoured motions, or oscillations, about a central point or region. As less assistance is required, or more range of motion or strength are achieved, motions may be progressively made more complex and dynamic, striving for improved balance/stabilization or coordination under increasing time or load constraints.

Pain tolerance must be evaluated by, the user all the while (316). If the current activity provokes discomfort that is not within pain tolerances (318), the activity may be aborted; or more preferably, the position or motion may be adjusted by shifting for comfort, and the ergonomic variables may again be considered for their possible contribution to the current discomfort. Commonly a user will sustain postures or perform motions rigidly, without variation. The tensions which mount in the involved tissues must be allowed to dissipate for the user to alleviate pains associated with sustained postures or stereotypic, rigidly performed motions. Joint Position Sense, or Kinesthesia, is a person's ability to sense tension and motions in the body. This form of body awareness must be optimized in the context of relaxed concentration. Extraneous body tensions, or tensed muscles peripheral to the intended activity, must be minimized so that the tensions pertinent to the intended activity are sufficiently sensed. Maximizing relevant sensations and minimizing irrelevant sensations improves the user's awareness of the relationship between body mechanics and discomfort. Improving this skill increases the user's intuitive knowledge of how to position or move one's self to reduce discomfort and pain secondary to mechanically disadvantageous circumstances. Resistance, rate, repetition, and duration each contribute to such mechanical disadvantages. Shifting for comfort and revising positions or motions in terms of specific ergonomic principles are the chief means of preventing and reducing discomfort and pain in the process of an activity, often precluding the need to abort an activity, and commonly affording tolerance to more complex and demanding activities under increasing time and load constraints.

Commonly, as discomfort mounts, it is helpful to reduce the rate or resistance associated with the activity. As comfort and duration goals are met, it is possible to increase the rate or resistance associated with the activity. If an activity is repeated, increasing its rate also increases its frequency. Duration of the maintained posture or motion is defined by the time-frame from initiation to abortion (320).

Shifting for comfort often involves moving in such a way that the structures under tension are relieved of such tension to some degree for varying periods of time, while the tension is distributed instead to other neighboring or remote structures in compensation. These shifting motions are generally subtle and brief and do not grossly distort the original posture or motion, but they need not be subtle (322). Further, the shifting is often out of the plane of the original tension. For example, if the original tension countered shoulder flexion, shifting motions would likely be in rotation or circumduction, while the flexion moment at the shoulder is largely maintained. Much of the shifting is volitional, but some may be avolitional, or out of the control of the user. Inability to control all motions underscores the importance of redundant degrees of freedom in mechanical systems. Joint play motions, both in the joints of the user and of the device, serve in this way to buffer extraneous motions, be it from shifting or otherwise.

DESCRIPTION OF EXERCISES, AS APPLIED TO THE FLOW CHART

Postural activities are-described above.

Range of motion or Stretching activities are used to increase flexibility. I will avoid the use of the term flexibility, as the terms flexing and flexion, while similar, suggest muscle contraction instead of stretching. Stretching involves moving a limb in such a way to allow greater range of motion. The range of motion of a joint is figuratively and literally contained within borders or barriers. Moving these barriers alters range of motion. Various approaches are used to expand the barriers to increase the range, including moving the limb toward, or even away from, the barrier. Movement toward and past the barrier is generally met with physical resistance of tight tissues, discomfort and possible guarding or muscular splinting of the individual. Movement away from the barrier is generally comforting and tolerable. Sustained tensions placed on the limb involved, in the plane desired, during a posture or a motion, have the benefit of forcing tissues to respond to the stress on the system. Muscles and other soft tissue respond to the sustained stress passively by elongating. Some tensions trigger muscular activation, or resistance to elongation, to stabilize the joints under stress or to resist the potentially injurious stretch of the muscle itself. If the supplied tension and the contraction are allowed to occur simultaneously, the contraction may be considered isometric if the forces are equal and there is no length change in the muscle, concentric if the muscle gets shorter, and eccentric if the muscle gets longer. Each form of muscular contraction has benefits for patients under certain circumstances. Indeed, stretching may occur in the context of motion as long as a tension remains on the system. Thus sustained, static, postural stretching may occur by adding a force moment in any direction to the posture, and sustained, dynamic stretching in one plane may occur with simultaneous motion occurring in a separate plane or planes. These positions and motions are accommodated by the flow chart process of the current invention, and especially well by the preferred embodiment.

Aerobic or endurance activities involve sustained motions that increase the heart rate above the resting rate. After approximately twenty minutes of moderate-intensity activity, the body shifts the means of burning fuel from primarily sugar sources to fat sources. Fat burning requires oxygen, and activities which use oxygen to bum fuel are called "aerobic." This level of activity is easily performed following the process guidelines established in the flow chart. These motions may be random, or more commonly repetitive in nature. The resistance to motion may be easily adjusted, but loads used should not be sufficient enough to cause fatigue, as greater endurance is the goal of aerobic activity. Endurance, or prolonged duration of activity, is best maximized by optimizing time constraints primarily, and load constraints secondarily. These activities thus have the qualities of relatively high rates of repetition and relatively low loads.

Anaerobic or Strengthening activities include those which burn sugar; a process which does not require oxygen. These activities have the qualities of relatively high loads and relatively low rates of repetition. These activities are meant to be fatiguing in order to improve strength, and thus are of brief duration. The flow chart describes motions, any of which may be made anaerobic by utilizing greater magnitudes of magnetic attraction or frictional coefficient.

Isometric activities are postural in nature, or may be said to approximate a posture, utilizing subtle motions out of the plane of the tension placed on the system. these exercise may have either fatigue or endurance as their goal, and so may be considered either anaerobic or aerobic respectively. The above comments include these activities.

Balancing and Stabilizing activities involve simultaneously contracting muscles of opposing functions, often to establish a base of support. Whereas motions are challenged by higher magnitudes of magnetic attraction and frictional coefficient, postures are challenged by lower magnitudes of the same. Thus, minimizing attractiveness, or using the repulsive quality of like poled magnets will serve to minimize the coefficient of friction at the distal interface coupling, promoting motion, instability, and imbalance. This relationship is best exploited by instructing a user to maintain a posture. To the degree that the device offen resistance to motion, the user will be assisted in maintaining stability or balance. As progressively less resistance is offered by the device, the user must provide increasingly more stabilization by intrinsic forces provided by the user's muscles or range of motion limitations. Thus, both range of motion, or stretching, and strengthening may benefit from balancing approaches, which may be performed as outlined by the flow chart.

Coordination activities involve sequentially contracting various muscles, with regard for proper timing, often to accomplish a functional task. As any complex task can be broken down into component postures and motions, any such task can be addressed from this standpoint by progressively coordinating the component postures and motion utilizing the flow chart process described. Vocational Rehabilitation is a prime example. Injured workers are returned to duty after implementing two subsequent programs: Work Conditioning and Work Hardening. The former stresses the positional, range of motion, aerobic, and general anaerobic approaches stated above, to abate the deconditioning influences common to all injuries. Work Hardening is a process of addressing the specific activities demanded of the worker at the worker's actual job. Sport-specific training is similar. These latter approaches build range of motion, strength, endurance, and timing parameters into the positions and motions the worker or athlete will actually use on the job or in the game. Activity-Specific Training requires tools which simulate function-specific postures and motions in such a way that time and load constraints may be optimized for a particular task. Many functions require tensions to be exerted out of the plane of the motions themselves. The beauty of the preferred embodiment relates to the combined resistances of the direction of the magnetic force and the perpendicular frictional resistance. While frictional resistance is largely dependent on the magnitude of magnetic force, either may be optimized selectively by the use of barriers of various materials, thickness, and texture. Ancillary joints in the proximal and distal segments permit out of plane motions, maintaining mechanical advantage during increasingly dynamic motions. The component positions and motions involved in most everyday tasks at home, at work, and at play are easily simulated by the preferred embodiment utilizing the flow chart process. Mopping, for instance, can be simulated by pushing and pulling a proximal segment, consisting of a magnet and a long handle, along a metallic surface on the floor. Place the metallic surface vertically, and the same apparatus may be used to simulate painting, or the like. The surface may be placed at any angle to simulate work on various grades, or the ceiling, for instance. The magnetic attraction may be used to unweight the limbs, allowing perpendicular motions without the need for excessive stabilization of the limb, reducing the "noise" of extraneous muscular tensions, and their associated discomforts. The benefit of such assisted-posturing is that users suffering from tightnesses, weaknesses, and discomforts are able to return to significant activities sooner. Additionally, the assistance may be weaned in a predictable and controllable fashion. Both elastic and magnetic materials are capable of providing such assistance, but only the latter provides additional controllable resistances to out of plane motions. While the preferred embodiment exploits the benefits of using magnets, the flow chart process may be exploited using other materials as well, including elastics.

The preferred embodiment achieves the above chiefly by implementing a new use of magnetic forces. Attractive magnetic forces are implemented when friction and thus resistance to movement is to be exploited. Repulsive magnetic forces are implemented when a frictionless or near frictionless system exploiting minimized resistance is desired. The simplest embodiment involves both a proximal and a distal segment, incorporating both a proximal and a distal interface. The proximal segment participates in both the proximal and distal interfaces, whereas the distal segment participates in the distal interface only. A person s limb engages the device at the proximal interface, which may vary in material, size, and shape for the purpose of accommodating to the particular structure, function, and comfort relative to the limb involved. The goal of the proximal interface is to transmit intended forces between the involved body part and the device. To do this, the interface connects the proximal segment to the involved limb in a secure yet comfortable fashion, while providing for freedom of motion of remaining parts of the body as desired.

The distal segment may remain free, similar to the end of a whip, and respond to motions set forth by the body, or it may be stabilized to some degree, as with a track system or a simple two dimensional surface fixed in a plane. Both the proximal and distal segments may benefit from incorporating joints within their structure. These joints lend the ability to derestrict the motion of the distal interface. They provide a physical buffer such that, although motion at the distal interface continues to conform to its architectural limitations, the actual limb moves freely in space, depending on the summated degrees of freedom afforded by the ancillary joints, provided in the segments.

ADDENDUM a joint, and either a stabilized or free distal segment.

Stabilized distal segment=Base

Motion occurs along the open or closed joint surface as the proximal segment, engaged with the human, moves relative to the stabilized distal segment, as controlled by the human (closed chain motion)

Vibrations/extraneous forces directed to human or absorbed by the device.

Free distal segment=whip

The open or closed joint allows motion along the contours of the segments dynamically such that resistances occur in stereotypic patterns: to and fro, circular, elliptical, or as otherwise defined by the human motion or the joint contours/articulations vibration/extraneous forces emitted by the free segment Consider fatigue. The activity can be performed, yet not enough energy to do so. Improvement here has to do with energy production and utilization. Substrate preservation, increased substrate stores, increased capacity to produce substrate, more output per unit substrate.

the problem current approaches face related evaluation, normal ranges and upper limits subjective patient suffering objective the problems Problems for individuals (pain and disability, aging, injury, weightlessness)

clinical significance causes of clinical entity treatment goals outcome populations everyone exists on the skills continuum social response/cost the multibillion-dollar fitness industry the following industries have a stake in the invention fitness medicine disability therapy human performance robotics mechanical engineering
virtual systems
aerospace
aeronautics
department of defense
Cost to society
multibillion-dollar industries are involved in motion
Low back pain is the #2 reason why people seek their doctor s advice. Taken collectively, musculoskeletal ailments . . .
current approaches and drawbacks
current approaches
Options:
Do nothing
Self initiate
Seek guidance
begin program
troubleshoot problem areas
ongoing feedback and progress The principles themselves, however, exist in physical terms and may be applied by a properly configured device in place of a human provider. With such a device, such principles are easy to grasp and utilize by individuals and may be applied safely within pain tolerances. A device, controlled by a patient, would have the added benefit of reduced pain and injury inflicted on such patients by inexperienced providers or inappropriate handling.

Pain is based on the tensions which are applied to tissues presently unable to dissipate the tension.

A device capable of unweighting the body part would afford conservative approaches:

routes how applied
access to the process/how it gets there
mechanisms how it works
modification of the process
what it acts on
problems
degree of use (is it used), of effect(does it work), of purity of effect (is it pure), reliability, purpose (is it useful).
does it meet the need, what does it do, what else does it do, is it made, utility, benefit (desired effect, signal), risks (undesired (side) effect, noise), reproducible gain.

Task competence exists on a continuum from complete dependence to complete independence. Intervention often stresses attempts to move a person from Dependence to Independence, on that continuum.

Goals of manual approaches are generally to increase or decrease motion, or improve motion control within a portion of the body, as appropriate. These approaches attempt to loosen tight or fixed structures and to tighten loose or dislocated structures, with the goal of progressing motion toward within normal limits. Stretching soft tissues and assisting motion are the goals where stiffness prevails, whereas strengthening muscles and assisting stabilization are the goals where laxity prevails. Where motion exists, control of motion is addressed by repetition of specific tasks under progressive load tolerance (strengthening) and various time constraints.

Braces, splints, various modalities, and medical pain control all may supplement proper biomechanical education and training where indicated.

Motion control may be seen as the ability to freely initiate, maintain, or quell motions of the parts, in the directions, to the degrees, at the rates, and for the purposes, desired.

The above means to accomplish exercise currently stack up as follows:

Free motion in all planes may be accomplished easily in all forms but friction.
The force of gravity acts on all loads for each form.
Pulleys, elastics, and to some extent friction provide a degree of unweighting of the load.
Pulleys and elastics may also provide a degree of longitudinal unweighting to the body part (distraction moment possible)
Friction alone provides reliable resistance to motion perpendicular to the plane of potential force.
Each conforms to implementation in a track system, especially a near frictionless track with means to vary friction utilizing low loads, with elastics to compensate for play.
Machines generally restrict motion to one plane, or potentially two planes, only, and may utilize cams designed to provide constant, progressive, or variable resistance relative to the plane of force.

All require exertion to stabilize body part relative to the plane of force. Thus all motion is biased by the plane of force.

Inertia is present in the longitudinal axis of the plane of force primarily. Similarly, the force of gravitation with its vertical bias may confound any intended motion pulley systems alter the directional pull of the load and subsequently vary the inertia of the load in directions which deviate from the longitudinal plane weights
must lift against resistance of gravity.
vertical force and horizontal force required to move weight during lift is not equal.
horizontal motion stresses the vertical more so than the horizontal joints stabilizers
forces in the vertical plane are different when lifting compared to lowering pulleys
plane of resistance is altered
otherwise, the above (for weights) holds true in that forces are biased to one plane
elastic structures
the plane of biased resistance can again be varied
multiple structures may be combined to finely control the position and motion in space, yet a set point must always be established, about which the stabilization of the apparatus is oriented.
friction
works well in the horizontal plane
may be varied as the plane approaches the vertical
varies with textures of materials used
varies with load of materials used
varies with coefficient of friction of materials used
opposed materials generate friction in any plane, however, load of the materials and of the body part used must be stabilized by the user, and may vary depending on the orientation to gravity.
track systems provide an attractive option by restricting the motion within certain parameters, thus stabilizing and providing some unweighting of the moving components and potentially the body part involved as well. Tracks require that the load and or friction be modified mechanically, and provide only stereotypic motions, unless coupled with other joints to provide multiaxial motions.

more aggressive means indication flowchart toward when this approach is indicated patients which fail conservative measures including physical, chemical, and cognitive approaches, generally seek more invasive approaches including surgery, or alternative medicine approaches. Many of the physical approaches are considered forms of alternative medicine, e.g. chiropractic, massage, acupuncture, myofascial release, etc.

aspects relative to this approach found in similar approaches their functions their compositions/make up (structures)

The different approaches to exercise may include aerobic anaerobic isometric passive stretch facilitated or directed motion therapeutic direct body work inductive indirect energy work accelerated conditioning The apparatus may be utilized for volitional activities (stressing function, and ultimately structure), or autonomic activities (stressing structure,.and ultimately function).

Whereas one is patterned and stereotypic, requiring exertion, applied, and task-based, the other appears random but is in fact customized naturally to unwind, liberate, maintain, dissipate energy while at rest with awareness and sustained relaxation, and is restoration-based.

drawbacks to prior/current approaches

Medical doctors are sought to assist those with physical ailments. While pain may respond to a chemical, disability usually requires a physical intervention. all but friction move against direct force, not necessarily a indirect force body configuration—specific motions occur in all planes irrespective to gravity. many motion types are poorly addressed by conventional methods overhead head/neck legs/hips/knees, especially when bent—out of pure flexion/extension planes natural body motions are non-linear and occur in all planes, irrespective of gravity Some motions are best achieved and developed with gravity controlled—can be used in weightlessness This approach offsets the effects of gravity efficacious reliable friction variation may used for ease efforts required of balance in that position posture provide feedback kinesthetically challenge effort of movement stabilize body part engaged reduce proximal stabilization required for distal motion dampen or create (vary) aberrant motions or vibrations reduce or augment (vary) extraneous play of joint assist postures functional uses exercise:

resistance training facilitated stretching AAROM via unweighting body sculpting aerobic—anaerobic spectrum in all planes of motion work conditioning and work hardening sport-specific training generalized conditioning therapeutic exercise with myofascial pain—allowing specific programs tailored to repetitive stress/cumulative trauma disorder strain sprain low back pain cervical, thoracic pain hip pain arm/shoulder pain leg thigh pain finger stiffness interossii pincer grasp, individual movements resistance in a weightlessness environment allowing preservation of muscle and bone tissue in space A significant drawback or manual approaches is that they must be provided by someone else. Patients must depend on care givers for such techniques and are at risk of habitual dependency, given the sensed benefit and the nature of the passive recipient role. No device as yet has supplanted the need for a person to implement the principles of such manual approaches.

drawbacks forge demands state the needs based on the drawbacks of current approaches a novel device/method solves problem A.B.C. . . .

Accomplishes desired function easy to manufacture easy to use reliable function over time present needs—based on drawbacks A device is needed to provide for these motions without the need for an observer-interface.

Human-device motion is easier to study than human-human interface, as a device may objectively record feedback and vary output quantifiably without bias.

demands create supply (which is then offered)

present invention as supply for demand, solution for problem the present invention fulfills these needs and provides other related advantages available motion—not accounted for by the engaged surfaces (intended motion)=play. The device may simplistically be conceived as having a proximal and a distal segment, as well as a proximal and a distal interface. The proximal interface is where the device is coupled with and stabilized by the person s body part, whereas the distal interface conforms to the engaged surfaces of open and or closed joints (not disengageable) via the architecture of the supporting structures (capsule, ligament, ball in socket). Therefore, force moment develop out of the plane/contour/track of the chosen device termed play, and are A human—mechanical interface which is capable of providing near frictionless motion to overwhelming resistances to motion in two or more dimensions of linear or curvilinear space.

In a process for assisting patients in assessing and augmenting range of motion, strength, balance, coordination, and endurance across various joints in the body. A body part is supported and or assisted in acquiring various postures for the purpose of strengthening in that posture and or facilitating motion related to that posture.

The motion related to that posture is dependent on the stabilization of both the body and the device as well as the available motion or degrees of freedom of the body part or parts engaged.

Assist the body part into the desired position.

Allow motion against variable degrees of resistance in all planes, specifically: longitudinal distraction/compression, axial rotation, and circumduction.

Both the body and the device must be stabilized to allow motion between them.

The body is engaged with the devise at the proximal interface.

The distal interface is where motion occurs within the device.

There may be multiple such distal interfaces, in series or in parallel.

Ancillary motions are provided by joints designed to provide desired play by various mechanisms: springs/magnets, attractive/repulsive. secondary to human motion, irregular contours, extremes of articulations, deformability of materials, interface instability, effects of materials in joints (fluid/solid). Play and ancillary motions may be smoothed by varying the composition or structure of the joint or engaged surfaces: cartilage analog. Deformable interface. Use malleable structures rather than rigid soft elastic compliant deformable, resilient. Consider use of bladders containing gas or liquid or particles allowing deformation. Fluids with variable pressures venting compartments high pressure diverticuli/hernias serving as fuses to pressure surge. Damping extraneous forces, vibrations as desired. Rigid structures are used to transmit forces appropriately. Vary transmission by material selected.

Absorb=disperse. Transmit=focus.

Means to vary available motion. Articular: number quantity. Architecture=quality. Periarticular materials: cartilage, capsule, bladders, deformable structures. Planes of motion: Axial, circumduction, longitudinal, translational. human=radial vs. Cartesian coordinate motion. Redundant planes offer buffer to motion, may vary contour or force with buffer.

Ancillary interfaces: active vs. passive(affects stability vs. affects mobility(restraining vs. facilitating)). Active: mobile interface, computer programmed, motor driven, assist/resist motion, teach motion—sequential approximations of target motions, permitted motions yet restricted to track. Fixed: provides counter-resistance for stabilization. Restraining: prevents motion past a point (directionally?), tether/ligament—spring/magnet (repulsive/attractive). Facilitating: augments/promotes motion directionally, elastic component, potential energy.

Interfaces may include handle, helmet, glove, boot, strap, garment, cage, etc. The human interface may also allow for movement or fit snugly.

Interfacing part vs. whole body (both mobility and stabilization afforded by device)

Righting response—a means to re-establish neutral or starting or desired position. Yoga balancing all limbs +/− trunkal portions reserve balance while compensating for revealed forces/distorted positions. Interfaces: contain limb/body part, afford means to stabilize vs. transmit resistance, transduces limb motion to stability vs. motion as desired. Thus both the body of the human and the body of the device must be stabilized in order to allow intended motion at the proximal and distal segment engagement and ancillary motion by the variously housed joints while interfaced with the human at the primary and ancillary interfaces.

Forces

The device directly utilizes the magnetic force (assist in the hold or promotes frictionless motion) while indirectly utilizes its moment of lateral inertia (provide resistance or lack of resistance to displacement in all directions within a chosen plane of motion).

Various purposes demand that the force of engagement be varied.

The degree of friction or resistance to perpendicular motion depends on the force of engagement.

Posture or motion may be assisted or resisted depending on the force of engagement.

Coefficient of friction depends on: (friction is varied to suit the resistance desired)

Means to vary resistance:

direction of magnetic field attractive/repulsive materials engaged texture of materials engaged smooth to rough surface area of material engaged depth of materials engaged proximal surface barrier solid
  interchangeable diaphragm or cassette distal surface barrier solid
  sheet modulator fluid barrier
  viscosity magnitude of magnetic field distance between materials engaged electromagnetic current number or couplings Force may be varied across a continuum—electromagnetically (dial current)

continuously over discrete ranges—mechanically (dial distance)

as with shifting gears in a car—variable speed strumming strings in a guitar—variable frequencies variable dial may show relationship to user discretely change magnitude of magnetic field: size: (area, depth), number change barrier to magnetic field (prox, dist, or distance)

semiconductor, insulator, air change materials
  magnet/metal change textures change distance Discrete function
  on/off switch
  engage/disengage
  reverse field lever/switch
  electromagnet.
  pull away, move to bigger barrier, decrease mag. force, move off surface mechanical, pneumatic, hydraulic, electric twist-on and twist off modules which are connected to magnets of various strength Continuous function Dynamic modulator—freeze/ease switch to stabilize or facilitate selectively in real time during exercise Distributive function distribute resistance to various motions to desired joints to afford a mobility/stability ratio to joints allowing relative ease and restriction in chosen planes of motion. dynamic distribution modulation by electromagnetics.

One embodiment may provide minimal friction for all but a particular face, which offers desired resistance, such that device accommodates to plane of effort so that resistance is offered in the plane only (which is dynamic due to the other joints).

Joints may be designed to minimized or maximize or vary resistance. Minimized friction may be useful for therapy, balance, robotics. The force of gravity must be addressed. Gravity acts on the body part as well as the load (weight of the device). The magnetic field s attractive force stabilizes the proximal to the distal surfaces, resisting the effects of gravity on the device. With fixation of the body part to the proximal segment, the degree of stabilization the body must offer to keep the body in that position is reduced, such that the body part itself is, at least in part, unweighted, and the body subsequently is more relaxed, permitting improved effort of stretch (passive stretch is more effective than active stretch). The force of gravity may be controlled for in part (gravity acts on body part and load). Gravity is not eliminated but its effects are reduced by the attractive magnetic force. Distal fixation offsets the need for proximal stabilization. This support unweights the body part thereby assisting in the acquisition of postures and related motions. Allows for isolation of distal motion more freely controlled secondary to reduced proximal stabilization. Relaxation affords further stretch. Interface thus becomes both means of posture/support statically, and means of resistance strengthening dynamically.

The starting point is variable in all directions along the surface. This benefit occurs in a gravitational field or in weightlessness.

A foreseeable embodiment involves electromagnetic modulation of attractive/repulsive forces throughout a mechanical system driven by computer program involving kinematic and kinetic sensors to allow further control of dynamic motions involved, as in robotics.

These may stand alone, or be interfaced with humans in the form of prosthetics/orthotics, assistive devices, therapy/performance/fitness devices, a physical interface to optimize the immersion experience of virtual systems, robotics, various NASA and defense purposes, and purposes where extension of the human form would benefit by a device allowing controllable postures and motions more distal to it or as a controllable extension of it.

Anatomically correct joint structures could utilize the magnetic benefits for purposes of indwelling artificial joints in humans or other animals. Anatomically correct joints, or modifications related to anatomically correct structures, may also serve to produce the framework for a humanoid robot, used for innumerable purposes for health or defense.

Flow Charts

Considerations motion planes distraction/compression rotation circumduction longitudinal displacement (translation)

axial rotation distal translation with proximal stabilization coupling human-device device —device device a—device—device b etc.

device

—device a+b+n . . .

friction modulation device surface material device surface material liquid electromagnetic modulation change magnets change thickness of surface material change liquid viscosity change external power modulation controlling motion at device joints Selections motion/usage body part(s) for motion mode of interface (distally)

mode of stabilization (proximally)

magnitude of attractive force magnitude of friction (coefficient)

degrees of freedom of motion device beginning position static vs. dynamic motion patterned vs. random motion stereotypic vs. functional motion facilitators distraction distracters vibration light/mirrors breathing static vs. dynamic held: low vs. high volume quantity smooth vs. staggered repetitive pant, glossopharyngeal, deep, forced sound/rhythm/buzzing/vibration pure frequency full spectrum random particular patterns: drop in water, other sine or interference odors/herbs light touch flow with turbulence/wind tunnel directional energy promote dispersion of release proximal joint adjustments Depending on region affected choose limb unweight→distract variably move to position of comfort/least resistance via circumduction and rotation
hold—allow adjustment to occur (release/adjust)
discern forces of tension
obvious→unwind
not obvious→test
attempt rotation in either direction
modulate longitudinal displacement moment
attempt directional circumduction
test a facilitator
amplify facilitator
change facilitator
combine facilitators
assess subject focus
point out tension noticed
point out region to relax
consider effect of gravity on system
consider positional change
regrip
change force of interface
change placement of interface
same location, alternate placement
change proximal/distal
change limb
combine limbs
Applications
Medical
objective data to correlate and coordinate diagnostic and therapeutic approaches
Human functional deficits related to intrinsic and extrinsic force production
Orthotic/Prosthetic
Ergonomic quantification
Workers compensation (Work conditioning and work hardening)
Computers
Activity (ob, sport, art, home) simulation
Virtual reality human-physical interface
Government
Aerospace
Military
Recreation
Theme parks
Synergistic vs. Antagonistic Governance
Capable of dynamically governing the balance of intrinsic and extrinsic forces to achieve goal of the activity
Where goveming includes the capacity to detect, transmit, process, and or emit/release forms of energy relative to the body-part and the device
Where energy forms are converted, recorded, and or programmed objectively
Where governing includes using objective evaluation by CPU or other means to receive, transmit, process, or emit energy signals
Including the step where the extrinsic force is modulated to affect the net bwlance of intrinsic and extrinsic forces
Where in the extrinsic forces are modulated to interact synergistically with the intrinsic forces such that the body-part is assisted by the device in achieving the promoted activity.
Wherein the extrinsic forces are modulated to interact antagonistically with the intrinsic forces such that the body-part is resisted by the device in achieving the opposed activity
Including the step of modulating the intrinsic forces as governed subjectively based on whether or not pain tolerance has been exceeded.
Goal relative to ergonomic variables
Objectively discern and decide the physical parameters energy signals relative to physical data
Including the step of sensing static and dynamic intrinsic and extrinsic data related to the body part, the device, or the material thing Including the step of modulating/introducing intrinsic and extrinsic energy, predetermined and variably, related to frequency and magnitude
Wherein the activity is governed by either the intrinsic or the extrinsic forces
Including the step of comparing ergonomic variables to assist in determining which variable to change based on the predetermined goal and the evaluated pain tolerance
Receive and transmit physical signals
Assistance vs. Resistance Influences
Assistance
unweighting body-parts
Unweight the body parts
Counter gravity
Resistance
Body part functional independence is promoted by successively weaning assistance from complete to partial then adding resistance as tolerable from partial to complete
Passive vs. Active
Passive as fully assisted and not resisted
Active as not assisted and not resisted
Resistive vs. Assistive
Resistive as
Assistive as
Single vs. Multiple Engagements
A plurality of body parts to interact with a plurality of devices respectively
Righting mechanism The Western Medical model is fixed in a chemical-focused bias without the means to progress toward utilizing physical approaches, given the lack of objectively measurable parameters for study as evidence of its benefit. Accordingly, resistances to movement are offered in many fitness centers as a means to increase power, however, other physical approaches await public mainstreaming, given that they generally require an assistant to provide the necessary forces to achieve the goal. No assistive device as yet conforms to the body s inherent spherical mechanics either.

There exists a profound need to stop throwing people away as they age. The disabled population is the largest minority population, and has the likelihood of affecting most everyone during their lifetime.

Although several embodiments have been described in detail for purposes of illustration, various modifications may be made without departing from the scope and spirit of the invention. Accordingly, the invention is not to be limited, except as by the appended claims.

What is claimed is:

1. A process for accommodating, improving, imitating or transmuting random static and dynamic human functions relative to an object, comprising the steps of:

selecting a device comprising a proximal member and a distal member which articulate relative to one another at an interface wherein energy is transmitted through the interface with a predetermined and variable efficacy, the interface being configured to permit a static force to have perpendicular and parallel components relative to a primary plane of the interface and to permit a dynamic force to have a parallel component relative to the primary plane, whereupon an inertia at the interface is affected in terms of a positive or negative affinity between the members and a proximity of the members to one another at the interface, such that either the static and dynamic forces attract the members toward one another at the interface urging a contact whereby a tendency for a motion of one member relative to another at the interface is resisted and a tendency for the interface between the members to remain in a statically opposed position is assisted, or the static and dynamic forces repel the members from one another at the interface urging a separation whereby a tendency for a motion of one member relative to another at the interface is assisted and a tendency for the interface between the members to remain in a statically opposed position is resisted, the device having a portion associable with the object;

associating the device with the object;

selecting an activity to accomplish the purpose of accommodating, improving, imitating or transmuting random static and dynamic human functions relative to the object; and providing a system of forces to the device which interact to bring about the selected activity;

whereby the device utilizes the system of forces provided to create a governable degree of inertia along the interface so arranged in predetermined degrees of freedom to accommodate, improve, imitate or transmute a myriad of random human functions including a static posture and a dynamic movement, resulting from a position, a translation, a rotation, or a revolution singularly at the interface or via a combination thereof.

2. The process of claim 1, wherein the proximal and distal members are connected by an attachment member which limits separation and allows for displacement at the interface.

3. The process of claim 1, wherein the device is articulated so as to allow smooth and free motions with variable degrees of freedom including redundant motions.

4. The process of claim 1, wherein the device includes a detachable component having a detachable member.

5. The process of claim 1, wherein the associating step includes the step of determining whether the object is associated continuously or intermittently with the device.

6. The process of claim 1, wherein the object comprises a human body-part.

7. The process of claim 6, wherein the associating step includes the step of associating the human body-part with the proximal member.

8. The process of claim 6, including the step of providing intrinsic forces from the human body-part and extrinsic forces from the device to provide the system of forces which interact to bring about the selected activity.

9. The process of claim 8, wherein the associable portion is capable of providing a net extrinsic force from the proximal member to the human body-part and a net intrinsic force from the human body-part to the proximal member.

10. The process of claim 8, wherein the associable portion comprises a manipulable surface or a conformable clothing capable of transmitting forces such as a handle, glove, shoe, sock, helmet, strap, or orthotic.

11. The process of claim 6, wherein the associable portion of the device effectively unweights the human body-part so as to counter the affect of gravity on the human body-part.

12. The process of claim 6, wherein the associable portion of the device conforms to the human body-part.

13. The process of claim 1, wherein the object comprises a mechanical part.

14. The process of claim 7, wherein the associating step includes the step of associating the mechanical part with the distal member.

15. The process of claim 1, wherein the associable portion of the device is configured to associate with both a human body-part and a mechanical part.

16. The process of claim 1, including the step of creating a net resultant force from the system of forces which creates motion of one member relative to another member.

17. The process of claim 16, wherein the system of forces applied at the interface act to resist movement of the proximal member relative to the distal member.

18. The process of claim 16, wherein the system of forces applied at the interface act to assist movement-of the proximal member relative to the distal member.

19. The process of claim 16, wherein the system of forces are created such that the motion of the object is initially assisted by the device and over time the system of forces reduces the degree of extrinsic force contribution as intrinsic force is offered and increased until the activity is performable without the assistance of extrinsic forces which then may be weaned completely providing the opportunity to subsequently enlist resistive extrinsic forces to increasingly antagonize the activity despite continued achievement of the activity in efforts to improve the function of the object.

20. The process of claim 1, wherein the proximal and distal members each have a face adjoining the interface.

21. The process of claim 20, wherein the face of either the proximal or distal member forms a track.

22. The process of claim 21, wherein the track includes gates for directing motion of the face of the other member.

23. The process of claim 22, wherein the gates are subject to governance.

24. The process of claim 20, wherein the face of either the proximal or distal member forms a cam surface.

25. The process of claim 1, wherein the interface comprises a plurality of interfaces arranged in either parallel, series, or a combination thereof within the device.

26. The process of claim 1, wherein the device comprises a plurality of devices which are associable with a plurality of objects.

27. The process of claim 1, including the step of introducing static magnetic flux density at the interface to affect the inertia at the interface.

28. The process of claim 27, wherein the magnetic flux is introduced by electromagnets.

29. The process of claim 1, wherein the dynamic force is created perpendicular to the primary plane of the interface.

30. The process of claim 1, wherein the energy transmitted at the interface of the proximal and distal members is variably adjusted using a barrier.

31. The process of claim 30, wherein the barrier includes the use of a bladder having fluid characteristics which affect the system of forces.

32. The process of claim 30, wherein the barrier includes a rolling member which allows linear displacement as well as angular displacement of one member relative to another member.

33. The process of claim 32, wherein the rolling member is engageable by a force providing source.

34. The process of claim 1, including the step of providing a plurality of magnetic flux density sources to create a holding or motive force at the interface.

35. The process of claim 1, including the step of providing a plurality of motor sources to contribute to a net force at the interface.

36. The process of claim 1, including the step of providing a plurality of electromechanical fiber sources to contribute to a net force at the interface.

37. The process of claim 1, including the step of providing a plurality of hydraulic sources to create a net force at the interface.

38. The process of claim 1, wherein the energy transmitted across the interface of the device comprises energetic radiation, conduction, convection or, vibration to affect a facilitation of the activity.

39. The process of claim 38, wherein the energy transmission is transmitted either to or from the object.

40. The process of claim 38, including the step of subjecting the energy transmission to an operable governance process.

41. The process of claim 40, wherein the operable governance process is created manually or electrically using a remote control and determined by a computer.

42. The process of claim 40, wherein the governance process involves the steps of creating, modifying and eliminating data.

43. The process of claim 42, wherein the modifying data step includes the steps of directing, magnifying, and distributing data.

44. The process of claim 40, wherein the governance process involves the steps of discerning, comparing, deciding, executing and repeating.

45. The process of claim 40, wherein the governance process affects the configuration and design of the interface and the forces applied thereto.

46. The process of claim 40, wherein the governance process affects a change in the direction of the applied force.

47. The process of claim 40, wherein the governance process affects the magnitude of the applied force.

48. The process of claim 40, wherein the governance process affects a change in the distribution of the applied forces both temporally and spatially.

49. The process of claim 1, including the step of sensing physical data related to the device and the object.

50. The process of claim 49, including the step of selecting a goal relating to the activity.

51. The process of claim 50, including the step of creating a governing force comprising either an equilibrant or resultant force which affects a shift in the balance of the intrinsic and extrinsic system of forces.

52. The process of claim 51, including the step of governing the governing force based upon considerations of the sensed physical data and the goal in order to direct the system of forces to facilitate accomplishment of the goal.

53. The process of claim 52, including the steps of evaluating the sensed physical data and repeating the governing process continually.

54. The process of claim 53, wherein the evaluating step is conducted using a microprocessor or computer.

55. The process of claim 49, wherein the sensing step includes the step of providing an accelerometer associated with the device.

56. The process of claim 49, wherein the sensing step includes the step of providing a gyroscope associated with the device.

57. The process of claim 1, including the step of evaluating pain tolerance.

58. The process of claim 57, including the step of altering ergonomic variables including force applied at the interface and rate of motion when the pain tolerance has been exceeded.

59. The process of claim 57, including the step of altering ergonomic variables including force applied at the interface and rate of motion when the pain tolerance has not been exceeded and the goal has been met.

60. A process for accommodating positioning and change in position for any given human body-part for the purpose of physically improving the human body-part function, comprising the steps of:

selecting a human body-part;

selecting a device comprising a proximal member and a distal member which articulate relative to one another at an interface wherein energy is transmitted through the interface with a predetermined and variable efficacy, the interface being configured to permit a static force to have perpendicular and parallel components relative to a primary plane of the interface and to permit a dynamic force to have a parallel component relative to the primary plane, whereupon an inertia at the interface is affected in terms of a positive or negative affinity between the members and a proximity of the members to one another at the interface, such that either the static and dynamic forces attract the members toward one another at the interface urging a contact whereby a tendency for a motion of one member relative to another at the interface is resisted and a tendency for the interface between the members to remain in a statically opposed position is assisted, or the static and dynamic forces repel the members from one another at the interface urging a separation whereby a tendency for a motion of one member relative to another at the interface is assisted and a tendency for the interface between the members to remain in a statically opposed position is resisted, the proximal member being associable with the selected body part wherein the associable portion of the proximal member is capable of providing a net extrinsic force from the proximal member to the human body-part and a net intrinsic force from the human body-part to the proximal member;

associating the device with the selected human body part;

selecting an activity for the selected human body part;

providing a system of forces to the device which interact to bring about the selected activity;

whereby the device utilizes the system of forces provided to create a governable degree of inertia along the interface so arranged in predetermined degrees of freedom to accommodate and improve a myriad of random human functions including a static posture and a dynamic movement, resulting from a position, a translation, a rotation, or a revolution singularly at the interface or via a combination thereof.

61. The process of claim 60, wherein the proximal and distal members are connected by an attachment member which limits separation and allows for displacement at the interface.

62. The process of claim 60, wherein the device is articulated so as to allow smooth and free motions with variable degrees of freedom including redundant motions.

63. The process of claim 60, wherein the device includes a detachable component having a detachable member.

64. The process of claim 60, wherein the associating step includes the step of determining whether the human body-part is associated continuously or intermittently with the device.

65. The process of claim 60, wherein the associable portion of the proximal member effectively unweights the human body-part so as to counter the affect of gravity on the human body-part.

66. The process of claim 60, wherein the associable portion of the proximal member conforms to the human body-part.

67. The process of claim 66, wherein the associable portion is capable of providing a net extrinsic force from the proximal member to the human body-part and a net intrinsic force from the human body-part to the proximal member.

68. The process of claim 66, wherein the associable portion comprises a manipulable surface or a conformable clothing capable of transmitting forces such as a handle, glove, shoe, sock, helmet, strap, or orthotic.

69. The process of claim 60, including the step of creating a net resultant force from the system of forces which creates motion of one member relative to another member.

70. The process of claim 69, wherein the system of forces applied at the interface act to resist movement of the proximal member relative to the distal member.

71. The process of claim 69, wherein the system of forces applied at the interface act to assist movement of the proximal member relative to the distal member.

72. The process of claim 69, wherein the system of forces are created such that the motion of the object is initially assisted by the device and over time the system of forces reduces the degree of extrinsic force contribution as intrinsic force is offered and increased until the activity is performable without the assistance of extrinsic forces which then may be weaned completely providing the opportunity to subsequently enlist resistive extrinsic forces to increasingly antagonize the activity despite continued achievement of the activity in efforts to improve the function of the object.

73. The process of claim 60, wherein the proximal and distal members each have a face adjoining the interface.

74. The process of claim 73, wherein the face of either the proximal or distal member forms a track.

75. The process of claim 74, wherein the track includes gates for directing motion of the face of the other member.

76. The process of claim 75, wherein the gates are subject to governance.

77. The process of claim 73, wherein the face of either the proximal or distal member forms a cam surface.

78. The process of claim 60, wherein the interface comprises a plurality of interfaces arranged in either parallel, series, or a combination thereof within the device.

79. The process of claim 60, wherein the device comprises a plurality of devices which are associable with a plurality of objects.

80. The process of claim 60, including the step of introducing static magnetic flux density at the interface to affect the inertia at the interface.

81. The process of claim 80, wherein the magnetic flux is introduced by electromagnets.

82. The process of claim 60, wherein the dynamic force is created perpendicular to the primary plane of the interface.

83. The process of claim 60, wherein the energy transmitted at the interface of the proximal and distal members is variably adjusted using a barrier.

84. The process of claim 83, wherein the barrier includes the use of a bladder having fluid characteristics which affect the system of forces.

85. The process of claim 83, wherein the barrier includes a rolling member which allows linear displacement as well as angular displacement of one member relative to another member.

86. The process of claim 85, wherein the rolling member is engageable by a force providing source.

87. The process of claim 60, including the step of providing a plurality of magnetic flux density sources to create a holding or motive force at the interface.

88. The process of claim 60, including the step of providing a plurality of motor sources to contribute to a net force at the interface.

89. The process of claim 60, including the step of providing a plurality of electromechanical fiber sources to contribute to a net force at the interface.

90. The process of claim 60, including the step of providing a plurality of hydraulic sources to create a net force at the interface.

91. The process of claim 60, wherein the energy transmitted across the interface of the device comprises energetic radiation, conduction, convection or, vibration to affect a facilitation of the activity.

92. The process of claim 91, wherein the energy transmission is transmitted either to or from the object.

93. The process of claim 91, including the step of subjecting the energy transmission to an operable governance process.

94. The process of claim 93, wherein the operable governance process is created manually or electrically using a remote control and determined by a computer.

95. The process of claim 93, wherein the governance process involves the steps of creating, modifying and eliminating data.

96. The process of claim 95, wherein the modifying data step includes the steps of directing, magnifying, and distributing data.

97. The process of claim 93, wherein the governance process involves the steps of discerning, comparing, deciding, executing and repeating.

98. The process of claim 93, wherein the governance process affects the configuration and design of the interface and the forces applied thereto.

99. The process of claim 93, wherein the governance process affects a change in the direction of the applied force.

100. The process of claim 93, wherein the governance process affects the magnitude of the applied force.

101. The process of claim 93, wherein the governance process affects a change in the distribution of the applied forces both temporally and spatially.

102. The process of claim 60, including the step of sensing physical data related to the device and the object.

103. The process of claim 102, including the step of selecting a goal relating to the activity.

104. The process of claim 102, wherein the sensing step includes the step of providing an accelerometer associated with the device.

105. The process of claim 102, wherein the sensing step includes the step of providing a gyroscope associated with the device.

106. The process of claim 104, including the step of creating a governing force comprising either an equilibrant or resultant force which affects a shift in the balance of the intrinsic and extrinsic system of forces.

107. The process of claim 106, including the step of governing the governing force based upon considerations of the sensed physical data and the goal in order to direct the system of forces to facilitate accomplishment of the goal.

108. The process of claim 107, including the steps of evaluating the sensed physical data and repeating the governing process continually.

109. The process of claim 108, wherein the evaluating step is conducted using a microprocessor or computer.

110. The process of claim 60, including the step of evaluating pain tolerance.

111. The process of claim 110, including the step of altering ergonomic variables including force applied at the interface and rate of motion when the pain tolerance has been exceeded.

112. The process of claim 110, including the step of altering ergonomic variables including force applied at the interface and rate of motion when the pain tolerance has not been exceeded and the goal has been met.

113. A process for accommodating positioning and change in position for any given human body-part for the purpose of physically improving the human body-part function, comprising the steps of:

selecting a human body-part;

selecting a device comprising a proximal member and a distal member which articulate relative to one another at an interface wherein energy is transmitted through the interface with a predetermined and variable efficacy, the interface being configured to permit a static force to have perpendicular and parallel components relative to a primary plane of the interface and to permit a dynamic force to have a parallel component relative to the primary plane, whereupon an inertia at the interface is affected in terms of a positive or negative affinity between the members and a proximity of the members to one another at the interface, such that either the static and dynamic forces attract the members toward one another at the interface urging a contact whereby a tendency for a motion of one member relative to another at the interface is resisted and a tendency for the interface between the members to remain in a statically opposed position is assisted, or the static and dynamic forces repel the members from one another at the interface urging a separation whereby a tendency for a motion of one member relative to another at the interface is assisted and a tendency for the interface between the members to remain in a statically opposed position is resisted, the proximal member being associable with the selected body part wherein the associable portion of the proximal member is conformed to the selected human body-part and capable of providing a net extrinsic force from the proximal member to the human body-part and a net intrinsic force from the human body-part to the proximal member;

determining whether the human body-part is associated continuously or intermittently with the device;

associating the device with the selected human body-part;

selecting an activity for the selected human body-part;

selecting a goal relating the selected activity;

providing intrinsic forces from the human body-part and extrinsic forces from the device to provide a system of forces which interact to bring about the selected activity;

sensing physical data from the device and the human body-part;

evaluating pain tolerance; and monitoring the sensed physical data and considering the selected goal in order to direct the system of forces to facilitate accomplishment of the selected goal;

wherein the system of forces includes magnetic flux introduced at the interface;

whereby the device utilizes the system of forces provided to create a governable degree of inertia along the interface so arranged in predetermined degrees of freedom to accommodate and improve a myriad of random human functions including a static posture and a dynamic movement, resulting from a position, a translation, a rotation, or a revolution singularly at the interface or via a combination thereof.

114. The process of claim 113, wherein the proximal and distal members are connected by an attachment member which limits separation and allows for displacement at the interface.

115. The process of claim 113, wherein the device is articulated so as to allow smooth and free motions with variable degrees of freedom including redundant motions.

116. The process of claim 113, wherein the device includes a detachable component having a detachable member.

117. The process of claim 113, wherein the associable portion of the proximal member effectively unweights the human body-part so as to counter the affect of gravity on the human body-part.

118. The process of claim 113, wherein the associable portion comprises a manipulable surface or a conformable clothing capable of transmitting forces such as a handle, glove, shoe, sock, helmet, strap, or orthotic.

119. The process of claim 113, including the step of creating a net resultant force from the system of forces which creates motion of one member relative to another member.

120. The process of claim 119, wherein the system of forces applied at the interface act to resist movement of the proximal member relative to the distal member.

121. The process of claim 119, wherein the system of forces applied at the interface act to assist movement of the proximal member relative to the distal member.

122. The process of claim 119, wherein the system of forces are created such that the motion of the object is initially assisted by the device and over time the system of forces reduces the degree of extrinsic force contribution as intrinsic force is offered and increased until the activity is performable without the assistance of extrinsic forces which then may be weaned completely providing the opportunity to subsequently enlist resistive extrinsic forces to increasingly antagonize the activity despite continued achievement of the activity in efforts to improve the function of the object.

123. The process of claim 113, wherein the proximal and distal members each have a face adjoining the interface.

124. The process of claim 123, wherein the face of either the proximal or distal member forms a track.

125. The process of claim 124, wherein the track includes gates for directing motion of the face of the other member.

126. The process of claim 125, wherein the gates are subject to governance.

127. The process of claim 126, wherein the face of either the proximal or distal member forms a cam surface.

128. The process of claim 113, wherein the interface comprises a plurality of interfaces arranged in either parallel, series, or a combination thereof within the device.

129. The process of claim 113, wherein the device comprises a plurality of devices which are associable with a plurality of objects.

130. The process of claim 113, including the step of introducing static magnetic flux density at the interface to affect the inertia at the interface.

131. The process of claim 130, wherein the magnetic flux is introduced by electromagnets.

132. The process of claim 113, wherein the dynamic force is created perpendicular to the primary plane of the interface.

133. The process of claim 113, wherein the energy transmitted at the interface of the proximal and distal members is variably adjusted using a barrier.

134. The process of claim 133, wherein the barrier includes the use of a bladder having fluid characteristics which affect the system of forces.

135. The process of claim 133, wherein the barrier includes a rolling member which allows linear displacement as well as angular displacement of one member relative to another member.

136. The process of claim 135, wherein the rolling member is engageable by a force providing source.

137. The process of claim 113, including the step of providing a plurality of magnetic flux density sources to create a holding or motive force at the interface.

138. The process of claim 113, including the step of providing a plurality of motor sources to contribute to a net force at the interface.

139. The process of claim 113, including the step of providing a plurality of electromechanical fiber sources to contribute to a net force at the interface.

140. The process of claim 113, including the step of providing a plurality of hydraulic sources to create a net force at the interface.

141. The process of claim 113, wherein the energy transmitted across the interface of the device comprises energetic radiation, conduction, convection or, vibration to affect a facilitation of the activity.

142. The process of claim 141, wherein the energy transmission is transmitted either to or from the object.

143. The process of claim 142, including the step of subjecting the energy transmission to an operable governance process.

144. The process of claim 143, wherein the operable governance process is created manually or electrically using a remote control and determined by a computer.

145. The process of claim 143, wherein the governance process involves the steps of creating, modifying and eliminating data.

146. The process of claim 145, wherein the modifying data step includes the steps of directing, magnifying, and distributing data.

147. The process of claim 143, wherein the governance process involves the steps of discerning, comparing, deciding, executing and repeating.

148. The process of claim 143, wherein the governance process affects the configuration and design of the interface and the forces applied thereto.

149. The process of claim 143, wherein the governance process affects a change in the direction of the applied force.

150. The process of claim 143, wherein the governance process affects the magnitude of the applied force.

151. The process of claim 143, wherein the governance process affects a change in the distribution of the applied forces both temporally and spatially.

152. The process of claim 113, wherein the sensing step includes the step of providing an accelerometer associated with the device.

153. The process of claim 113, wherein the sensing step includes the step of providing a gyroscope associated with the device.

154. The process of claim 113, including the step of creating a governing force comprising either an equilibrant or resultant force which affects a shift in the balance of the intrinsic and extrinsic system of forces.

155. The process of claim 154, including the steps of evaluating the sensed physical data and repeating the governing process continually.

156. The process of claim 155, wherein the evaluating step is conducted using a microprocessor or computer.

157. The process of claim 113, including the step of altering ergonomic variables including force applied at the interface and rate of motion when the pain tolerance has been exceeded.

158. The process of claim 113, including the step of altering ergonomic variables including force applied at the interface and rate of motion when the pain tolerance has not been exceeded and the goal has been met.

* * * * *